United States Patent [19]

McKay et al.

[11] 4,025,757

[45] May 24, 1977

[54] VOTING SYSTEM

[75] Inventors: Richard H. McKay, Oak Brook, Ill.; William R. Smith, Morristown, N.J.; Herman Deutsch, Raleigh, N.C.

[73] Assignee: Video Voter Inc., Chicago, Ill.

[22] Filed: Feb. 26, 1976

[21] Appl. No.: 661,836

Related U.S. Application Data

[63] Continuation-in-part of Ser. No. 543,322, Jan. 23, 1975.

[52] U.S. Cl. ..... 235/54 F; 235/51

[51] Int. Cl.[2] ..... G07C 13/00

[58] Field of Search ..... 235/51, 54 F

[56] References Cited

UNITED STATES PATENTS

| | | | |
|---|---|---|---|
| 3,227,364 | 1/1966 | Clark | 235/54 F |
| 3,710,105 | 1/1973 | Oxendine et al. | 235/54 F |
| 3,739,151 | 6/1973 | Moldovan et al. | 235/54 F |
| 3,779,453 | 12/1973 | Kirby et al. | 235/54 F |
| 3,793,505 | 2/1974 | McKay et al. | 235/54 F |

*Primary Examiner*—Ulysses Weldon

*Attorney, Agent, or Firm*—McWilliams & Mann

[57] ABSTRACT

A voting system includes a vote head with a plurality of selector switches for actuation by a voter to indicate choices of candidates, bond issues, referenda and other questions. Switches on the vote head control the drive of a film projector for displaying successive frames of election questions and, after all the selections have been made and reviewed, to transfer the voting information to a data center. The data center generates a train of data pulses for passage to the vote head, continually scanning the switches. Signals are returned from the vote head, indicating the change in status of any switch or indicator lamp. The data center is controlled by a program, in hard-wired circuits and in a memory circuit, for regulating the scanning of the vote head and the registration of the votes. The portion of the program unique to the particular election is stored in the memory from a tape prior to the election procedure. At the end of the election the accumulated vote count —temporarily stored in another memory of the data center—is recorded on the magnetic tape, and also can be read out from the memory display area of the data center.

21 Claims, 70 Drawing Figures

FIG. 5
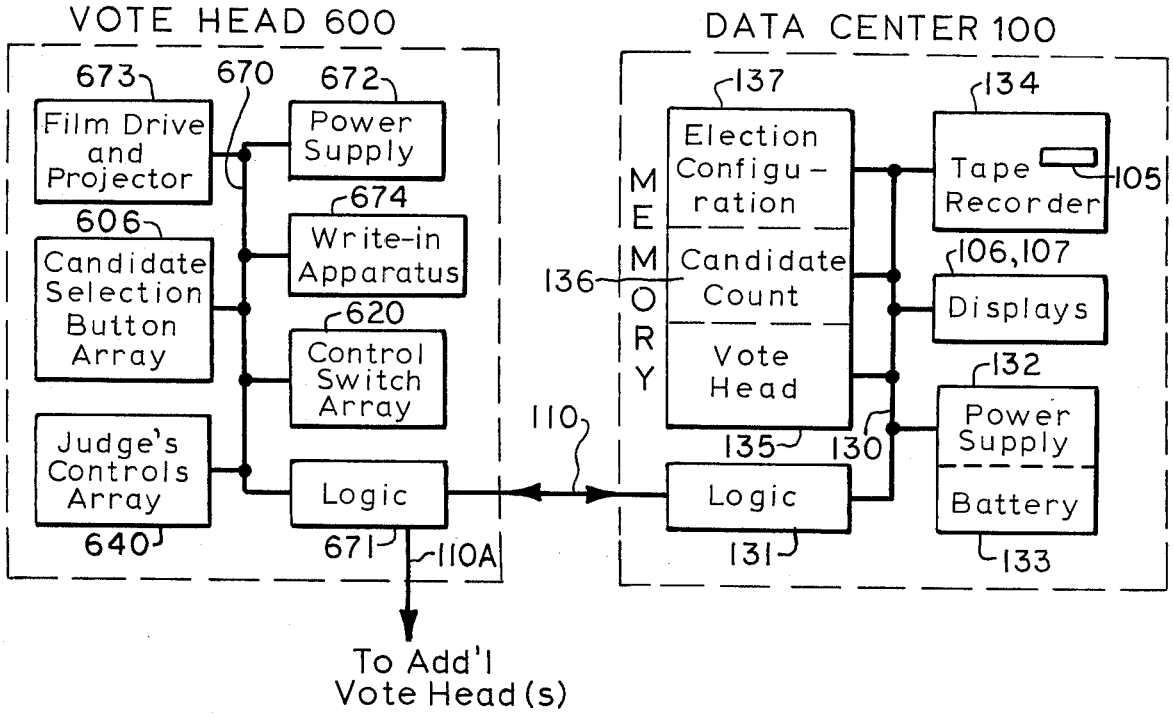
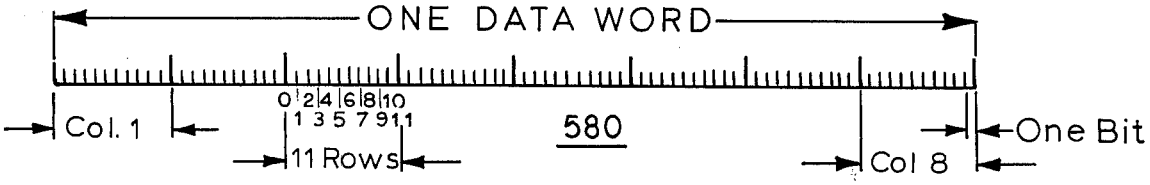
FIG. 6
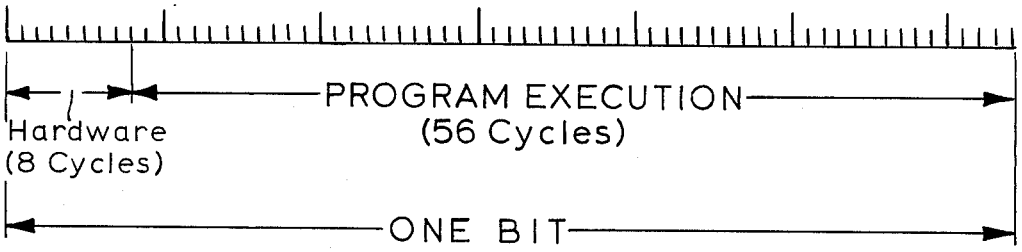
FIG. 7

VOTE HEAD LOGIC

ADAPTER LOGIC

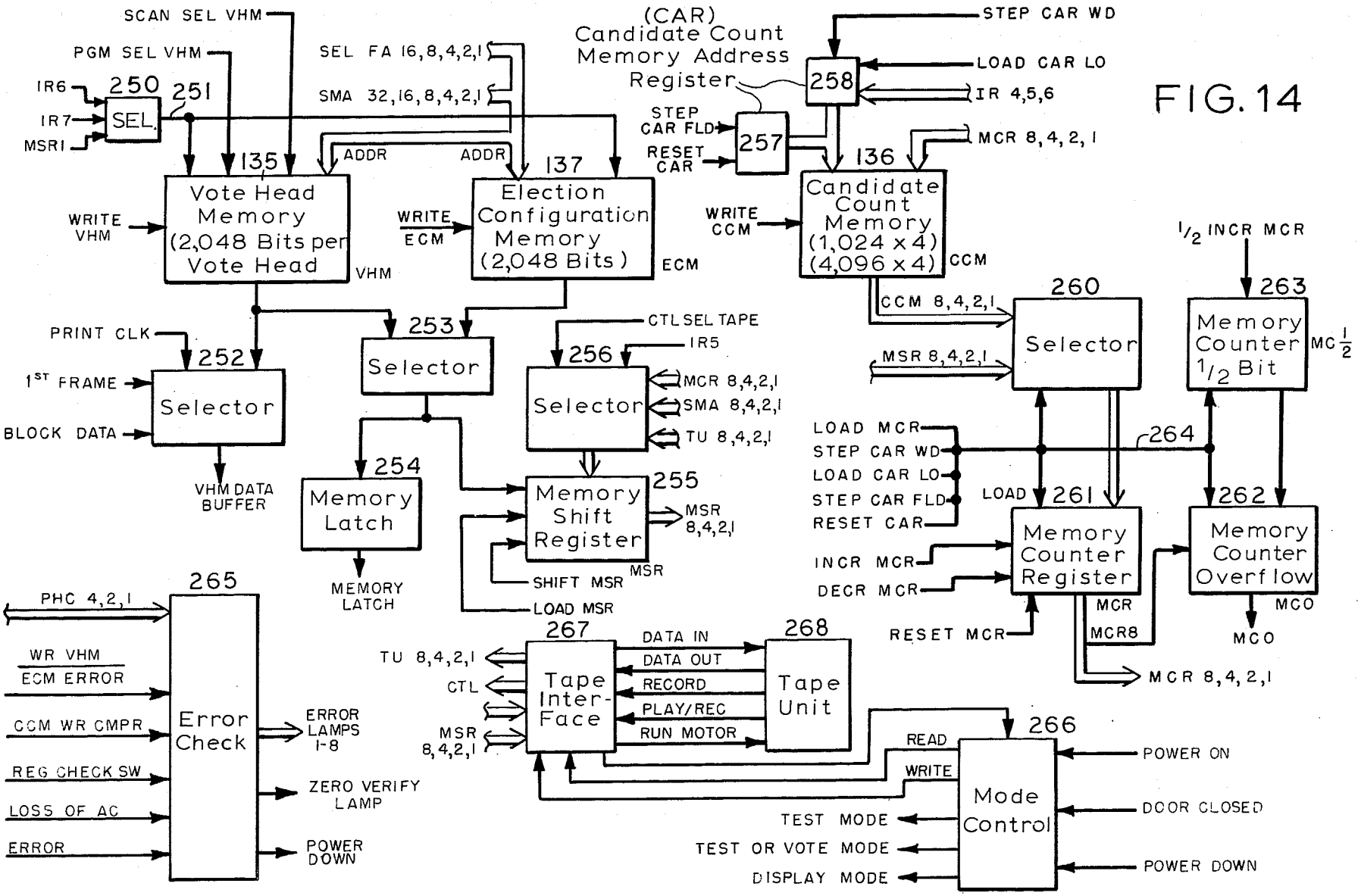
FIG. 14
Memory Counter 1/2 Bit
263
MC 1/2
1/2 INCR MCR
Memory Counter Overflow
262
MCO
MCO
264
Selector
260
Memory Counter Register
261
MCR
MCR8
MCR 8,4,2,1
STEP CAR WD
LOAD CAR LO
IR 4,5,6
MCR 8,4,2,1
Candidate Count Memory (1,024 x 4) (4,096 x 4)
136
CCM
CCM 8,4,2,1
MSR 8,4,2,1
LOAD
LOAD MCR
STEP CAR WD
LOAD CAR LO
STEP CAR FLD
RESET CAR
INCR MCR
DECR MCR
RESET MCR
POWER ON
DOOR CLOSED
POWER DOWN
Mode Control
266
READ
WRITE
TEST MODE
TEST OR VOTE MODE
DISPLAY MODE
258
257
(CAR) Candidate Count Memory Address Register
STEP CAR FLD
RESET CAR
WRITE CCM
Tape Unit
268
DATA IN
DATA OUT
RECORD
PLAY/REC
RUN MOTOR
Tape Inter-Face
267
TU 8,4,2,1
CTL
MSR 8,4,2,1
CTL SEL TAPE
IR5
MCR 8,4,2,1
SMA 8,4,2,1
TU 8,4,2,1
Selector
256
Memory Shift Register
255
MSR
MSR 8,4,2,1
SHIFT MSR
LOAD MSR
Election Configuration Memory (2,048 Bits)
137
ECM
ADDR
WRITE ECM
SEL FA 16,8,4,2,1
SMA 32,16,8,4,2,1
Selector
253
Memory Latch
254
MEMORY LATCH
Vote Head Memory (2,048 Bits per Vote Head)
135
VHM
ADDR
SCAN SEL VHM
PGM SEL VHM
SEL.
250
251
IR6
IR7
MSR1
WRITE VHM
Selector
252
VHM DATA BUFFER
PRINT CLK
1ST FRAME
BLOCK DATA
Error Check
265
ERROR LAMPS 1-8
ZERO VERIFY LAMP
POWER DOWN
PHC 4,2,1
WR VHM
ECM ERROR
CCM WR CMPR
REG CHECK SW
LOSS OF AC
ERROR

FIG.15A

VOTING HEAD MEMORY (VHM)
INITIAL FRAME (00)

| COL \ ROW | 1 | 2 | 3 | 4 | 5 | 6 | 7 | 8 |
|---|---|---|---|---|---|---|---|---|
| 1 | $PVI_{11}$ 11 | $PVI_{21}$ 21 | $PVI_{31}$ 31 | $PVI_{41}$ 41 | $PVI_{51}$ 51 | $PVI_{61}$ 61 | $PVI_{71}$ 71 | $PVI_{81}$ 81 |
| 2 | $PVI_{12}$ 12 | | | | | | | |
| 3 | $PVI_{13}$ 13 | | VOTING ENABLED CTL | | CC T1 | CCT2 | CCT4 | CCT8 |
| 4 | $PVI_{14}$ 14 | VOTING ACTIVE 92 | VOTING ENABLED FLASH 93 | WR-IN INITIATE 94 | WR-IN MODE 95 | VOTING ENABLED SOLID 96 | REG VOTES 97 | 98 |
| 5 | $PVI_{15}$ 15 | EXT ROW CTL | PARTY SELECTED | COUNT STAT | BACKUP MODE | WAIT TIMER | WAIT FOR WINDOW | WAIT FOR SLIDE CHG |
| 6 | $PVI_{16}$ 16 | 102 | WR-IN OPEN 103 | TEST MODE 104 | 105 | 106 | 107 | ADD PARTY 108 |
| 7 | $RN_1$ 17 | $RN_2$ 27 | $RN_4$ 37 | OPEN WRITE-IN 47 | CHANGE FRAME 57 | REVERSE FRAME 67 | 77 | 87 |
| 8 | $PEI_1$ 91 | $PEI_2$ 92 | $PEI_3$ 93 | $PEI_4$ 94 | $PEI_5$ 95 | $PEI_6$ 96 | $PEI_7$ 97 | $PEI_8$ 98 |

ROW & COLUMN OF SCAN BUTTON (SBC)

$PVI_{XX}$ = PARTY VOTE INDICATOR ROW COL.

$PEI_X$ = PARTY ENABLED INDICATOR NO.

$RN_X$ = RACE NUMBER (ROW OF COL.) FOR PRINT WHEEL

FIG.15B

VHM FRAMES 1–19

| COL \ ROW | 1 | 2 | 3 | 4 | 5 | 6 | 7 | 8 |
|---|---|---|---|---|---|---|---|---|
| 1 | $VI_{11}$ 11 | $VI_{21}$ 21 | $VI_{31}$ 31 | $VI_{41}$ 41 | $VI_{51}$ 51 | $VI_{61}$ 61 | $VI_{71}$ 71 | $VI_{81}$ 81 |
| 2 | $VI_{12}$ 12 | $VI_{22}$ 22 | $VI_{32}$ 32 | $VI_{42}$ 42 | $VI_{52}$ 52 | $VI_{62}$ 62 | $VI_{72}$ 72 | $VI_{82}$ 82 |
| 3 | $VI_{13}$ 13 | $VI_{23}$ 23 | $VI_{33}$ 33 | $VI_{43}$ 43 | $VI_{53}$ 53 | $VI_{63}$ 63 | $VI_{73}$ 73 | $VI_{83}$ 83 |
| 4 | $VI_{14}$ 14 | $VI_{24}$ 24 | $VI_{34}$ 34 | $VI_{44}$ 44 | $VI_{54}$ 54 | $VI_{64}$ 64 | $VI_{74}$ 74 | $VI_{84}$ 84 |
| 5 | $VI_{15}$ 15 | $VI_{25}$ 25 | $VI_{35}$ 35 | $VI_{45}$ 45 | $VI_{55}$ 55 | $VI_{65}$ 65 | $VI_{75}$ 75 | $VI_{85}$ 85 |
| 6 | $VI_{16}$ 16 | $VI_{26}$ 26 | $VI_{36}$ 36 | $VI_{46}$ 46 | $VI_{56}$ 56 | $VI_{66}$ 66 | $VI_{76}$ 76 | $VI_{86}$ 86 |
| 7 | $RC_1$ 1 | $RC_2$ 1 | $RC_3$ 1 | $RC_4$ 1 | $RC_5$ 1 | $RC_6$ 1 | $RC_7$ 1 | $RC_8$ 1 |
| 8 | $RC_1$ 2 | $RC_2$ 2 | $RC_3$ 2 | $RC_4$ 2 | $RC_5$ 2 | $RC_6$ 2 | $RC_7$ 2 | $RC_8$ 2 |

NOT DISPLAYED $VI_{XX}$ = VOTE INDICATOR ROW COL.

$RC_X^X$ = RACE COUNT BIT NO.

ELECTION CONFIGURATION MEMORY (ECM)

FIG.16A

INITIAL FRAME (00)

| ROW / COL | 1 | 2 | 3 | 4 | 5 | 6 | 7 | 8 |
|---|---|---|---|---|---|---|---|---|
| 1 | $PBV_{11}$ | $PBV_{21}$ | $PBV_{31}$ | $PBV_{41}$ | $PBV_{51}$ | $PBV_{61}$ | $PBV_{71}$ | $PBV_{81}$ |
| 2 | $PBV_{12}$ | 0 | RACE = COL | FM (10) | FM 1 | FM 2 | FM 4 | FM 8 |
| 3 | $PBV_{13}$ | 1 | C2 1 | C3 1 | P1 1 | P2 1 | P3 1 | |
| 4 | $PBV_{14}$ | | C2 2 | C3 2 | P1 2 | P2 2 | P3 2 | |
| 5 | $PBV_{15}$ | WR-IN INHIBIT | C2 4 | C3 4 | P3 4 | P3 4 | P3 4 | |
| 6 | $PBV_{16}$ | C1 | C2 8 | C3 8 | P1 8 | P2 8 | P3 8 | |
| 7 | | | S1 1 | S2 1 | S3 1 | S4 1 | S5 1 | S6 1 |
| 8 | | | S1 2 | S2 2 | S3 2 | S4 2 | S5 2 | S6 2 |

} LAST FRAME NUMBER $PBV_{xx}$ = PARTY BUTTON VALID ROW COL.

FM = LAST FRAME (0-19)

C1, C2, C3, = COUNTY NUMBER (0-199)

S1, S2, ... S6 = TAPE ID CODE (0-999,999)

FIG.16B

ECM INITIAL FRAME EXPANDED

| ROW / COL | 1 | 2 | 3 | 4 | 5 | 6 | 7 | 8 |
|---|---|---|---|---|---|---|---|---|
| 1 | | | S1 4 | S2 4 | S3 4 | S4 4 | S5 4 | S6 4 |
| 2 | | | S1 8 | S2 8 | S3 8 | S4 8 | S5 8 | S6 8 |
| 3 | | | | | | | | |
| 4 | $PEV_1$ 1 | $PEV_2$ 1 | $PEV_3$ 1 | $PEV_4$ 1 | $PEV_5$ 1 | $PEV_6$ 1 | $PEV_7$ 1 | $PEV_8$ 1 |

ELECTION CONFIGURATION MEMORY (ECM)

FIG. 16C

ECM FRAMES 1–19

| COL \ ROW | 1 | 2 | 3 | 4 | 5 | 6 | 7 | 8 |
|---|---|---|---|---|---|---|---|---|
| 1 | $BV_{11}$ | $BV_{21}$ | $BV_{31}$ | $BV_{41}$ | $BV_{51}$ | $BV_{61}$ | $BV_{71}$ | $BV_{81}$ |
| 2 | $BV_{12}$ | $BV_{22}$ | $BV_{32}$ | $BV_{42}$ | $BV_{52}$ | $BV_{62}$ | $BV_{72}$ | $BV_{82}$ |
| 3 | $BV_{13}$ | $BV_{23}$ | $BV_{33}$ | $BV_{43}$ | $BV_{53}$ | $BV_{63}$ | $BV_{73}$ | $BV_{83}$ |
| 4 | $BV_{14}$ | $BV_{24}$ | $BV_{34}$ | $BV_{44}$ | $BV_{54}$ | $BV_{64}$ | $BV_{74}$ | $BV_{84}$ |
| 5 | $BV_{15}$ | $BV_{25}$ | $BV_{35}$ | $BV_{45}$ | $BV_{55}$ | $BV_{65}$ | $BV_{75}$ | $BV_{85}$ |
| 6 | $BV_{16}$ | $BV_{26}$ | $BV_{36}$ | $BV_{46}$ | $BV_{56}$ | $BV_{66}$ | $BV_{76}$ | $BV_{86}$ |
| 7 | $MRC_1 1$ | $MRC_2 1$ | $MRC_3 1$ | $MRC_4 1$ | $MRC_5 1$ | $MRC_6 1$ | $MRC_7 1$ | $MRC_8 1$ |
| 8 | $MRC_1 2$ | $MRC_2 2$ | $MRC_3 2$ | $MRC_4 2$ | $MRC_5 2$ | $MRC_6 2$ | $MRC_7 2$ | $MRC_8 2$ |

$BV_{XX}$ = BUTTON VALID ROW COL.

$MRC_X X$ = MAXIMUM RACE COUNT NO. BIT $PEV_X$ = PARTY ENABLE VALID NO.
(IN LAST FRAME, ALL SHOULD = 1)

FIG. 16D

ECM FRAMES 1–19 EXPANDED

| COL \ ROW | 1 | 2 | 3 | 4 | 5 | 6 | 7 | 8 |
|---|---|---|---|---|---|---|---|---|
| 1 | R1 PARTI-SAN | R2 PARTI-SAN | R3 PARTI-SAN | R4 PARTI-SAN | R5 PARTI-SAN | R6 PARTI-SAN | R7 PARTI-SAN | R8 PARTI-SAN |
| 2 | R1 PROPOR | R2 PROPOR | R3 PROPOR | R4 PROPOR | R5 PROPOR | R6 PROPOR | R7 PROPOR | R8 PROPOR |
| 3 | | R2 EXT | R3 EXT | R4 EXT | R5 EXT | R6 EXT | R7 EXT | R8 EXT |
| 4 | $PEV_1$ | $PEV_2$ | $PEV_3$ | $PEV_4$ | $PEV_5$ | $PEV_6$ | $PEV_7$ | $PEV_8$ |

VOTES WILL BE RECORDED FOR INDICATED PARTY CANDIDATE WHEN PARTISAN VOTING IS USED

CANDIDATE CAN RECEIVE 1, 1½, OR 3 VOTES, DEPENDING ON NO. OF VOTES (3, 2, OR 1) CAST IN RACE 1-(YES)-IF ROW IS EXTENSION OF PREVIOUS ROW 0-(NO)-FRAME NOT TO BE PRESENTED IF $PEV_X$ SIGNAL IS PRESENT

CANDIDATE COUNT MEMORY (CCM)

FIG. 17A

CANDIDATE FIELD

| Bit \ Word | 1 | 2 | 3 | 4 | 5 | 6 | 7 | 8 |
|---|---|---|---|---|---|---|---|---|
| 1 | FM 1 | COL 1 | ROW 1 | CT 1'S 1 | CT 10'S 1 | CT 100'S 1 | CT 1000'S 1 | |
| 2 | FM 2 | COL 2 | ROW 2 | CT 1'S 2 | CT 10'S 2 | CT 100'S 2 | CT 1000'S 2 | |
| 4 | FM 4 | COL 4 | ROW 4 | CT 1'S 4 | CT 10'S 4 | CT 100'S 4 | CT 1000'S 4 | |
| 8 | FM 8 | FM (10) | 1/2 CT | CT 1'S 8 | CT 10'S 8 | CT 100'S 8 | CT 1000'S 8 | |

FIG. 17B

VOTE HEAD COUNTER FIELD

| Bit \ Word | 1 | 2 | 3 | 4 | 5 | 6 | 7 | 8 |
|---|---|---|---|---|---|---|---|---|
| 1 | 0 | 0 | HD* 1 | CT 1'S 1 | CT 10'S 1 | CT 100'S 1 | CT 1000'S 1 | |
| 2 | 0 | 1 | HD* 2 | CT 1'S 2 | CT 10'S 2 | CT 100'S 2 | CT 1000'S 2 | |
| 4 | 0 | 1 | HD* 4 | CT 1'S 4 | CT 10'S 4 | CT 100'S 4 | CT 1000'S 4 | |
| 8 | 0 | 0 | 0 | CT 1'S 8 | CT 10'S 8 | CT 100'S 8 | CT 1000'S 8 | |

(FM=00, COL=6)

FIG. 17C

TAPE ID FIELD

| Bit \ Word | 1 | 2 | 3 | 4 | 5 | 6 | 7 | 8 |
|---|---|---|---|---|---|---|---|---|
| 1 | C2 1 | 1 | 0 | P3 1 | P2 1 | P1 1 | C3 1 | |
| 2 | C2 2 | 1 | 0 | P3 2 | P2 2 | P1 2 | C3 2 | |
| 4 | C2 4 | 1 | 0 | P3 4 | P2 4 | P1 4 | C3 4 | |
| 8 | C2 8 | C1 | 0 | P3 8 | P2 8 | P1 8 | C3 8 | |

(COL=7, ROW=0)

FIG. 17D

TOTAL VOTE COUNT FIELD

| Bit \ Word | 1 | 2 | 3 | 4 | 5 | 6 | 7 | 8 |
|---|---|---|---|---|---|---|---|---|
| 1 | 0 | 1 | 1 | CT 1'S 1 | CT 10'S 1 | CT 100'S 1 | CT 1000'S 1 | |
| 2 | 0 | 1 | 0 | CT 1'S 2 | CT 10'S 2 | CT 100'S 2 | CT 1000'S 2 | |
| 4 | 0 | 1 | 0 | CT 1'S 4 | CT 10'S 4 | CT 100'S 4 | CT 1000'S 4 | |
| 8 | 0 | 0 | 0 | CT 1'S 8 | CT 10'S 8 | CT 100'S 8 | CT 1000'S 8 | |

(FM=00, COL=7, ROW=1)

VOTE HEAD TIMING & DATA

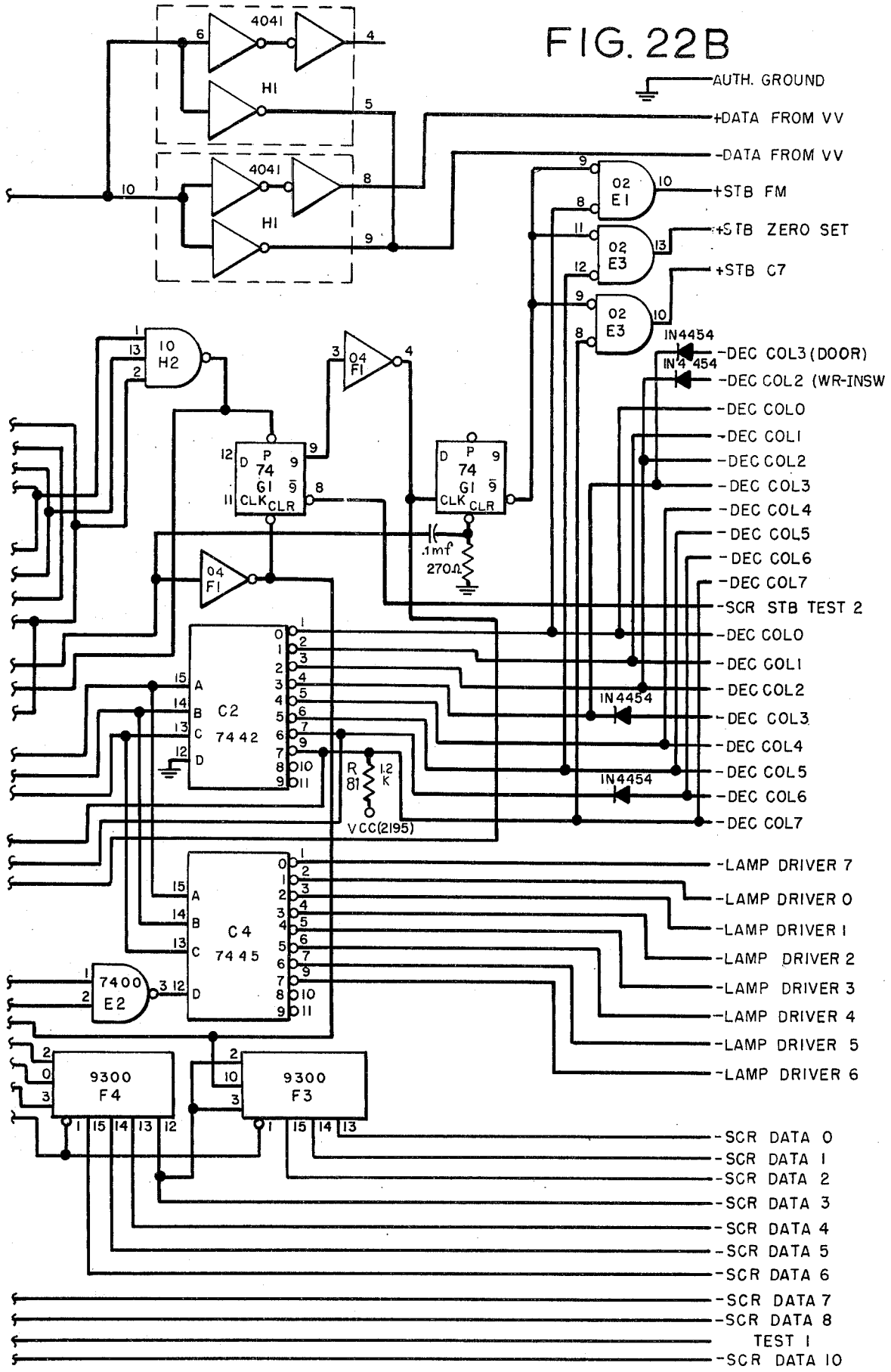
FIG. 22B
AUTH. GROUND
+DATA FROM VV
-DATA FROM VV
+STB FM
+STB ZERO SET
+STB C7
-DEC COL3 (DOOR)
-DEC COL2 (WR-INSW
-DEC COL0
-DEC COL1
-DEC COL2
-DEC COL3
-DEC COL4
-DEC COL5
-DEC COL6
-DEC COL7
-SCR STB TEST 2
-DEC COL0
-DEC COL1
-DEC COL2
-DEC COL3
-DEC COL4
-DEC COL5
-DEC COL6
-DEC COL7
-LAMP DRIVER 7
-LAMP DRIVER 0
-LAMP DRIVER 1
-LAMP DRIVER 2
-LAMP DRIVER 3
-LAMP DRIVER 4
-LAMP DRIVER 5
-LAMP DRIVER 6
-SCR DATA 0
-SCR DATA 1
-SCR DATA 2
-SCR DATA 3
-SCR DATA 4
-SCR DATA 5
-SCR DATA 6
-SCR DATA 7
-SCR DATA 8
TEST 1
-SCR DATA 10
4041
HI
10 H2
04 F1
74 G1
C2 7442
C4 7445
7400 E2
9300 F4
9300 F3
02 E1
02 E3
IN4454
.1mf
270Ω
R 81 1.2 K
VCC(2195)

PROJECTOR & WRITE-IN MECHANISM CONTROL

LAMP DRIVERS AND SCR's

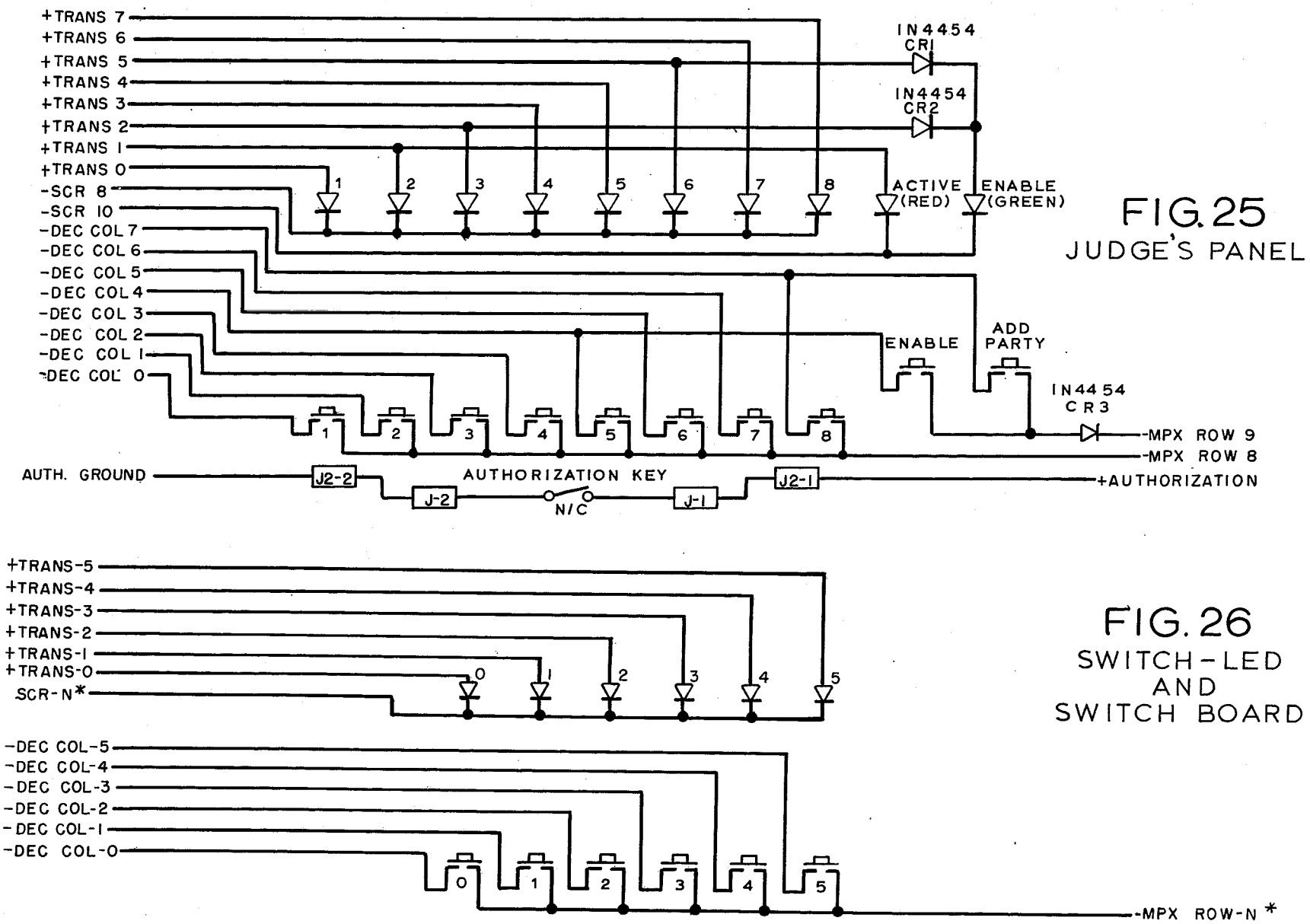
FIG. 25
JUDGE'S PANEL
FIG. 26
SWITCH-LED
AND
SWITCH BOARD
IN4454
CR1
IN4454
CR2
ACTIVE
(RED)
ENABLE
(GREEN)
ADD
PARTY
ENABLE
IN4454
CR3
-MPX ROW 9
-MPX ROW 8
+AUTHORIZATION
AUTHORIZATION KEY
N/C
J2-1
J-1
J-2
J2-2
AUTH. GROUND
+TRANS 7
+TRANS 6
+TRANS 5
+TRANS 4
+TRANS 3
+TRANS 2
+TRANS 1
+TRANS 0
-SCR 8
-SCR 10
-DEC COL 7
-DEC COL 6
-DEC COL 5
-DEC COL 4
-DEC COL 3
-DEC COL 2
-DEC COL 1
-DEC COL 0
+TRANS-5
+TRANS-4
+TRANS-3
+TRANS-2
+TRANS-1
+TRANS-0
SCR-N*
-DEC COL-5
-DEC COL-4
-DEC COL-3
-DEC COL-2
-DEC COL-1
-DEC COL-0
-MPX ROW-N*

MAIN SCREEN BOARD

INSTRUCTION DECODES

COMPARE AND TEST
INSTRUCTION EXECUTE

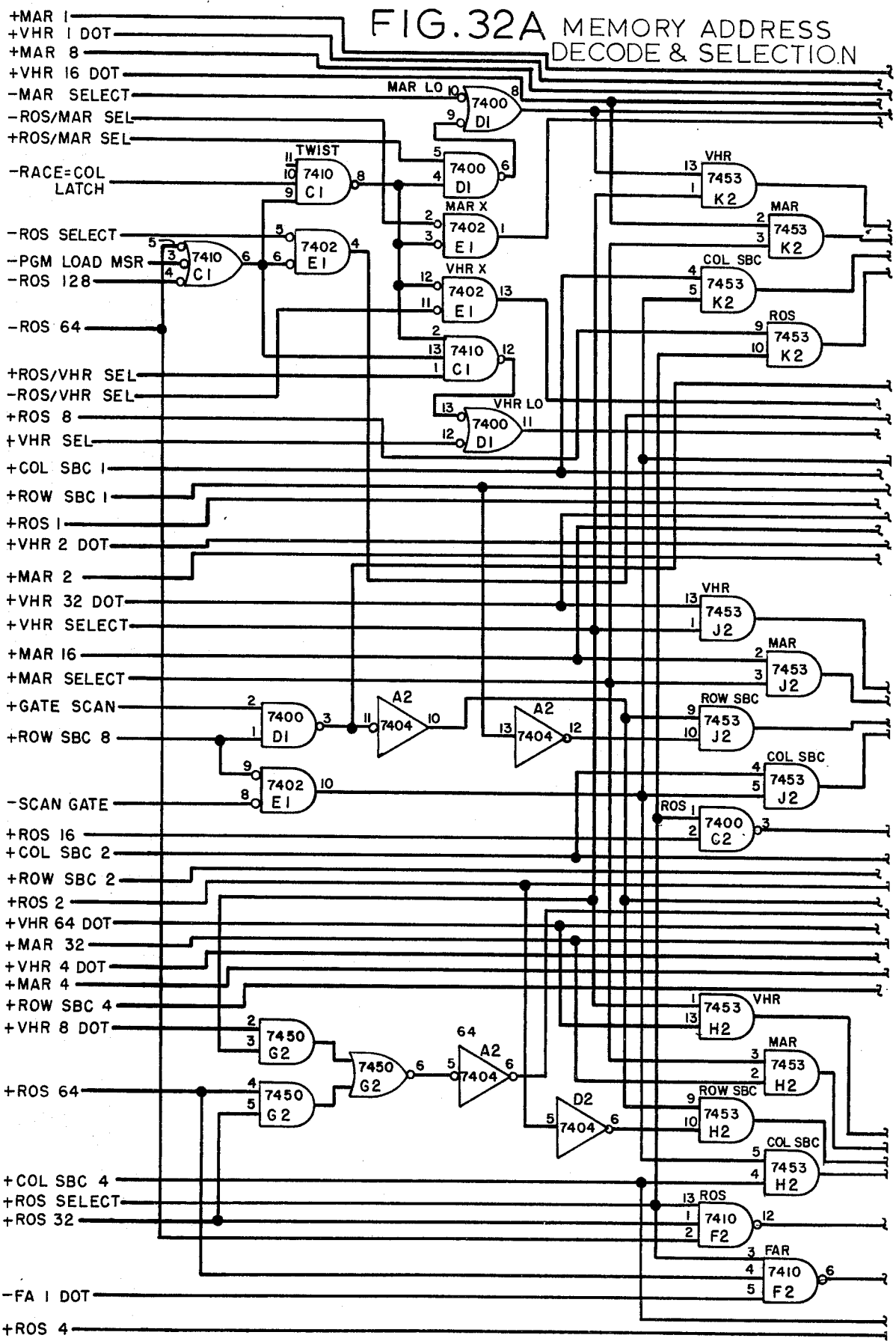
FIG. 32A MEMORY ADDRESS DECODE & SELECTION
+MAR 1
+VHR 1 DOT
+MAR 8
+VHR 16 DOT
-MAR SELECT
-ROS/MAR SEL
+ROS/MAR SEL
-RACE=COL LATCH
-ROS SELECT
-PGM LOAD MSR
-ROS 128
-ROS 64
+ROS/VHR SEL
-ROS/VHR SEL
+ROS 8
+VHR SEL
+COL SBC 1
+ROW SBC 1
+ROS 1
+VHR 2 DOT
+MAR 2
+VHR 32 DOT
+VHR SELECT
+MAR 16
+MAR SELECT
+GATE SCAN
+ROW SBC 8
-SCAN GATE
+ROS 16
+COL SBC 2
+ROW SBC 2
+ROS 2
+VHR 64 DOT
+MAR 32
+VHR 4 DOT
+MAR 4
+ROW SBC 4
+VHR 8 DOT
+ROS 64
+COL SBC 4
+ROS SELECT
+ROS 32
-FA 1 DOT
+ROS 4
MAR LO
TWIST
MAR X
VHR X
VHR LO
7400 D1
7410 C1
7402 E1
7453 K2
7453 J2
7453 H2
7410 F2
7450 G2
7404
A2
D2
64
VHR
MAR
COL SBC
ROS
ROW SBC
FAR

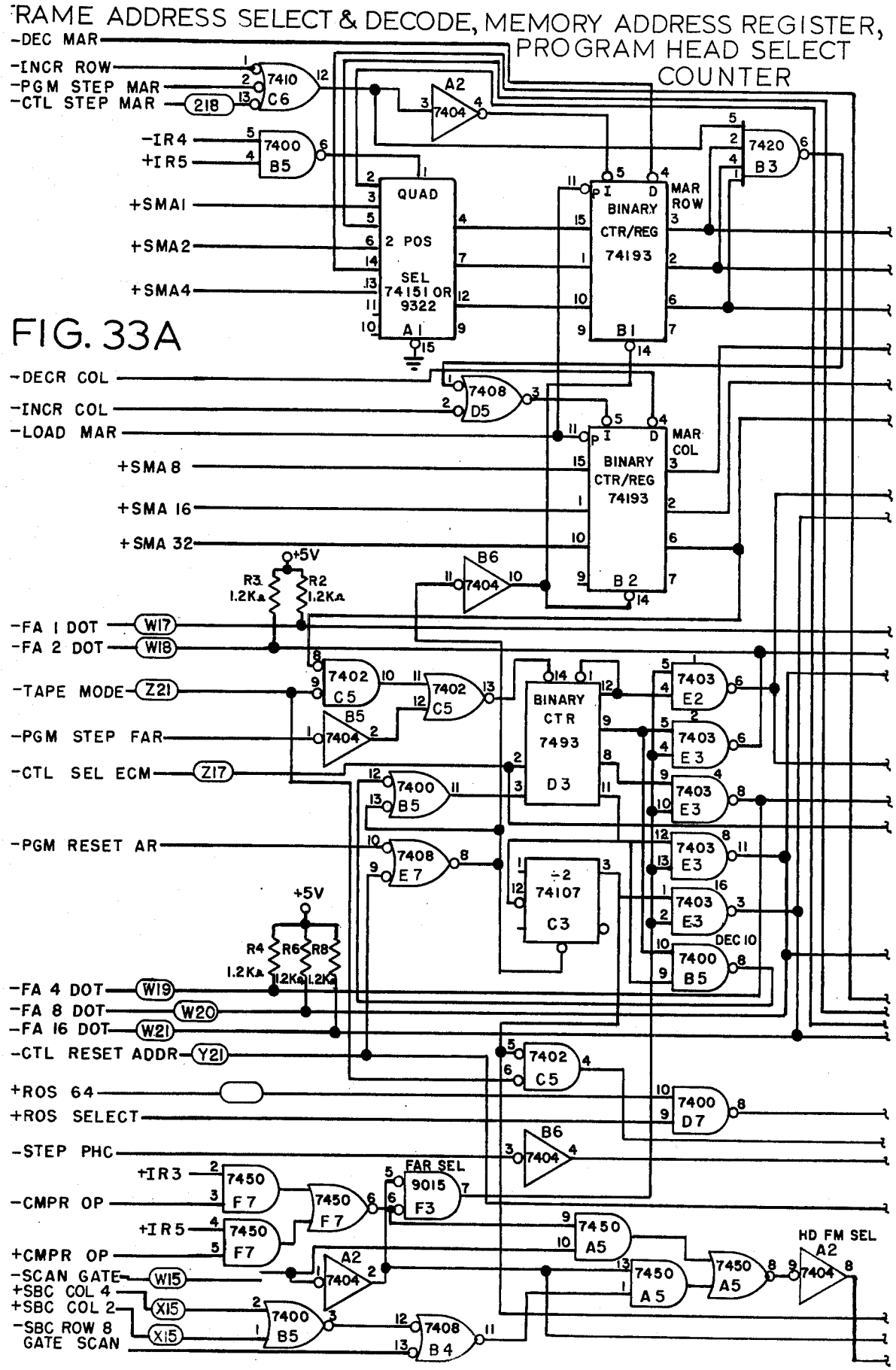
FRAME ADDRESS SELECT & DECODE, MEMORY ADDRESS REGISTER, PROGRAM HEAD SELECT COUNTER
-DEC MAR
-INCR ROW
-PGM STEP MAR
-CTL STEP MAR
218
7410 C6
A2 7404
-IR4
+IR5
7400 B5
7420 B3
+SMA1
+SMA2
+SMA4
QUAD 2 POS SEL 74151 OR 9322 A1
BINARY CTR/REG 74193 B1
MAR ROW
FIG. 33A
-DECR COL
-INCR COL
-LOAD MAR
7408 D5
BINARY CTR/REG 74193 B2
MAR COL
+SMA 8
+SMA 16
+SMA 32
+5V
R3 1.2KΩ
R2 1.2KΩ
B6 7404
-FA 1 DOT
-FA 2 DOT
W17
W18
-TAPE MODE
Z21
7402 C5
B5 7404
-PGM STEP FAR
-CTL SEL ECM
Z17
7400 B5
BINARY CTR 7493 D3
7403 E2
7403 E3
-PGM RESET AR
7408 E7
÷2 74107 C3
DEC 10
R4 1.2KΩ
R6 1.2KΩ
R8 1.2KΩ
-FA 4 DOT
-FA 8 DOT
-FA 16 DOT
W19
W20
W21
-CTL RESET ADDR
Y21
+ROS 64
+ROS SELECT
7400 D7
-STEP PHC
+IR3
-CMPR OP
+IR5
+CMPR OP
7450 F7
FAR SEL 9015 F3
7450 A5
HD FM SEL
-SCAN GATE
W15
+SBC COL 4
+SBC COL 2
-SBC ROW 8
GATE SCAN
X15
7408 B4

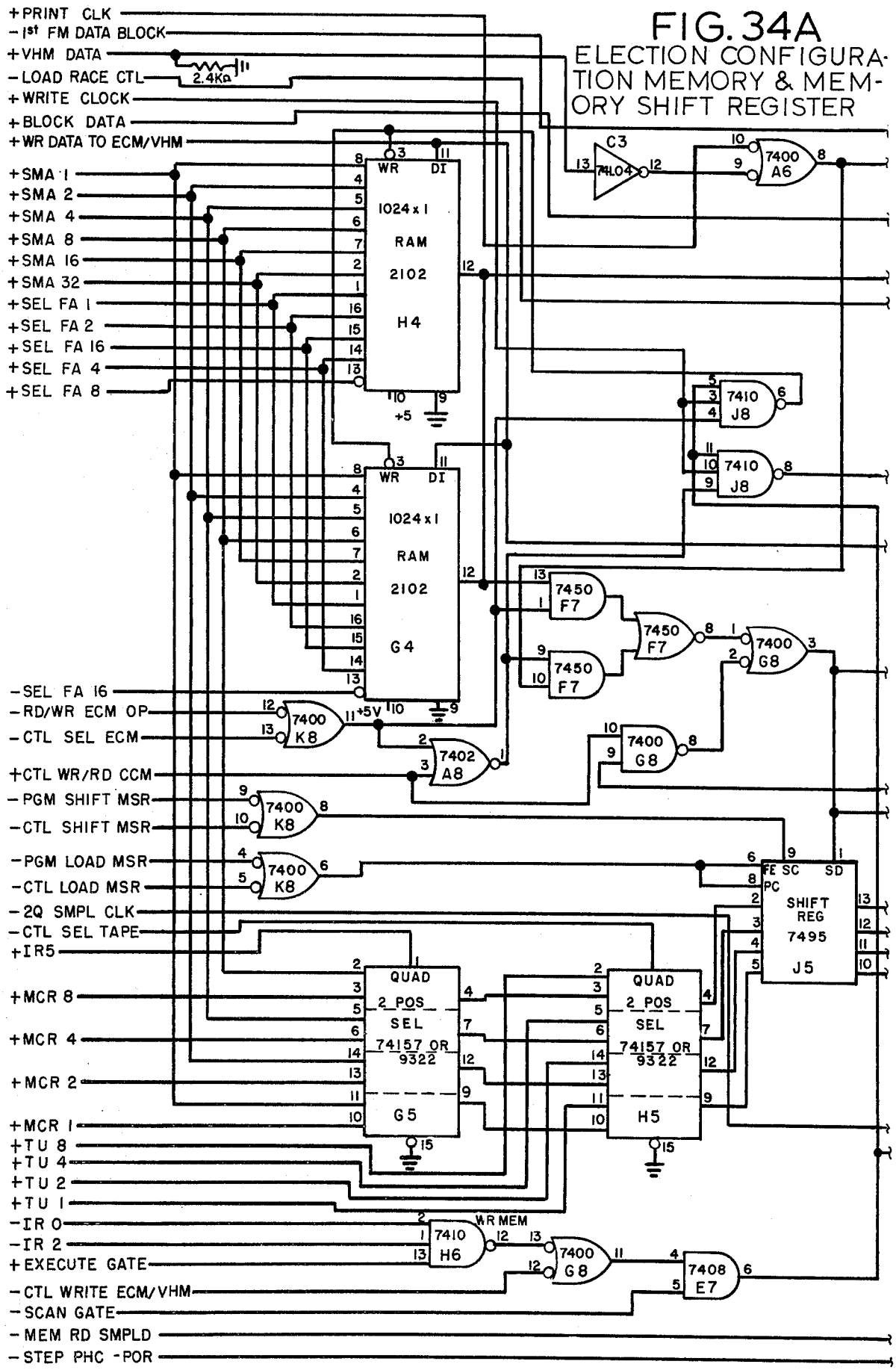
FIG. 34A
ELECTION CONFIGURATION MEMORY & MEMORY SHIFT REGISTER
+PRINT CLK
-1st FM DATA BLOCK
+VHM DATA
-LOAD RACE CTL
+WRITE CLOCK
+BLOCK DATA
+WR DATA TO ECM/VHM
+SMA 1
+SMA 2
+SMA 4
+SMA 8
+SMA 16
+SMA 32
+SEL FA 1
+SEL FA 2
+SEL FA 16
+SEL FA 4
+SEL FA 8
2.4KΩ
1024x1 RAM 2102 H4
1024x1 RAM 2102 G4
WR
DI
+5
C3
74LO4
7400 A6
7410 J8
7450 F7
7400 G8
-SEL FA 16
-RD/WR ECM OP
-CTL SEL ECM
+CTL WR/RD CCM
-PGM SHIFT MSR
-CTL SHIFT MSR
-PGM LOAD MSR
-CTL LOAD MSR
-2Q SMPL CLK
-CTL SEL TAPE
+IR5
7400 K8
7402 A8
+5V
SHIFT REG 7495 J5
SC
SD
PC
QUAD 2 POS SEL 74157 OR 9322 G5
QUAD 2 POS SEL 74157 OR 9322 H5
+MCR 8
+MCR 4
+MCR 2
+MCR 1
+TU 8
+TU 4
+TU 2
+TU 1
-IR 0
-IR 2
+EXECUTE GATE
-CTL WRITE ECM/VHM
-SCAN GATE
-MEM RD SMPLD
-STEP PHC -POR
7410 H6
WR MEM
7408 E7

ADDRESS REGISTER & ROM'S

CANDIDATE COUNTER MEMORY 1,& ADDRESS

REGISTER, MEMORY COUNTER REGISTER
WR DI
1024X1 RAM 2102
G7
F7
E7
D7
+5V
2.4K
C6 L04
D6 04
7486 E6.
7486 E6
9015 E8
+CCM WR CMPR
MC1/2
JK-FF 74107
J8
7486 J2
MCO
B3
+MCO
+MCR 1
+MCR 2
+MCR 4
+MCR 8
MCR
QUAD 2 POS SEL 74157 OR 9322
G6
UP/DOWN DECADE CTR/REG 74192 OR 9360
H6
+RESET MCR
+CAR 1
+CAR 2
+CAR 4
+CAR 8
+CAR 16
+CAR 32
+CAR 64
+CAR 128
+CAR 256
+CAR 512
+CAR MEM SEL 1
+CAR MEM SEL 2
-CAR MEM SEL 2
-CAR MEM SEL 1
E2
-O CAR MEM SEL 1

CANDIDATE COUNT MEMORY N

* SELECT TABLE

| NAME | MEM # |
|---|---|
| CAR MEM SEL 1 | 1,3 |
| CAR MEM SEL 1 | 3 |
| CAR MEM SEL 2 | 3,4 |
| CAR MEM SEL 2 | 2 |

CLOCKING & "BUTTON" COMPARE

+WRITE CLOCK
-PGM SMPL CLK
+500 KHZ CLOCK
-500 KHZ CLOCK
-2Q SMPL CLK
-SCAN SEL VH1
-SCAN SEL VH2
-SCAN SEL VH3
-SCAN SEL VH4
-SCAN SEL VH5
-SCAN SEL VH6
-SCAN SEL VH7
-SCAN SEL VH8
-PRINT CLK
-HEAD CLK
+HEAD CLK
-SCAN GATE
+ROW SBC 1
+ROW SBC 2
+ROW SBC 4
+ROW SBC 8
+COL SBC 1
+COL SBC 2
+COL SBC 4
+SCAN FM*
+SW COMPARE
+SP SW
+FLASH CLK
+BLOCK DATA
-RESET
+RESET
+90 MS CLOCK
D-FF 7474 B2
7408 A1
B1 04
E2 17
+5
1.2K
D 7474 Q CLK A2 Q
4041 F3
+5V
12K
9015 D3
7430 A3
7486 J1
7486 J2
7410 G2
9015 F2
7400 G1
7425 H1
7425 H2
7408 F1
C4 E3
25 H2
25 H1
00 G1
10 G2
08 F1
+5V
1.2K

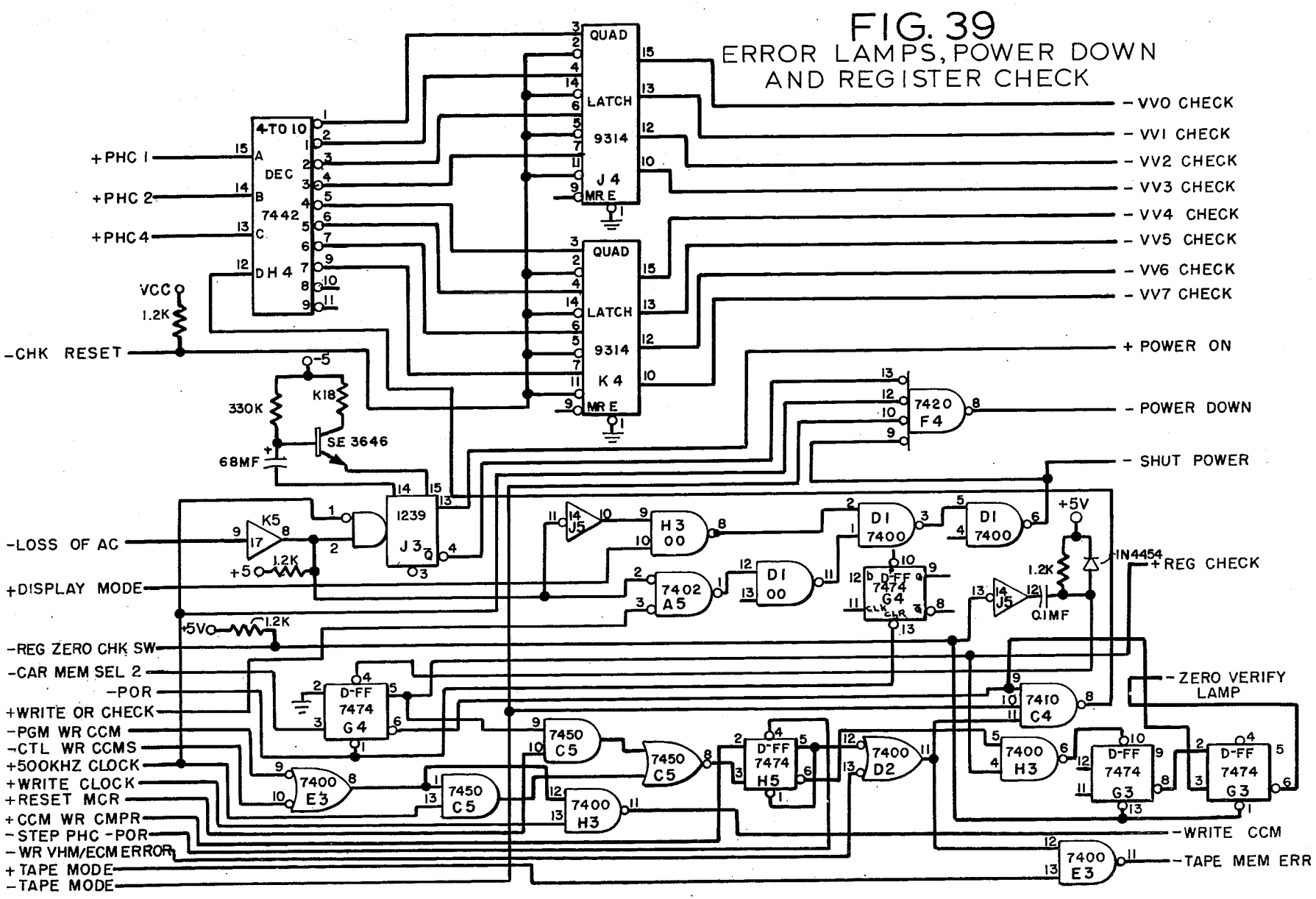
FIG. 39
ERROR LAMPS, POWER DOWN
AND REGISTER CHECK
- VV0 CHECK
- VV1 CHECK
- VV2 CHECK
- VV3 CHECK
- VV4 CHECK
- VV5 CHECK
- VV6 CHECK
- VV7 CHECK
+ POWER ON
- POWER DOWN
- SHUT POWER
+ REG CHECK
- ZERO VERIFY LAMP
- WRITE CCM
- TAPE MEM ERR
+ PHC 1
+ PHC 2
+ PHC 4
- CHK RESET
- LOSS OF AC
+ DISPLAY MODE
- REG ZERO CHK SW
- CAR MEM SEL 2
- POR
+ WRITE OR CHECK
- PGM WR CCM
- CTL WR CCMS
+ 500KHZ CLOCK
+ WRITE CLOCK
+ RESET MCR
+ CCM WR CMPR
- STEP PHC - POR
- WR VHM/ECM ERROR
+ TAPE MODE
- TAPE MODE

TAPE CLOCK AND TAPE UNIT ANALOG

MOTOR CONTROL

TAPE DATA TIMING

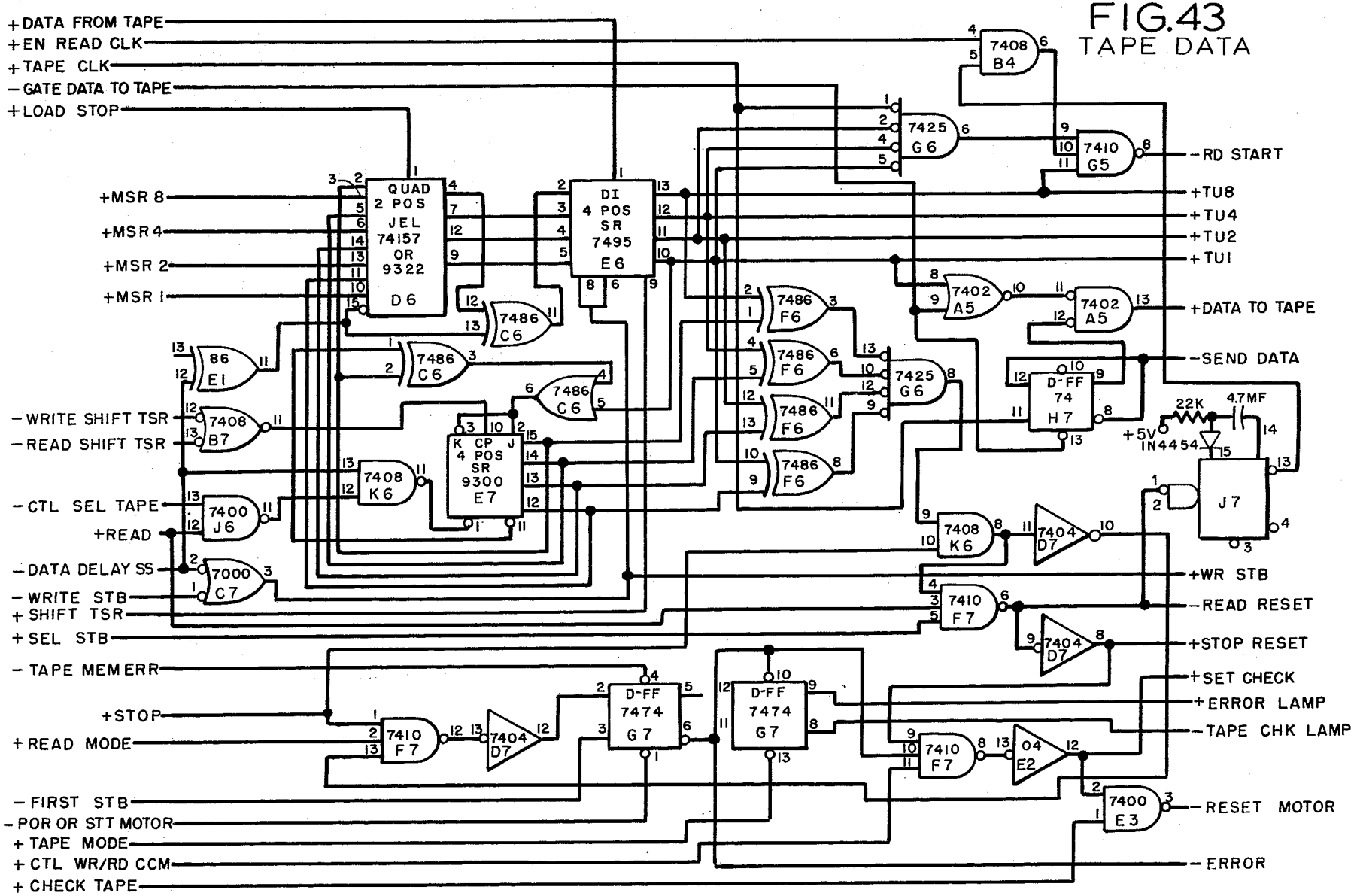
FIG.43
TAPE DATA
-RD START
+TU8
+TU4
+TU2
+TU1
+DATA TO TAPE
-SEND DATA
+WR STB
-READ RESET
+STOP RESET
+SET CHECK
+ERROR LAMP
-TAPE CHK LAMP
-RESET MOTOR
-ERROR
+DATA FROM TAPE
+EN READ CLK
+TAPE CLK
-GATE DATA TO TAPE
+LOAD STOP
+MSR 8
+MSR 4
+MSR 2
+MSR 1
-WRITE SHIFT TSR
-READ SHIFT TSR
-CTL SEL TAPE
+READ
-DATA DELAY SS
-WRITE STB
+SHIFT TSR
+SEL STB
-TAPE MEM ERR
+STOP
+READ MODE
-FIRST STB
-POR OR STT MOTOR
+TAPE MODE
+CTL WR/RD CCM
+CHECK TAPE

TAPE CONTROL MEMORY TIMING

READOUT CONTROL

DATA CENTER PANEL

½ CT
7 SEG DISPLAY HP7730
CT 1'S
CT 10'S
CT 100'S
CT 1000'S
R29 75Ω
R32 75Ω
R33 75Ω
R28 75Ω
R31 75Ω
R30 75Ω
+5V
-DISPLAY MODE
R27 180Ω
VV7 CHK
R26 180Ω
VV6 CHK
R25 180Ω
VV5 CHK
R24 180Ω
VV4 CHK
R23 180Ω
VV3 CHK
R22 180Ω
VV2 CHK
R21 180Ω
VV1 CHK
R20 180Ω
VV0 CHK
R19 180Ω
TAPE MODE
R18 180Ω
VOTE MODE
GROUND
-CHECK RESET
-DISPLAY ADVANCE
-DISLAY BACKUP
-DISPLAY RESTART
-REG ZERO CHK
-STOP TAPE
CHK RESET
DISP ADVANCE
DISP BACKUP
DISP RESTART

POWER SUPPLY CONTROL

VOTE HEAD ADAPTER

VOTE HEAD MEMORY

FIG. 50
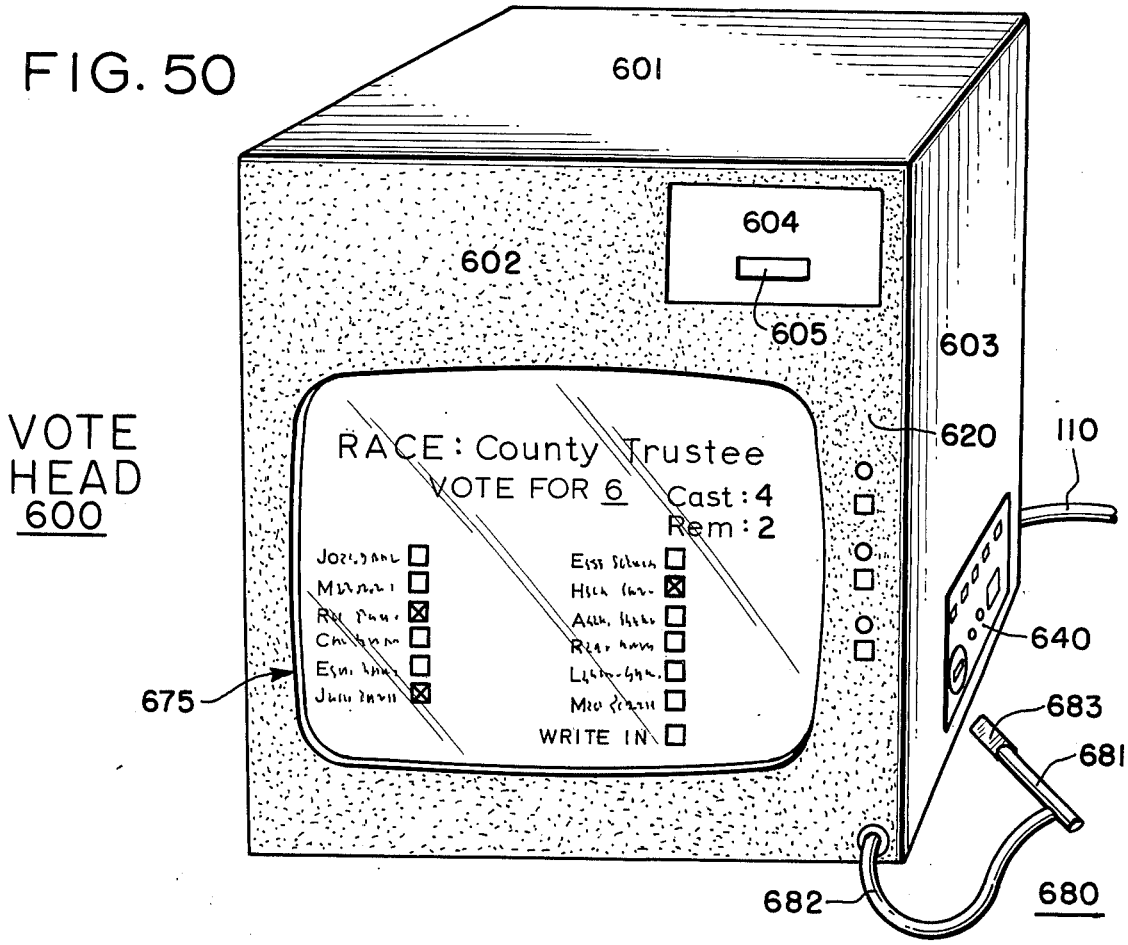
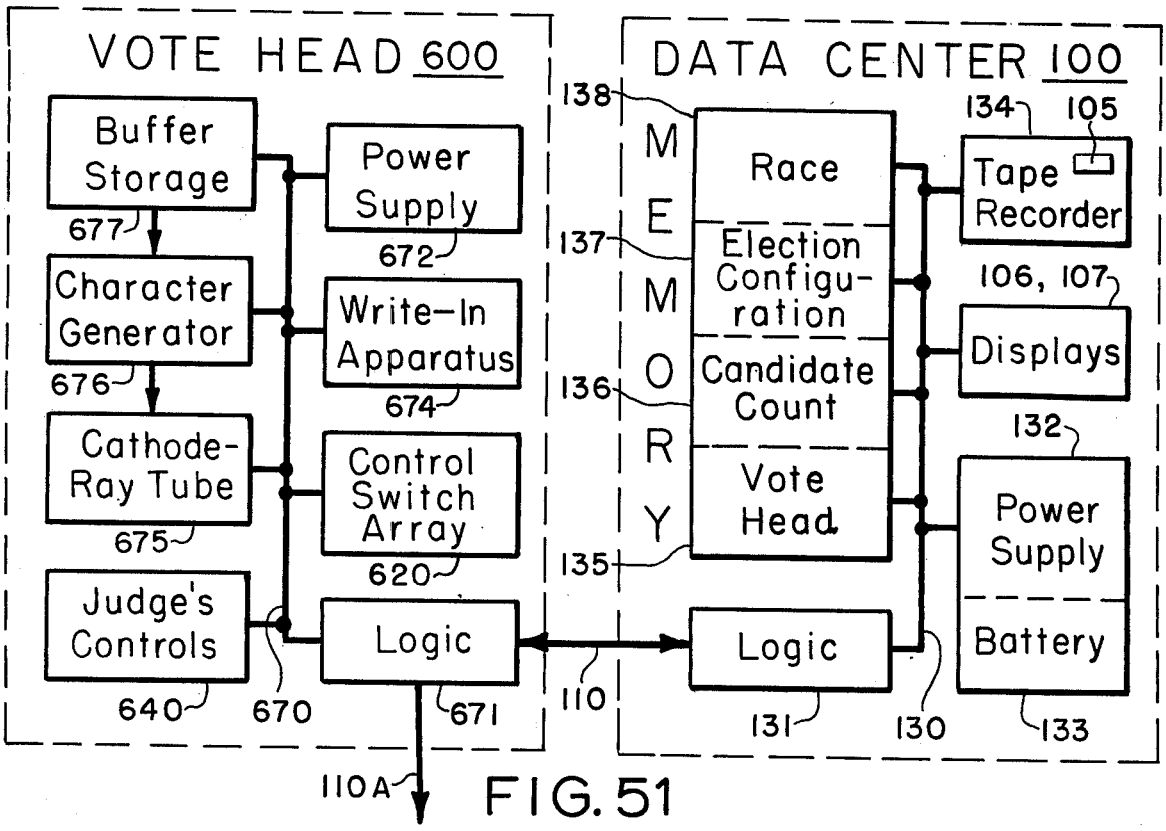
FIG. 51

VOTING SYSTEM

This application is a continuation-in-part of the application filed Jan. 23, 1975, Ser. No. 543,322, by the same inventors and having the same title.

BACKGROUND OF THE INVENTION

The present invention is particularly concerned with the automation of the voting process, and effecting such automation with equipment that is readily understood and easily operable by the voter, positive and rapid in operation, and extremely secure against intentional tampering and untoward mechanical and electrical troubles. In the past various efforts have been made to automate the election process and simplify the tallying of the votes. A familiar example of an early machine is the mechanical voting machine used in many large cities. In general, there is some mechanical movement in such machines with the registration of each party or candidate selection by the voter. With each mechanical part and movement there is a corresponding possibility that this part will break down on the election day. In addition the use of particular actuators for a specific party or a specific candidate raises the possibility of such party or candidate being effectively precluded from receiving votes if a single actuator is tampered with or becomes inoperable. For these reasons considerable effort has been expended to further automate and simplify the voting process.

One example of such an improvement is described and claimed in U.S. Pat. No. 3,793,505 - McKay et al, entitled "Electronic Voting Machine." The patent describes the use of suitable film projection apparatus, such as a 35 millimeter projector with forward and reverse drive controls, for projecting successive frames or ballot pages onto a screen for candidate selection by the voter as he activates individual buttons at the candidate locations. The patent describes a system for controlling both operation of the voting buttons and operation of the vote counters (including identification of voting categories) by the use of components (such as phototransistors) positioned adjacent the screen, such that the light projecting the candidates names will also strike the phototransistors and provide control signals.

There are many complicated problems connected with the usual election procedures. One problem is that of straight-ticket voting as opposed to ballot splitting among candidates of different political parties. Accordingly, it is an important object of the present invention to provide a simple, automated voting system in which straight-party votes can be cast, and a single vote (or more, if desired) for a candidate from another party can still be entered simply by changing the selection in that particular race.

Another important consideration is the use of proportional voting, where it is allowed. For example, in a vote for a board of regents, there may be six candidates with the instruction to vote for as many as three candidates. If three are selected, each gets one vote; if two candidates are chosen, each receives 1½ votes; and if only one is selected, he receives three votes. Proportional voting requires mental computations when paper ballots are used, and additional mechanical parts when a mechanical voting machine is used. It is therefore another important object of this invention to provide for proportional voting with a simple memory circuit arrangement which facilitates the use of proportional voting in any contest where it is desired.

Another important consideration is that some races may have more candidates than can readily be displayed on a single horizontal row or vertical column of the display presented to the voter. With a paper ballot this presents no problem, as the additional names are merely added to the list. It is therefore a salient object of this invention to provide a flexible-format candidate presentation for each race, where the space for a given race can be extended to include the next row (or column) simply by pushing a button or by some equally simple control arrangement.

It is not always possible with automated machinery to regulate the maximum number of votes which can be cast in a given race, when this maximum number exceeds one. It is therefore an important object of this invention to provide a flexible-format arrangement in which the maximum number of votes can be preset when the equipment is prepared for the election. A related important object is to provide such a format of enhanced flexibility, so that when a given race is extended to present candidates on the next row (or column), the maximum number of votes to be cast in that race can also be increased.

A corresponding object of the invention is to provide a data center coupled to the voting machine (or vote head), for generating a train of signals which are passed to the vote head to continually determine the status of all the buttons and switches on the vote machine, returning this information to the data center for registration as candidate votes.

Another important object of the invention is to provide such a system in which a plurality of machines (or vote heads) can be served simultaneously by the same data center.

Another important consideration is to provide such a system in which the data center is a stored program data processor, serving the multiple vote heads on-line and in real time, maintaining a continuous count of the votes for each candidate or question.

Still another important object of the invention is to provide a permanent record, such as a magnetic tape, which both includes a part of the stored program for the particular election, and is used at the end of the election to record the election results in permanent form without the need to perform a secondary data recording operation.

An important object of the invention is the provision of positive identification of each frame or ballot page projected to the voter, which identification is utilized to refer to the stored program for establishing the validity of certain buttons in the vote head to perform candidate selection, and then directing the vote selection into the appropriate memory storage of the data center.

Another important object of the invention is to allow the voter to change individual selections on each frame (ballot page), and to review the entire ballot — making changes in the votes entered, if desired — before the votes are "cast" by entry in the appropriate memory of the data center.

SUMMARY OF THE INVENTION

A vote entry and recording system for storing information regarding candidates and races for successive presentation to a voter constructed in accordance with this invention comprises a vote head and a data center. The vote head includes an optical unit for visually representing the candidates in each race, and has selection means for indicating the candidate selected in each race. A logic circuit is connected to the selection means in the vote head. The data center is coupled to the vote head by at least two conductor pairs. The data center includes three memories: an election configuration memory for storing processing instructions; a candidate count memory connected to receive and accumulate the total of votes in each race cast at the vote head; and a vote head memory, coupled between the first of the conductor pairs and the candidate count memory, for continually representing the status of the selection means in the vote head. A logic circuit in the data center is coupled to the first conductor pair and to the three memories. This logic circuit includes a clock circuit connected to generate a train of pulses for passage over the second conductor pair to the vote head, to continually scan the selection means in the vote head. The logic means in the vote head is connected to change the representation of at least one pulse in the pulse train each time the selection means is actuated, thus producing a modified pulse train which is returned over the first conductor pair to the data center to indicate the selection made at the vote head.

THE DRAWINGS

The foregoing objects and other aspects of the invention will be better understood with reference to the accompanying drawings and the corresponding explanation. In the drawings:

FIG. 5 is a block diagram depicting the intercoupling of sub-systems within the system of this invention;

FIGS. 6 and 7 are timing diagrams useful in understanding the operation of the system shown in FIGS. 1 and 5;

FIGS. 12 – 14 are data flow diagrams which, taken together, illustrate the interconnection and operation of the components of the data center;

FIGS. 15A – 17D are illustrations of the memory formats of the memories in the data center;

FIGS. 22A – 49 are schematic diagrams giving additional details of the circuits shown in FIGS. 8 and 11–14; and FIGS. 50 and 51 are perspective and block diagrams illustrating another embodiment of the vote head.

GENERAL SYSTEM DESCRIPTION

Figure 1:
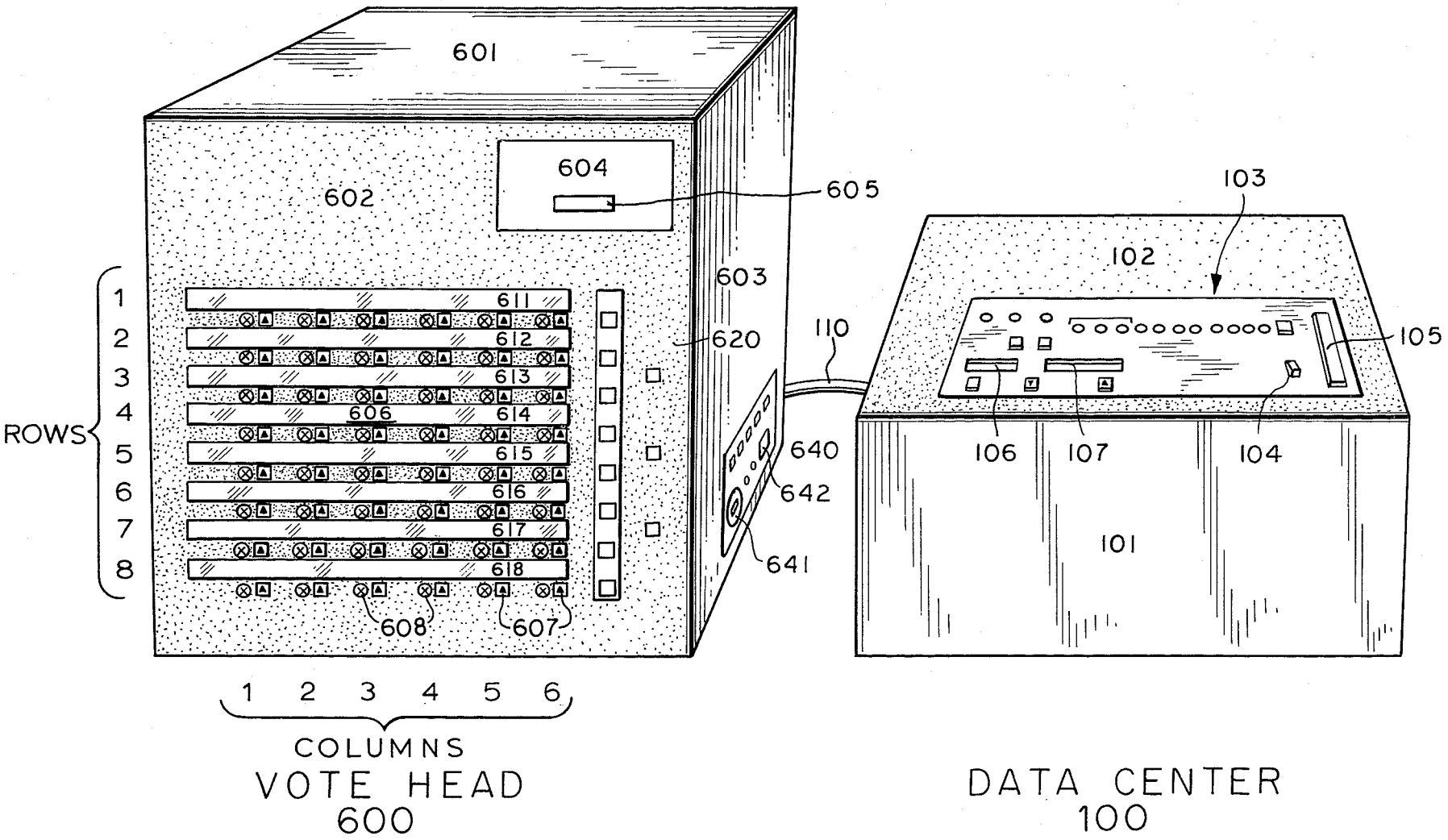
FIG. 1 is a perspective illustration of a system constructed in accordance with this invention, showing a data center coupled to a vote head.

FIG. 1 shows a data center unit 100 intercoupled 20 with a vote head unit 600. Both units are generally box-shaped, and can be placed on stands (not shown) for ready access by a voter making his selection and later by a judge utilizing the data center 100. In addition a shroud or divider (not shown) is generally utilized adjacent the vote head 600 to provide privacy for the voter. Because such details are not necessary to an understanding of the invention, they are omitted.

Of the data center 100, front panel 101 and the top portion 102 are visible. A control section 103 is shown in the top of the data center. This section includes a plurality of control and indicating units, such as the power on-off switch 104, a tape cartridge 105 received in a suitable well and positioned such that data can read from and recorded on the tape, and read-out or display windows 106, 107. The other components are relatively small in this perspective illustration and will be described subsequently in connection with FIG. 2.

A cable is shown intercoupling the data center 100 and the vote head 600. This cable includes a plurality of conductor pairs for transferring data from the data center 100 to the vote head 600, and back from the vote head to the data center. The separate power cables, one for the vote head and one for the data center, which are normally plugged into a conventional 110 volt, 60 hertz power outlet are not illustrated. It is important to note that there is only one conductor pair in the cable 110 for passing data from the data center 100 to the vote head 600, and only one additional conductor pair for returning data from the head 600 to the data center. This is important for security reasons, as it prevents a single wire or conductor pair from being cut to isolate one candidate or party from the possibility of selection.

Vote head 600 is generally box-shaped, and in FIG. 1 the top surface 601, front panel 602 and a side panel 603 are visible. Although the vote head appears to contain a number of selectors and other controls for actively generating signals, it is emphasized that vote head 600 is basically a passive selection unit for receiving serial bits of information over a conductor pair in cable 110, and altering a single bit in the train of bits as one or another button or key is actuated in the vote head. Visible on the front panel 602 are a write-in panel 604 behind which a roll of paper and other equipment is housed for allowing write-in of a candidate selection when the write-in window 605 is opened. The major portion of the area on the front panel is occupied by a candidate selection button array 606, which includes a plurality of vote buttons 607 which can be depressed to indicate a vote choice and a corresponding plurality of indicator lamps 608, one positioned to the left of each of the selector buttons for illumination to indicate which buttons were pushed. Those skilled in the art will appreciate that the term "button" encompasses other selectors and actuators whether or not physically displaced, for providing an output signal responsive to the touch of a human finger. The button array 606 is shown aligned in eight horizontal rows of six columns each, so that the eight horizontal rows and six vertical columns allow 48 places or ballot positions to be presented to the voter. Though not visible in FIG. 1, a film drive and projector unit is housed within the vote head 600 to project the names of candidates, identities of parties, or explanation of referenda or other propositions to be selected by the voter on the successive translucent strips, 611-618, inclusive. Such film strips are prepared by conventional photography techniques, for example on a 35 millimeter film for use with a well-known type of projector which in ordinary home use has a remote control button for advancing the projector to illuminate the next slide or frame, or reversing the drive to review the last frame. The incorporation of such a film drive and projector unit in conjunction with an electronic voting machine is disclosed and claimed in U.S. Pat. No. 3,793,505 - McKay, et al, entitled Electronic Voting Machine, which issued to the assignee of this invention on Feb. 19th, 1974. This patent also includes a careful exposition of suitable means shown as phototransistors 60, 61 and so forth (FIG. 3 of the U.S. Pat. No. 3,793,505) for providing positionindicating output signals as a function of a position code represented by light dots 56, 57 on the same film strip 51 which also contains the candidate and other balloting information. The complete teaching of such a film drive and projector arrangement obviates any necessity of a specific teaching of such well-known film movement and display techniques herein.

On the right side of the front panel 602 of the vote head is a control switch array 620 which contains various control buttons or selectors for such steps as advancing the film strip (not visible) to illuminate the next frame (similar to next ballot page) of candidates for selection by the voter. It is again noted that although the film strip advance is controlled by pressing one of the buttons in the array 620, the initial actuation of the selector button only sends a signal as one serial bit in a train of data bits passed within the cable 110 to the data center 100, which data bit is then in effect decoded. The data center then transmits another signal back over another conductor pair within cable 110 to provide the forward stepping of the film.

In the lower right portion of the right side panel 603 of the vote head is a judge's controls array 640. This array includes an authorization key 641 for actuation by an election judge to enable the equipment of the vote head, a push-button enable switch 642 to allow the judge to provide operation by a voter after viewing identification to insure he is qualified, and other buttons which will be explained hereinafter. For purposes of this explanation and the appended claims, the term "information matrix" will be used to describe the positions of all the selectors or actuators in the candidate selection button array 606, the control switch array 620, the judge's controls array 640, the write-in apparatus, and the film drive and projector equipment. More precisely the information matrix is continually scanned by signals passed over conductors within cable 110 to indicate the status of each of the buttons and/or other selectors, such as the key 641. "Status" is used to indicate not only the present physical position of a selector, but also its last operation or displacement by the voter or election judge. Details of the various selectors in the information matrix will be more apparent after viewing the illustrations in FIGS. 3 and 4 in connection with the accompanying explanation.

Figure 2:
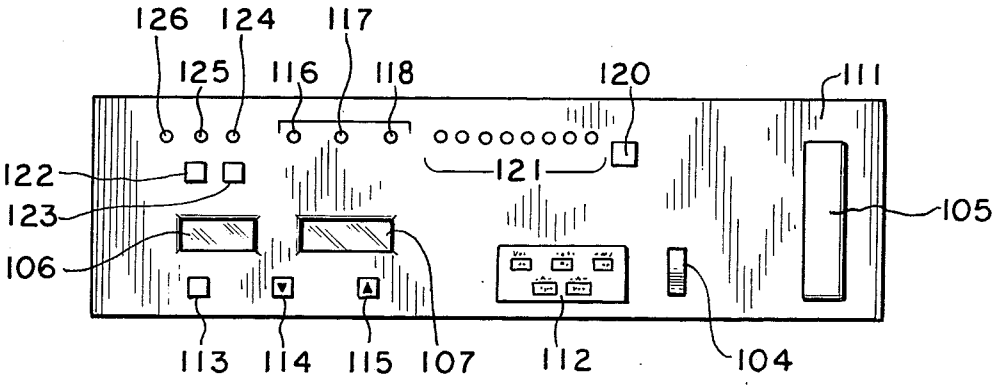

FIG. 2 shows the control area 103 of the data center 100 in more detail. A well or receptacle 111 is provided for receiving tape cartridge 105 for proper positioning adjacent the tape drive and record/read electronics (not visible). To the left of the power on-off switch 104 is an information area 112 on which the operating criteria for the equipment, such as volts, amps, hertz, model and serial numbers can be inscribed. Below the "position number" window 106 and the "total" readout window 107 are the restart button 113, backup button 114 and advance button 115. These controls are utilized at the end of voting for displaying the information stored in a memory of the data center in the windows 106, 107, so the vote total can be viewed by judges of election and recorded for tabulation. A locking cover (not shown) is provided for the data center, for locking in position over the just-described controls of the data center so that after the on-off switch 104 is turned to the on position with the tape cartridge inserted, the tape cartridge must remain in.

Above the "total" window 107 are three mode-indicating lamps 116, 117, and 118. One of these lamps will be illuminated to indicate the operating mode of the data center. In the "tape" mode, control information is passed from the tape cartridge after insertion into a memory within the data center; in the "vote" mode, after the cover is locked the voter is allowed to make selections at the vote head; and in the "display" mode, the vote totals can be read out at the end of the voting time. To the right of the mode lamps is a lamp array 121 including eight "Video Voter Check" lamps sequentially numbered 1–8, and a "reset" button 120 is to the right of this lamp array 121. To the left of the mode lights are a "tape stop" button 122, a "zero check" button 123, "zero verify" lamp 124, "tape check" lamp 125, and a "battery" indicator lamp 126. The use of the buttons and lamps 116–125 in connection with the initial energization and operation of the data center will be described hereinafter.

Figure 3:
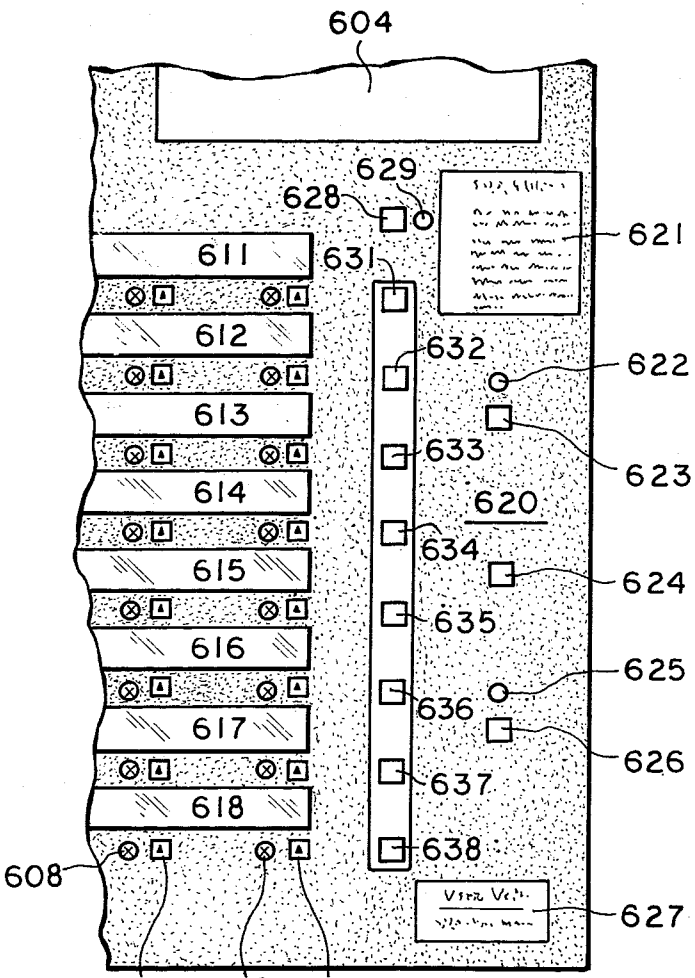

FIG. 3 shows the right portion of the front panel 602 of vote head 600. The locking cover for the vote head is now shown. Only the lower part of the front plate 604 of the write-in apparatus is indicated, and only the two righthand columns 5 and 6 of the candidate selection button array 606 are shown. In the upper right portion of the control switch array 620 is a box 621 with the instructions for the write-in-procedure. Below this box is an "on" lamp 622 which is illuminated when the vote head is energized and ready for operation. Immediately beneath that is a "new page" button 623, for actuation by the voter to view the next page of the ballot, by instructing the projector behind the front panel to advance to the next frame. Next is a "review ballot" button 624 for actuation by the voter to return the projector to the initial position, and sequentially project the ballot frame by frame, while the appropriate ones of the lamps 608 are illuminated adjacent the appropriate candidates or propositions on each frame, to review his selection. A "votes recorded" lamp 625 is provided just above a "register votes" button 626. When the button 626 is actuated the system begins to transfer the votes indicated by the voter from a temporary or "scratch-pad" memory in the data center to another memory which continually accumulates the votes cast at all the vote heads connected to the same data center. While this transfer and recording is taking place and the film is being returned to the home frame position, lamp 625 will flash to indicate to the voter that his selections are being recorded. When the lamp 625 is extinguished, the voter knows that his voting procedure is terminated and he can leave the booth.

A "write-in" button 628 is provided for the voter to indicate he wishes to write in a candidate selection. Lamp 629 is intermittently flashed when button 628 is pushed, and then continuously energized when one of the row-select write-in buttons 631–638 is pushed. The remainder of the write-in procedure will be described hereinafter.

Figure 4:
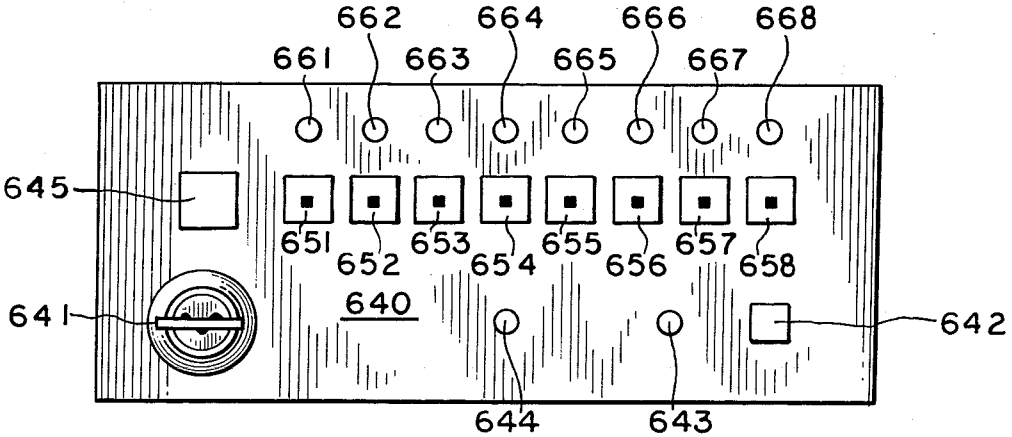
FIGS. 2, 3 and 4 are illustrations, in more detail and on an enlarged scale, of portions of the data center and vote head shown in FIG. 1.

FIG. 4 indicates the controls on the election judge's panel, at the lower right of the vote head 600. The authorization key 641 is inserted and turned to the right by the judge to complete the data path between the vote head and the data center. When the enable button 642 is pushed, the voting lamp 643 is illuminated to provide a visible indication that the vote head is ready for operation by the voter. The "active" lamp 644 will be illuminated when the voter pushes the first button on the candidate selection array 606 or the control switch array 620. This provides an indication to the judge that the voter is successfully operating the machine. If the light 644 is not illuminated then the judge can surmise that the voter has "frozen" or does not understand which of the buttons to push first. The voter can leave the booth and have any of his questions answered. The "add" button 645 is used in conjunction with the page selection buttons 651–658, allowing the judge to control the illumination of lamps 661–668 during balloting. In addition the add button is used during the pre-election procedure in which the original tape (the tape in cartridge 105 in the data center) is "configured" or initially recorded with the appropriate information for the particular election. The page selection buttons 651–658 allow the judge of elections to skip pages or go from page to page sequentially, to control which ballots are presented to the voter. The page selected is indicated thereafter by the illumination of the corresponding one of the lamps 661–668. It is noted that the judges' panel is on the side of the vote head, away from the front panel which is shrouded so that the voter is secluded when making his selection. Thus the judge can view the voter's identification before he votes, determine that he is from a certain precinct, and skip to a certain page, which will allow the data center to accumulate votes from different precinct voters for the same candidate, and to maintain cumulative totals by precincts. In addition the page selection feature allows the selective presentation of referenda, bond issues or other issues for determination by voters of different precincts. With this general perspective of the hardware arrangement in the vote casting and tabulating system, the underlying data processing principles will now be explained.

FIG. 5 basically illustrates the system of FIG. 1, but in a block diagram arrangement such that the major subsystems of the complete invention are shown intercoupled to function as a complete system. In the data center 100 a common bus 130 intercouples a logic circuit 131, a normal power supply 132 which is backed-up by a battery 133 for operation as will be described hereinafter, the displays 106 and 107 already illustrated and described, a tape recorder arrangement 124 which includes the electronics for recording on and reading from the tape in the cartridge 105, and the memory arrangement. The memory actually includes three separate memories, the first of which is a "scratch-pad" memory 135 for operation in conjunction with the vote head. That is, the status of the various selectors, keys and other controls in the associated vote head are continually represented in the vote head memory 135. Coupled to this is the candidate count memory 136 for receiving the information from the vote head memory 135 each time the "register votes" button (626, FIG. 3) is pushed at the vote head. The third memory is the election configuration memory 137. The illustrated memories 135–137 were of a semiconductor type in the preferred embodiment of the invention. For this reason the back-up battery 133 was supplied in conjunction with the normal power supply 132 so that, upon the interruption of the normal power supply from a suitable wall outlet (not shown) to the supply 132, the battery 133 will supply energy for the time required for the then-accumulated totals in the memory 137 and the contents of memories 135 and 136, to be read out and recorded by the tape recorder 134 onto the tape within the cartridge 105. Similarly the data center, when reenergized, will return the accumulated totals and other information then on the tape in cartridge 105 over the tape recorder 134 into the memories 135, 136 and 137. This is done automatically under the direction of the steps or "program" stored by reason of the interconnection of the components in the logic circuit 131. The logic circuit, together with the information initially passed from the tape over the recorder 134 into the election configuration memory 137, govern the operation of the complete system.

As will be made clear hereinafter, this system operation is basically regulated by the generation of a series of data pulses from a "clock" or oscillator circuit within the logic circuit 131 of the data center. These pulses are passed over a conductor pair in cable 110 to the logic circuit 671, for passing regulating signals over the common bus 670 in the vote head 600 to the various sub-systems there shown. A power supply 672 is coupled to the common bus. This power supply, like the power supply 132 in the data center, is supplied with 110 volt, 60 hertz energy from a conventional wall outlet. The film drive and projector apparatus 673 and the write-in apparatus 674 are also coupled to the common bus 670. The film drive and projector can be a conventional type 35 millimeter remote control projector, as described previously and fully explained in connection with U.S. Pat. No. 3,793,505. The write-in apparatus includes a roll of paper with a small motor for advancing the paper, a mechanical spring for opening the write-in window (it is closed by the voter), and three print wheels for actuation by the same mechanical spring to indicate both the frame then being presented to the voter when the write-in select button 628 is pushed, and which one of the row write-in buttons 631–638 is depressed subsequent to actuation of the write-in select button 628.

An additional cable 110A can be coupled to the vote head 600 and connected to the logic circuit 671 to pass the train of data pulses from the data center to an adjacent vote head (not shown). Such intercoupling and operation will be apparent from the subsequent description. In a preferred embodiment a single data center 100 was constructed to service eight vote heads simultaneously, with so little time lapse between the actuation of a button by a voter and the illumination of the adjacent lamp to identify the button actuated, that each voter believes his vote head is the only one being handled by the data center. With this basic view of the data processing sub-systems, the timing or sequence of the train of data pulses will now be explained.

FIG. 6 depicts a train of data pulses or bits in serial form, shown conventionally as vertical lines to represent each pulse in a data word, and referenced 580 to collectively represent the 88 pulses or bits in a single data word. The pulse group 580 represents a train of pulses generated by the clock circuit, to be described hereinafter, and continually passed from the data center 100 over the cable 110 (FIG. 5) to the logic circuit in the vote head. At the end of the complete data word a reset or synchronizing (sync) pulse is generated, and is represented by a pulse of slightly higher amplitude. This pulse is not only used in the basic scanning procedure, but also a single sync or reset pulse is passed to the vote head at the end of every data word transmission, to maintain positive synchronization between the 88-bit data word scanning the information matrix in the vote head and the 88-bit data word effecting the program operation and other functions in the data center. Precise synchronization between the data center and the vote head circuits is assured with this arrangement, which is also important because it contributes to the continuous scanning of the status of the various buttons and switches in the vote head, translation of the status information to the data center, and positive and rapid operation of the various counting and program circuits, all accomplished with a minimum of expense and equipment size and a maximum of security and accuracy.

Referring to the left hand portion of FIG. 1, there are eight horizontal rows and six vertical columns of positions in which a selection can be effected by pushing one of the vote buttons 607. Thus there are only 48 different positions to be scanned for data transfer by actuation of a single vote selector or button. Because 88 pulses are used in a single data word, this leaves 88–48 or 40 additional scan positions to determine the situation of the switches in the control switch array 620, those in the judges controls array 640, the frame then presented on the screen by the film drive projector 673, and the status of the write-in apparatus 674. The logic circuit 671 in the vote head is arranged so that the input scanning pulses are first applied to the first column, designated column one in FIG. 1 and in FIG. 6, and this column position is "held" while the eleven rows in that column are scanned. Only eight of these row scanning pulses are actually related to the eight vertical vote buttons 607 in the first column, leaving three additional scanning positions for hardware points to be scanned by the last three scanning pulses at the end of each column pulse sequence. The eleven individual row pulses are identified by number in the column 3 position of the pulse group 580. At the end of the data word, the time duration of one bit of the 88 bits is indicated, to better relate this description to the succeeding description of hardware and program cycles.

This single bit, or the space between two adjacent pulses, is shown expanded in a time frame in FIG. 7. In a preferred embodiment the frequency of the bit pulses was selected so that 88.8 complete data words would be transmitted in each second. This provides ample time for effectively scanning all the hardware in the vote head (or eight vote heads), returning the output signals to the data center, illuminating a light associated with a vote button or advancing the projector, or taking any other action indicated by a change in status of any selector button at the vote head. This occurs so rapidly that the voter does not notice any time lag between initiation of a request at the vote head and the carrying of that request into effect by the program stored in the data center. This transmission rate of the data words corresponds to a time of 11,264 microseconds for one complete data word. One bit of the 88-bit data word thus requires 128 microseconds. This single bit, shown expanded in FIG. 7, in only 128 microseconds provides the time for 64 cycles of the complete voting system. Of these 64 two-microsecond machine cycles, the first 8 cycles are devoted to the hardware—scanning the equipment—and the remaining 56 cycles in each bit are devoted to the program execution, carrying out the orders or acknowledging the operation of some element in the hardware. Below is Table A, setting out the row and column scanning locations for the 88-bits of the data word. In other words, this chart represents the input data signals to the vote head 600 distributed according to the scanning sequence. Each column has an address in the three-bit binary code (4-2-1) and each of the 11 horizontal rows has an address in the four bit binary code (8-4-2-1). These specific addresses are shown under each of the column headings, and at the left side of the chart below the Row SBC (scan button counter) designation.

TABLE A

| Address SBC Row 8,4,2,1 | C1 000 | C2 001 | C3 010 | C4 011 | C5 100 | C6 101 | C7 110 | C8 111 |
|---|---|---|---|---|---|---|---|---|
| | | | Input Signals To Vote Head Scan Button Counter: Column 4,2,1 | | | | | |
| 0000 | LP11 | LP12 | LP13 | LP14 | LP15 | LP16 | RCB:1 | FMB:1 |
| 0001 | LP21 | LP22 | LP23 | LP24 | LP25 | LP26 | RCB:2 | FMB:2 |
| 0010 | LP31 | LP32 | LP33 | LP34 | LP35 | LP36 | RCB:3 | FMB:3 |
| 0011 | LP41 | LP42 | LP43 | LP44 | LP45 | LP46 | OPEN WR-IN | FMB:4 |
| 0100 | LP51 | LP52 | LP53 | LP54 | LP55 | LP56 | CHANGE FRAME | FMB:5 |
| 0101 | LP61 | LP62 | LP63 | LP64 | LP65 | LP66 | REV FRAME | FMB:6 |
| 0110 | LP71 | LP72 | LP73 | LP74 | LP75 | LP76 | CLK PRT-WHL | FMB:7 |
| 0111 | LP81 | LP82 | LP83 | LP84 | LP85 | LP86 | | FMB:8 |
| 1010 | | VOTING ACTIVE | VOTING ENAB. FLASH. | WR-IN INIT. | WR-IN MODE | VOTING ENAB. SOLID | REG. VOTES | |
| 1001 | | SW ACTIVE | WR-IN OPEN | TM | | | | ADD PARTY |
| 1000 | PEI 1 LP 111 | PEI 2 LP 112 | PEI 3 LP 113 | PEI 4 LP 114 | PEI 5 LP 115 | PEI 6 LP 116 | PEI 7 LP 117 | PEI 8 LP 118 |

The designation "LP" refers to one of the lamps, such as the lamps 608 shown in FIG. 3 adjacent each of the vote buttons 607. Thus after one of the vote buttons has been depressed, and the signal is transmitted over the conductor pair to the data center, the program determines if in fact this was a valid button and no other candidate (or no excess number of candidates) has been selected for this race, and returns a signal to the appropriate position to light the lamp adjacent the actuated voter button. In columns 7 and 8, the legend "RCB" refers to a "race count bit" and "FMB" designates a "frame bit." The subsequent legends regarding opening the write-in window, and the changing and reversing of the frame presentation, are apparent. The legend "CLK PRT-WHL" means "clock print-wheel," that is, a pulse initiating the actuation of the print wheels in the write-in apparatus 674 to identify the frame and row in which the write-in selection was made. "REG VOTES" refers to the register vote button 626 on the vote head. In column 8, "ADD PARTY" refers to the "ADD" button 645 on the judges panel (FIG. 4).

Among the other legends, "VOTING ACTIVE" means that the voting lamp 643 (FIG. 4) has been illuminated, and "SW ACTIVE" means that the active lamp 644 has been lighted. "VOTING ENAB. FLASH." means that the voting lamp 643 is being flashed intermittently and not continuously illuminated. "WR-IN OPEN" indicates that the write-in window 605 has been opened. "WR-IN INIT." indicates that write-in button 628 has been pushed. "TM" indicates the system is in the test mode.

"WR-IN MODE" denotes that the write-in sequence has been started. "VOTING ENAB. SOLID" means that the voting lamp 643 is continuously illuminated. In the bottom or 11th row in Table A, the term "PEI" refers to party enable indicator. This legend will become more apparent from the subsequent explanations.

In a related manner the output signals from the vote head to the data center, occurring at precise times in synchronism with the 88-bit scanning input signal in a complete data word, denote the actuation of switches or the status of some component. These output signals in the 8×11 information matrix are depicted in Table B below.

TABLE B

| Address SBC ROW 8,4,2,1 | C1 000 | C2 001 | C3 010 | C4 011 | C5 100 | C6 101 | C7 110 | C8 111 |
|---|---|---|---|---|---|---|---|---|
| | Output Signals From Vote Head Scan Button Counter: Column 4,2,1 | | | | | | | |
| 0000 | SW11 | SW12 | SW13 | SW14 | SW15 | SW16 | WI17 | FMID 1 |
| 0001 | SW21 | SW22 | SW23 | SW24 | SW25 | SW26 | WI27 | FMID 2 |
| 0010 | SW31 | SW32 | SW33 | SW34 | SW35 | SW36 | WI37 | FMID 3 |
| 0011 | SW41 | SW42 | SW43 | SW44 | SW45 | SW46 | WI47 | FMID 4 |
| 0100 | SW51 | SW52 | SW53 | SW54 | SW55 | SW56 | WI57 | FMID 5 |
| 0101 | SW61 | SW62 | SW63 | SW64 | SW65 | SW66 | WI67 | FMID 6 |
| 0110 | SW71 | SW72 | SW73 | SW74 | SW75 | SW76 | WI77 | FMID 7 |
| 0111 | SW81 | SW82 | SW83 | SW84 | SW85 | SW86 | WI87 | FMID 8 |
| 1010 | WI91 | WI92 | WI93 | WI94 | WI95 | WI96 | WR IN SELECT | |
| 1001 | REV-IEW | REG. VOTES | WR-IN OPEN | TM | ENAB-LED | NEW PAGE | | ADD PARTY |
| 1000 | PRTYC 111 | PRYTC 112 | PRYTC 113 | PRTYC 114 | PRTYC 115 | PRTYC 116 | PRTYC 117 | PRTYC 118 |

The format for Table B is generally similar to that of Table A. However, instead of the designation LP for lamp, "SW" refers to a switch, one of the vote selector buttons 607 shown in FIG. 3. Thus if SW42 (the switch in row 4, column 2) is depressed, this signal is transmitted out as a changed data bit over a conductor pair to the data center, and subsequently (after appropriate operation in the program at the data center) a signal is returned to the corresponding information position in Table A, so that the lamp 42 is illuminated in row 4, column 2, adjacent the button just depressed by the voter. In Table B, column 7, the various write-in select button 631–638 are represented at the positions in column 7, rows 1–8. In row 9 of this column, the legend indicates this position is associated with the write-in select button 628. In column 8 the "FMID" positions refer to "frame identification" positions. That is, a four out of eight code is used as will be explained, which code positively identifies the particular frame or ballot page being displayed on the screen for selection by the voter. The legends in row 10 are associated with the different buttons having similar legends on the front panel and on the judges panel of the vote head. The legend "PRTYC" in the last row refers to "party control," and is useful both to provide page control information which regulates page (frame) skipping, and in providing the basic control or "configuration" tape for a specific election after the 35 millimeter film has been initially prepared to display the names of the different candidates for the election.

Given this basic understanding of the general block system in FIG. 5, including the transmission of individual data bits from the data center over one conductor pair 110 to the vote head and the return of signals over another conductor pair at precise times related to the times of transmission over the first conductor pair to the data center, it will now be useful to consider the basic logical arrangement of the major components in the vote head 600.

VOTE HEAD - LOGIC DESCRIPTION

Figure 8:
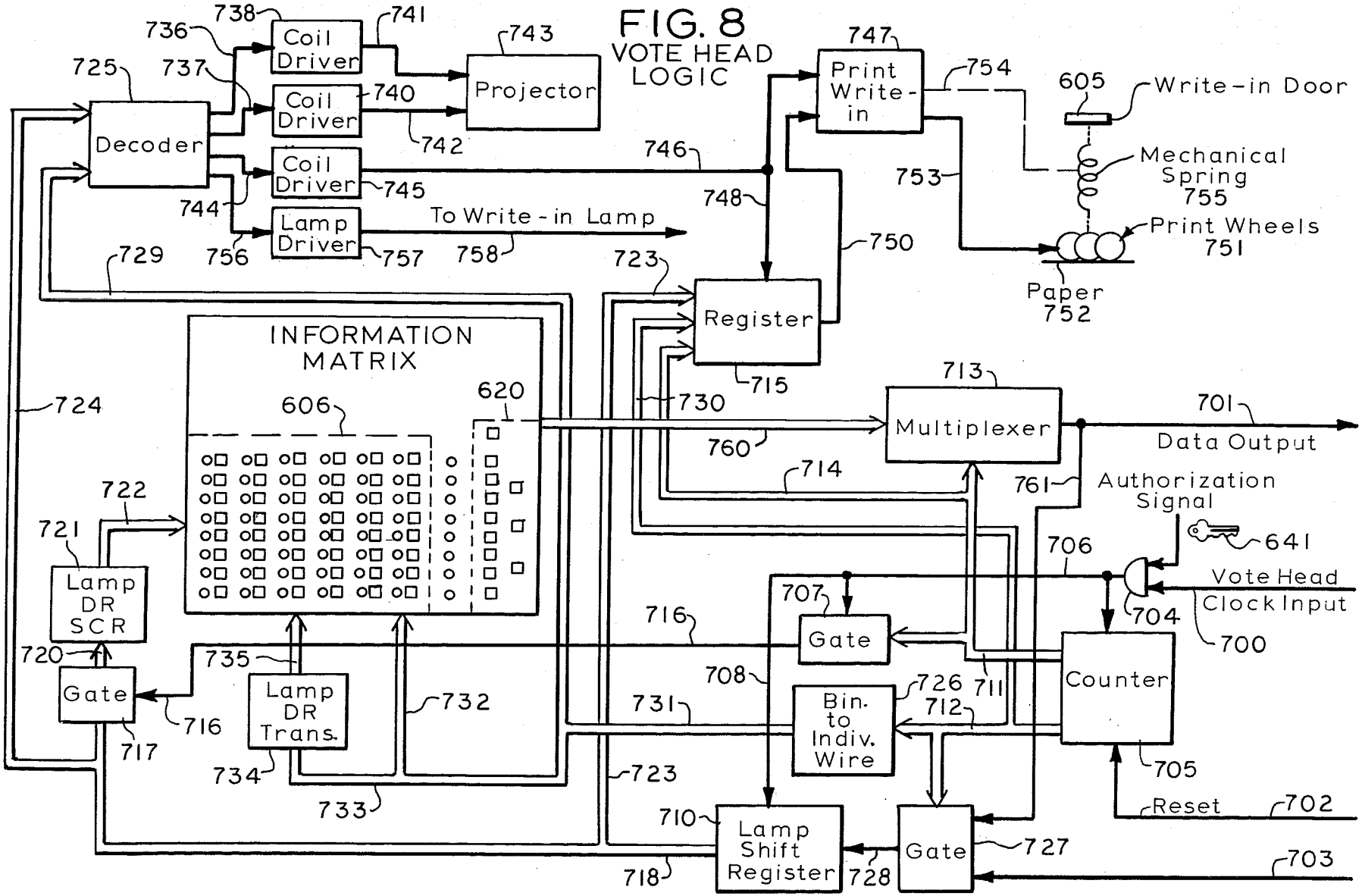
FIG. 8 is a data flow diagram depicting the interconnection of the vote head components.

FIG. 8 shows the vote head information matrix with the candidate selection array 606 generally indicated. The remainder of the information matrix to be scanned by the incoming pulses is not specifically depicted, but from Table A and the previous description it is apparent that there is an 8×11 matrix which will be scanned by the 88 serial data bits in each word. This train of data pulses is received over the conductor pair 700, and is termed the "vote head clock input" signal for purposes of this description. This is also termed the "head clock" signal; "clock" denotes the precise generation of the pulses by an oscillator circuit, and "head" refers to the vote head. By "conductor pair" is meant either a physical pair of conductors as is frequently used in telephone circuits, or a coaxial pair of concentric conductors often used in higher-frequency circuits, or any pair of conductors for transmitting a data signal. It is emphasized that although each pulse is shown as relatively uniform and with the same amplitude in FIGS. 6 and 7; a yes or no, a I or O, signal is generally represented by a change in amplitude in such pulses. For example a pulse of virtually zero or less than one volt amplitude could indicate no change or actuation or a component or no command; and an amplitude of 5 or 6 volts can indicate a button has been actuated or that some command had been generated in the program portion of the data center in response to actuation of a component in the vote head. The data output signals from the vote head to the data center are passed over the conductor pair 701, which like the other conductor pairs will be depicted as a single line for simplicity. These output signals correspond to the previously described data bits and particularly to the matrix shown above in Table B. Another conductor pair 702 provides for receipt of a reset or sync signal from the data center, to maintain the requisite correspondence in time between the data pulses circulating in the vote head and those in the data center. Another conductor pair 703 provides an input connection to the vote head 600 for receiving data signals from the scratch-pad or vote head memory in the data center, as will be explained subsequently.

The vote head clock input signal train passes over conductor 700 to one input connection of a conventional AND circuit 704, the other input connection of which receives the authorization signal when the judge's key 641 is initially inserted and displaced to activate the vote head. The output signal from the AND circuit 704 is passed to a counter circuit 705, over conductor 706 to a gate circuit 707, and over conductor 708 to a lamp shift register circuit 710. Details of these various circuits represented in block form will be set out hereinafter in FIGS. 22A–28, to enable those skilled in the art to build and operate the system with a minimum of experimentation. However the basic signal flow and co-operation of the different system components will be evident from the desscription and the block diagram, and will not be given in connection with the schematic diagrams which are appended only for an explicit teaching.

The counter circuit 705 is of the type which receives serial bits or pulses over the input connection from AND circuit 704, and provides binary coded output signals on a plurality of conductors at two different output connections. A 4-wire or 4-position binary output signal is continually provided on its first output line designated 711, and these binary signals correspond to the binary address (8,4,2,1) of the successive rows 1-11 in the information matrix to be scanned, noted in the left column of Tables A and B above. On the other output line 712 of the counter 705, is a 3-wire binary signal, for use in the 3-position column address (4,2,1) and related functions.

The 4-line binary signals on line 711 are applied to gate circuit 707, to a multiplexer circuit 713, and, over line 714, to one input connection of a register circuit 715. The output signal from gate circuit 707 is passed over conductor 716 to one input of another gate circuit 717. The output signals from lamp shift register 710 are applied over an output line 718 to the same gate circuit 717, which in turn provides output signals for passage over the line 720 to drive the lamp-driver SCR circuit 721 and provide row signals on line 722 (actually, on 8 conductors corresponding the the 8 rows of the candidate selection button array 606 of the vote head). It is noted that the output signals from the lamp shift register 710 are also passed over line 718 and 723 to another input connection of the register 715 which provides the frame number identification, and (to the left of circuits 717 and 721) over line 724 to an input connection of another decoder circuit 725, used in providing the forward and reverse commands to the film projector and also commands to the write-in apparatus.

The 3-wire column signals on the output line 712 of counter 705 are applied to a decoder circuit 726 for translating the binary signals into individual wire signals, and to one input connection of a gate circuit 727 which also receives two other input signals, one from the output conductor pair 701 of the vote head and the other from the input date line 703. Gate 727 provides an output signal over conductor 728 to the lamp shift register 710.

The third output of the 3-wire binary signals from counter 705 is passed over conductors 712 and 730 to the third input connection of register 715. The output signals on individual wires from decoder 726 are passed over the eight-conductor circuits 731 and 732 to the various locations in the eighth sequential columns of the vote button array. Six of the conductors are included in another circuit 733 coupled to a lamp-driver transistor circuit 734, which in turn provides amplified output signals for passage over the six conductors (collectively labeled 735) to illuminate the selected ones of the indicator lamps 608 when an adjacent one of the vote buttons 607 is depressed.

At the top left portion of FIG. 8 is a decoder 725, receiving input signals both from lamp shift register 710 and from the decoder circuit 726. Decoder 725 provides a first pair of output signals on conductors 736 and 737. These signals are amplified in the respective coil driver stages 738, 740 and passed over the control conductors 741, 742 to the projector 743. The signal on conductor 741 is used to signal a change of frame in the forward direction to the projector, and conversely the signal on conductor 742 indicates a backup signal for the projector. Such application of forward and reverse signals with a hand-held control unit for the 35 millimeter projectors are well known and understood in the art. In addition the projector operation is explained in detail in the above identified referenced patent.

There are two additional output connections from the decoder circuit 725. The first of these connections passes a signal over conductor 744 to another coil driver stage 745, for providing a signal over line 746 to a print write-in command circuit 747, and also providing a signal over line 748 to the print wheel position register 715. This register has three iputs, the row and column inputs from counter 705 and the additional signal from lamp-shift register 710. Accordingly register 715 always provides a signal over conductor 750 to the print write-in command circuit 747 which indicates the print wheel positions, that is, the positions of three print wheels collectively denoted 751 positioned adjacent a paper web 752 for impressing thereon the characters on the print wheel adjacent the paper when energy is imparted to the print wheels under the command of circuit 747. Another output signal from command circuit 747 is passed over a linkage, represented by broken line 754, to release the energy previously stored in a mechanical spring 755. In a preferred embodiment the mechanical spring was physically coupled to the write-in window 605 so that, upon closing of the window by the voter at the termination of the previous write-in voting procedure, energy is stored in spring 755 for subsequent release of (1) pull up the write-in window 605 when the next write-in sequence is initiated, and (2) provide impact energy to the print wheels 751 to imprint both the frame ID number (from 0–19) and the row (1–8) on paper and thus provide the precise identification of the exact race for which the selection has been written in.

Decoder stage 725 also provides another output control signal on conductor 756. When the voter depresses the write-in button 628 (FIG. 3), this signal is passed over the cable to the data center, examined under its internal program and an appropriate signal is returned to the vote head which, after passing through decoder 725, provides an intermittent signal on line 756, through lamp driver stage 757 and over its output conductor 758 to flash the write-in select lamp 629 adjacent the basic write-in button 628. When the voter then depresses one of the row write-in select buttons 631–638, the signal returned from the data center provides a continuous energization signal on line 756 and write-in lamp 629 is continuously energized. At the same time that the lamp is continually turned on, the other signal is provided on conductor 744, through coil driver stage 745 and over line 746, both to the print write-in control stage 747 and over line 748 to the register stage 715, as previously described.

It is again emphasized that the trains of data pulses are continually circulating between the data center and the vote head. As previously described these data pulses are received at the vote head 600 in FIG. 8 over line 700, for stepping the counter 705 and providing the basic signals for the logic arrangement in the vote head. After scanning the various selector buttons and controls in the information matrix, the output signals are provided on an 11-wire output line 760 (corresponding to the 11 row positions) to the multiplexer 713. The received input pulses or serial data bits are decoded in the counter 705 to provide different binary codes for use in addressing and locating the various items. The matrix is scanned by "sitting" on a single column, while the 11 rows of possible information in that column are scanned; hence the 11-line output signal of parallel bits in cable 760 to the multiplexer 713. The multiplexer functions in a sense inverse to counter 705, coverting the parallel pulse bits into a serial train of data pulses for transmission over the data output line 701 to the data center in synchronism with the basic clock signal provided in the data center. A synchronizing signal is also provided over from the multiplexer 713 over line 761 to one input circuit of gate 727.

Line 702 at the lower right portion provides for application of a reset or sync pulse to the counter stage 705 during the transmission of each data word. As noted previously, to effect the maximum derivation of information and the transfer and decoding of this information with a minimum of hardware it is requisite that the data bits received over the input line 700 and then circulated through counter 705 and the subsequent stages be maintained in synchronism with the circulation of the pulses and operation of the components in the data center itself. For this reason the reset pulses are applied to the counter 705 to be certain that any slight aberration or time difference between the pulses is corrected in each data word cycle. As a practical matter it has been found that the reset is needed only during the first cycle of the equipment, when the data center and the vote head have been initially turned on and energized. After the first reset pulse, the snchronism is maintained because of the precise timing from the basic oscillator or clock in the data center, but the reset pulse provides an extra measure of safeguard during the subsequent operation of the voting system.

Figure 9:
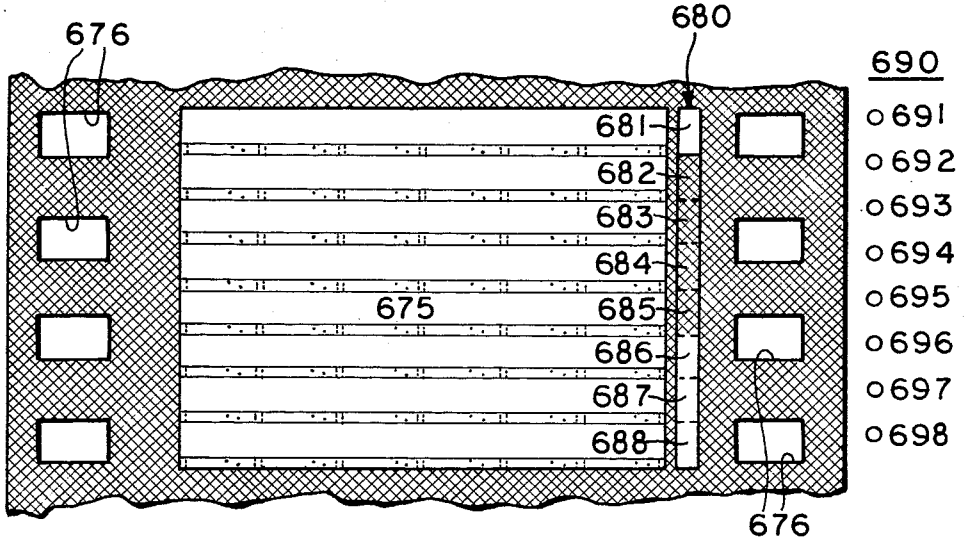
FIG. 9 is a front view of a segment of a film strip for use with this invention, showing one frame of the strip.

It has been found convenient to represent successive ballow pages as successive, individual frames of a continuous film strip. FIG. 9 illustrates a single-frame segment of one such film strip. The segment includes a central portion 675, on which the individual candidate names and similar specific information is carried, after being prepared by conventional photographic techniques. This information is projected onto the screen of the vote head so that the individual names or party identifications are on the translucent strips 611–618, above the vote selector buttons 607 in the 8×6 matrix of vote buttons. The film strip includes conventional film sprocket holes 676 adjacent each margin of the film for driving the film in response to signals supplied over lines 741, 742 to the projector apparatus. In accordance with a feature of this inventive system each frame segment also includes a frame identification area 680. This frame identification (FR ID) location is subdivided into eigh individual locations 681–688. In a preferred embodiment a four-out-of-eight code was used for positive identification with maximum accuracy. That is, each frame includes a vertical column of eight spaces of which four are left open to pass radiation from the projector bulb, and four are opaque, like the adjacent opaque portion of the film strip. To the right of the film strip segment an array of photoresistors 690 is depicted.

Projector 743 was illustrated in FIG. 8 as a simple block, because the projector with a remote control arrangement for advancing and reversing the frames, with each frame being identified as light falls on four of the eight photoresistors numbered 691–698 in a columnar array corresponding to the vertical disposition of the code spaces 681–688 on the film strip. Although photoresistors were used in a preferred embodiment, those skilled in the art will appreciate that photodiodes, phototransistors or any other related component for providing a variation in some electrical parameter as a function of the absence or presence of incident radiation can also be used. In the frame shown in FIG. 9, the code one position is open as signified by the open rectangle 681, and the next code row positions 2–5 are opaque, preventing the passage of light. The last three positions 686–688 are open to pass the radiation. This results in passage of light from the bulb in the projector through the openings 681, 686, 687 and 688 to impinge on the similarly positioned phototransistors 691, 696, 697 and 698. This provides an output code with positive identification of which frame is then being illuminated, identifying to the data center which candidate array is then presented to the voter.

Figure 10:
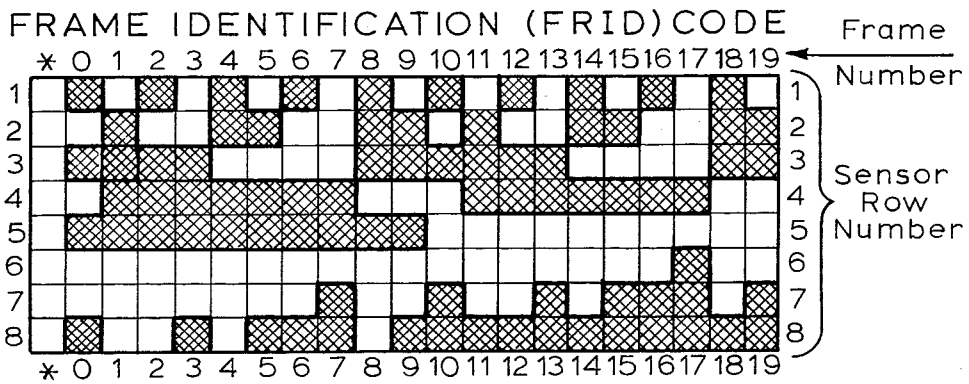
FIG. 10 is a diagram illustrating the codes which identify each successive frame on the film strip.

FIG. 10 depicts a complete code arrangement for identifying 20 successive frames, or 20 individual slides, when presented successively by the projector for viewing by the voter. There is an extra or twenty-first frame identified by the asterisk with completely opaque presentation on the film, and only the frame identification area is open to transmit light. This is a special identification of the home frame, and allows positive decoding even if the registration of the film, while the projector is stepped in reverse, is offset from the registration when it is being stepped in the forward direction. The eight sensor row numbers indicate the successive row positions of the identification spaces 681–688, corresponding to the vertical positions of the phototransistors 691–698. Of course other code numbers and arrangements can be employed, but that illustrated was successfully used in a preferred embodiment, giving positive and accurate identification with a relatively simple eight-position code arrangement.

From the code arrangement shown on FIG. 10, it is apparent that a corresponding arrangement can be utilized to identify each candidate or question presented to the voter. Each location on the screen visible to the voter can be identified by the number of the frame (0–19) then being projected onto the screen, the row (1–8) in which the candidate or question is positioned, and the column number (1–6) in that specific row. There are 20 frame numbers identified in FIG. 10, indicated as 0 – 19. Thus two digits are required to identify the frame when more than nine frames are utilized. A third digit is used to identify the row (1–8), and a fourth digit is used to identify the column (1–6). Suppose then that on a 20-frame format, it is desired to identify the candidate position on the third frame, in the first row, and the fourth column. This can be done by the four digit sequence 0314. In a corresponding manner a four digit sequence can be utilized to identify all the successive positions on the 20 frames of the film strip.

With this basic understanding of the data flow and interconnection of the subsystems within the vote head itself, the interconnection of the data center and its operation will now be described. In general all of the components such as the memories and the logic arrangement within the data center are used to execute the program stored within the data center, both in the hard-wired logic and in the memory with information readin from tape, and also to send out the data pulses to the vote heads coupled to that particular data center. Because as many as eight vote heads can be serviced and continually monitored by a single data center, there is one component or circuit arrangement, termed an adapter, in the data center which is particular to only one vote head. If there are eight volte heads coupled to the data center, there are eight adapters; with only two vote heads coupled to the data center, only two adapters are used. The illustration and description of a single adapter will suffice to show the use of up to eight of these adapters. In addition, however, it is convenient to use shortened designations to describe the data and circuit interconnections within the data center. For example, the vote head memory shown as a single block 135 in FIG. 5 will be designated VHM; the program memory in the data center will be designated PM. Although these mnemonics will be readily apparent to those skilled in the art. Table C set out below is a compilation of the mnemonics or shorthand identifications of the major components used in the data flow diagrams set out in FIGS. 11 – 14.

TABLE C

| BLOCK DIAGRAM GLOSSARY | | |
|---|---|---|
| Abbreviation | Name | Size in Bits |
| FAR | Frame Address Register | 5 |
| MAR | Memory Address Register | 7 |
| VHC | Vote Head Counter | 3 |
| VHM | Vote Head Memory | 2,048 |
| ECM | Election Configuration Memory | 2,048 |
| MSR | Memory Data Shift Register | 4 |
| CCM | Candidate Count Memory | 4,096 to 16,364 |
| MCR | Memory Counter Register | 4 |
| CAR | Candidate Count Memory Address Register | 12 |
| PAR | Program Address Register | 10 |
| MCO | Memory Counter Overflow | 1 |
| MC ½ | Memory Counter ½ Bit | 1 |
| NVB | New Valid Button | — |

TABLE C-continued

| BLOCK DIAGRAM GLOSSARY | | |
|---|---|---|
| Abbreviation | Name | Size in Bits |
| NFI | New Frame ID Code | — |
| PCC | Program Cycle Counter | 2 |
| SHC | Scan Head Counter | 3 |
| SBC | Scan Button Counter | 7 |
| IR | Instruction Register | 16 |
| PM | Program Memory | 8,192 |
| SMA | Selected Memory Address | — |
| CMPR | Compare Circuit | — |
| SEL | Selector Circuit | — |
| VH | Vote Head | — |
| VHR | Vote Head Register | 7 |

DATA CENTER ---LOGIC DESCRIPTION

Figure 11:
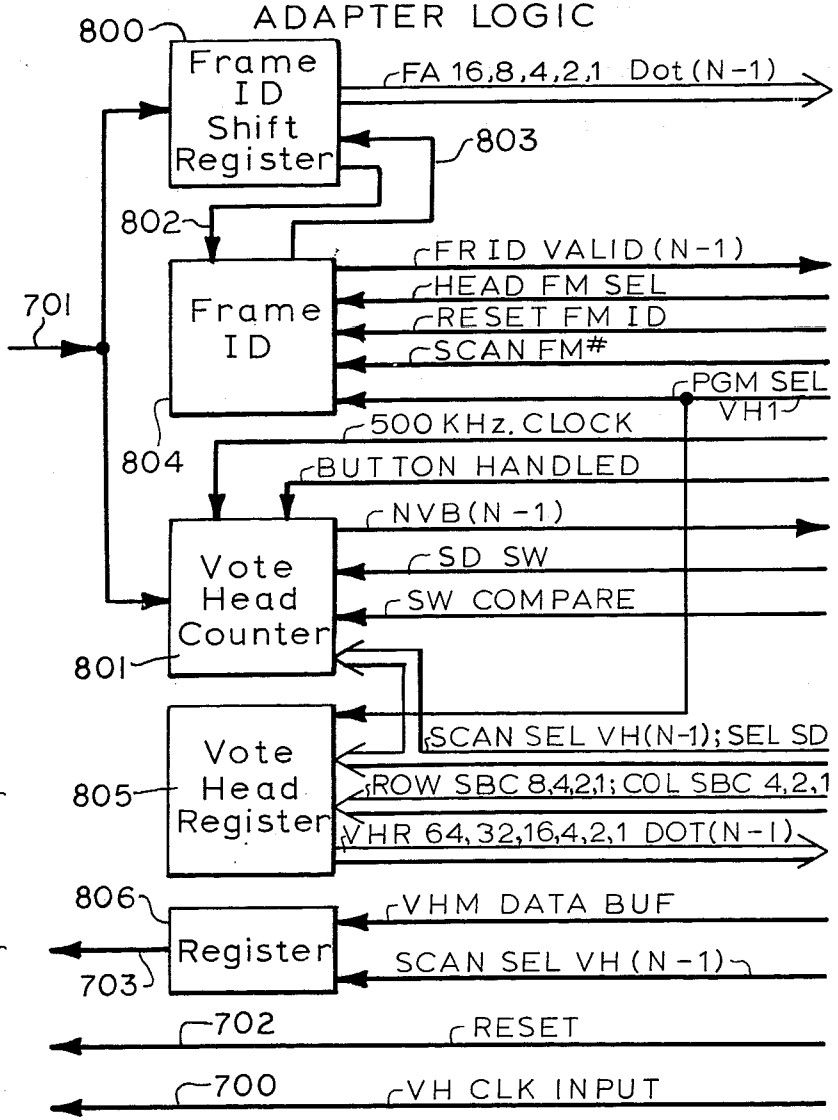
FIG. 11 is a data flow diagram for an adapter located in the data center but serving only one vote head.

FIG. 11 depicts one adapter with the logic flow shown between one specific vote head and the data center serving that vote head. The serial data-bits provided by the multiplexer stage 713 in the vote head are received in the adapter circuit over line 701, and applied to a frame identification shift register 800 and to a vote head counter circuit 801. The shift register state 800 is intercoupled over two separate conductor pairs 802, 803 with a frame identification stage 804. "Frame" generally refers to an individual portion of the film strip such as that identified as 675 on FIG. 9. The mnemonics and the digits shown on the conductors adjacent the shift register 800 and the frame identification stage 804 will be generally understood by those skilled in the art, and are set out in Table C abov. "FA" means "frame address" and the successive digits 16, 8, 4, 2 and 1 indicate there are 5 conductors for signifying these 5 different values in a binary notation system. N refers to one adapter, such as the eighth, and (N-1) refers to the previous adapter, the seventh in this example. The legends will also be identified sub-sequently in connection with FIGS. 12–14 showing the appropriate conductors and multiple-conductor runs in the data center which either receive the signals from the adapter shown in FIG. 11 or transmit the signals identified on the various conductors.

Figure 48A:
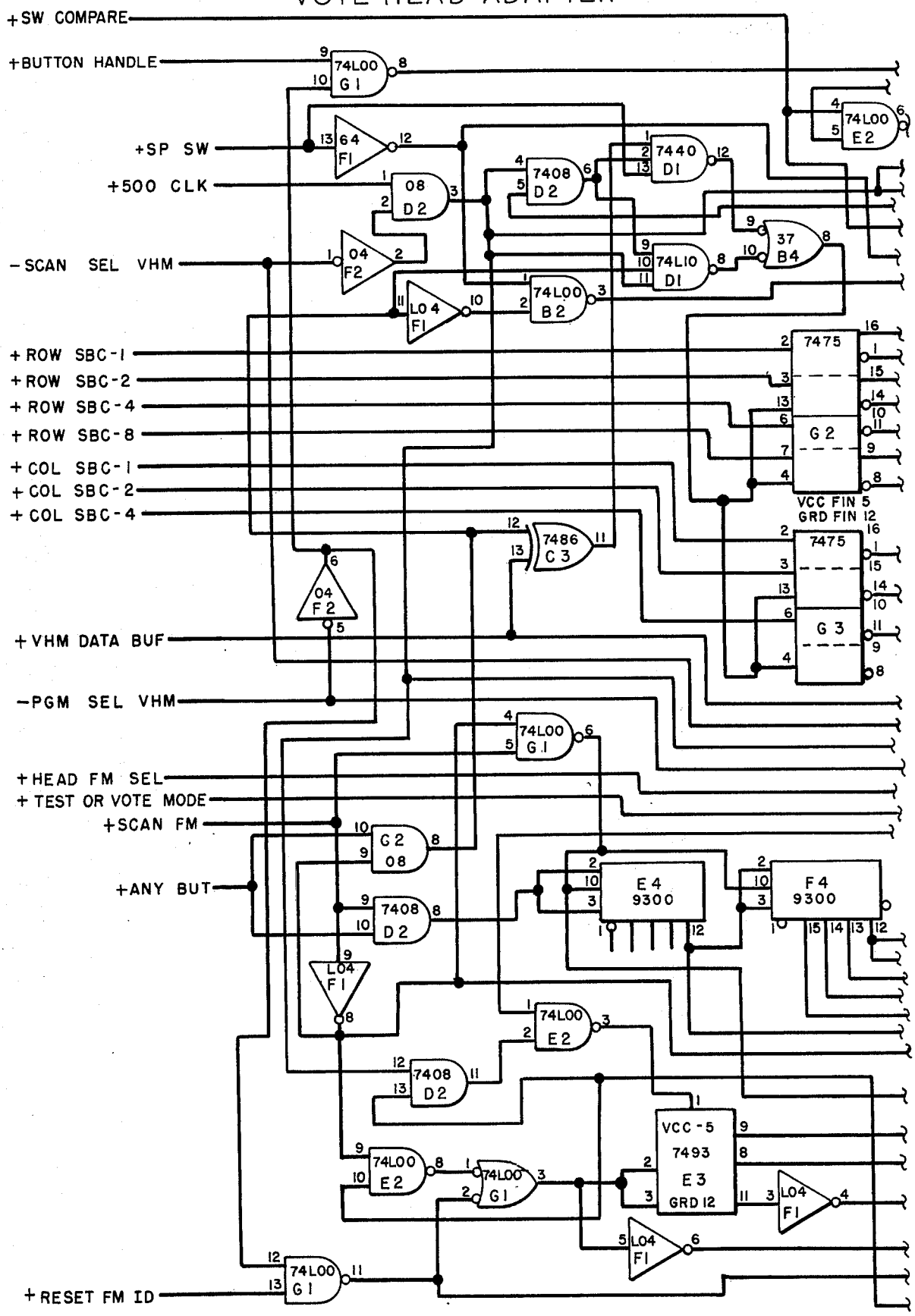
Figure 48B:
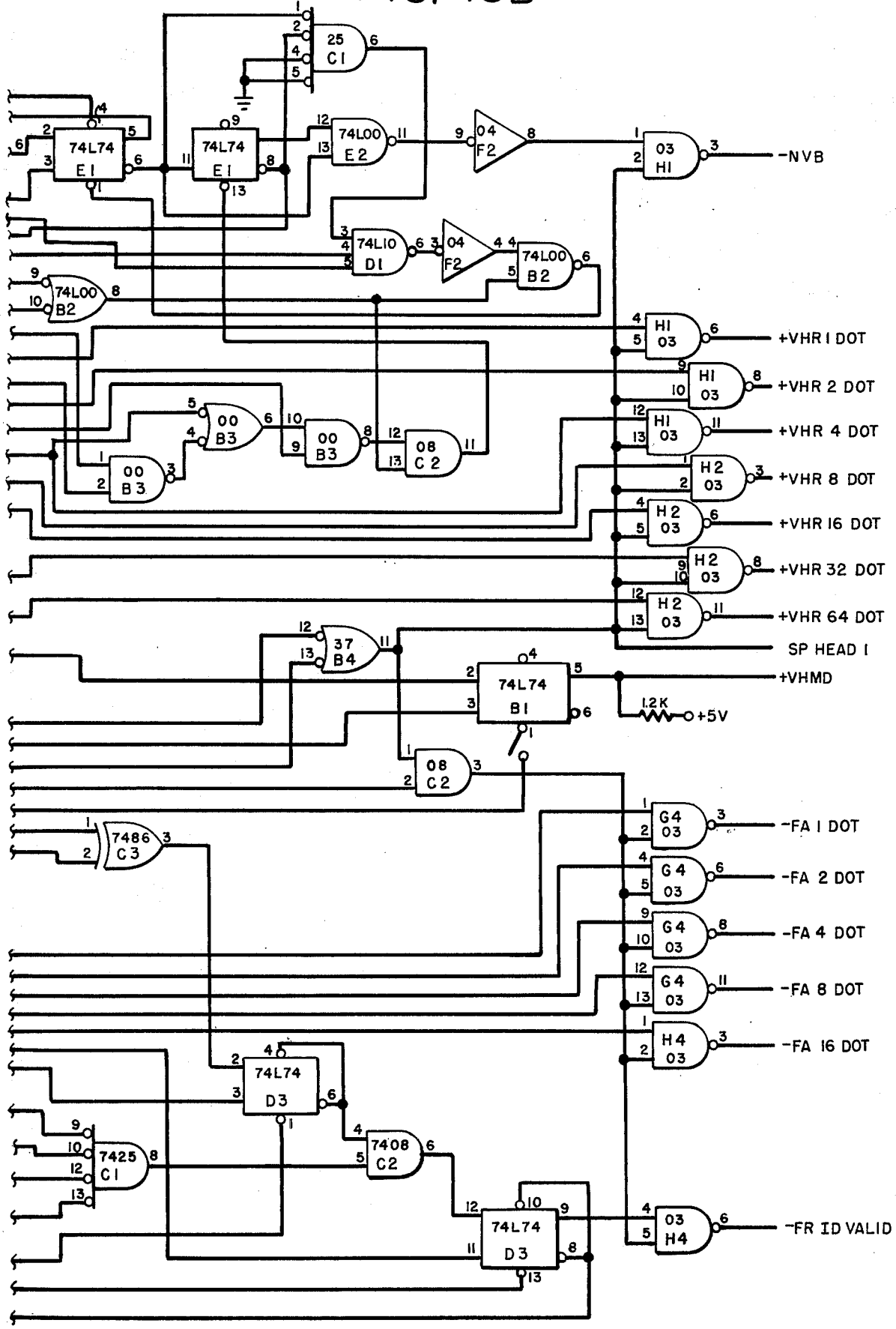
Figure 49:
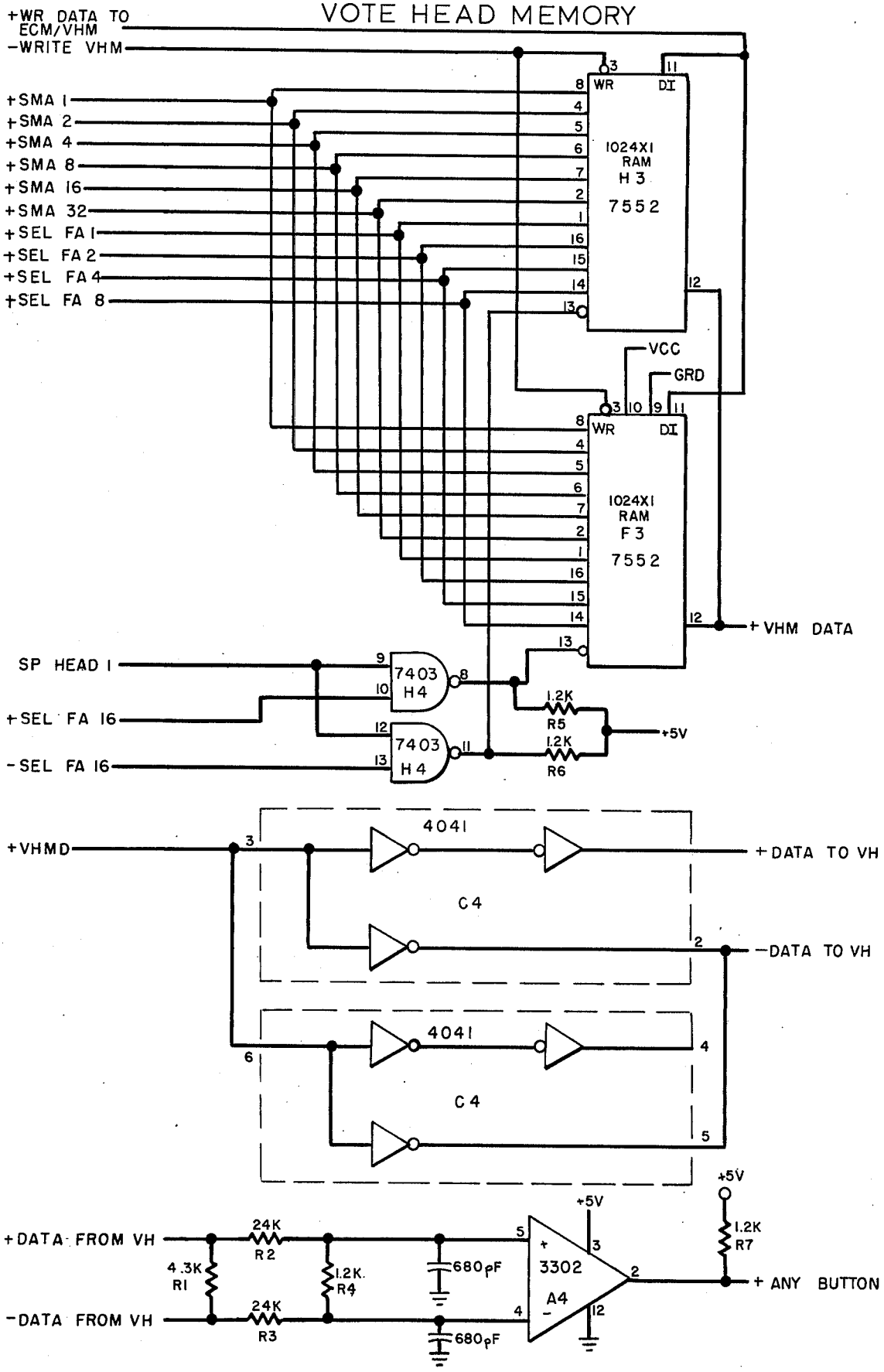

The vote head counter state 801 is a representation of an arrangement used as a "de-bounce" circuit for determining that a signal received on conductor 701 is in fact an indication that a selector button or other switch status has changed in the vote head, and that there is not a momentary transient noise or some other stray effect simulating the button actuation. When the circuit determines, in conjunction with logic and program circuits in the data center, that a button has in fact been depressed and that it is a new valid button, this signal is transmitted on the line indicated with the legend "NVB (N-1)". The legend "PGM SEL VH1" refers to the "program selector", vote head 1". "VH1" is used to indicate that although the program in the data center is generating signals for as many as eight different vote heads, that signal indicated with this legend VH1 is transmitted only to the adapter for that first vote head. The vote head register can be considered a "button" register for continually indicating the button or switch actuated in the vote head. The lowermost register 806 combines the signals from the vote head memory data buffer and the scan selector, providing an output signal on line 703 for application to the gate circuit 727 in the vote head. The other conductors 700 and 702 are shown to indicate that there is an electrical connection through the adapter circuit from the data center to the vote head, for these particular lines. The other specific connections and the legends will not be desribed in FIG. 11, as they will become apparent from the subsequent explanation of the logic arrangement and data flow in the data center itself. Schematic details of the adapter are shown in FIGS. 48A and 48B.

Figure 12:
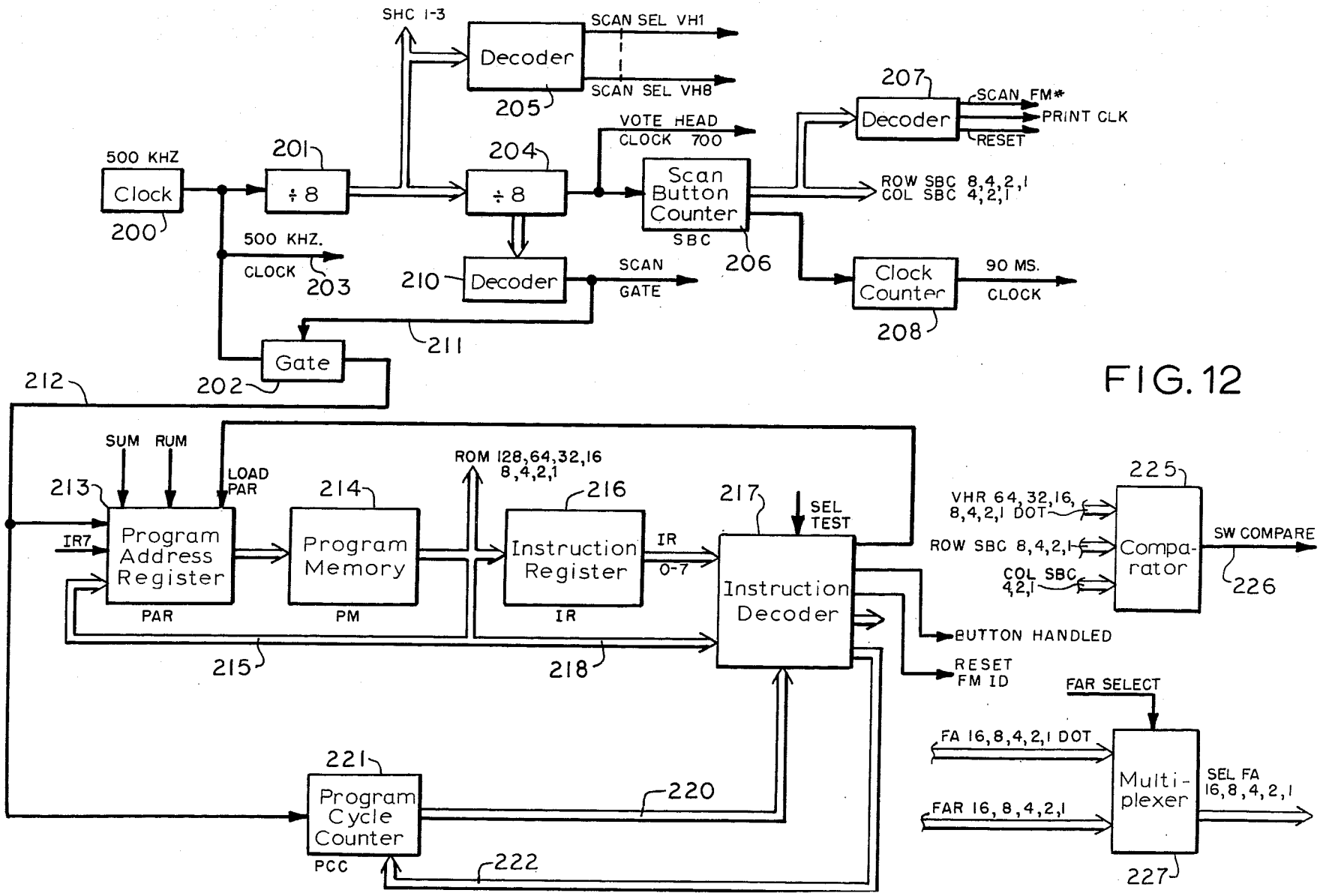
Figure 13:
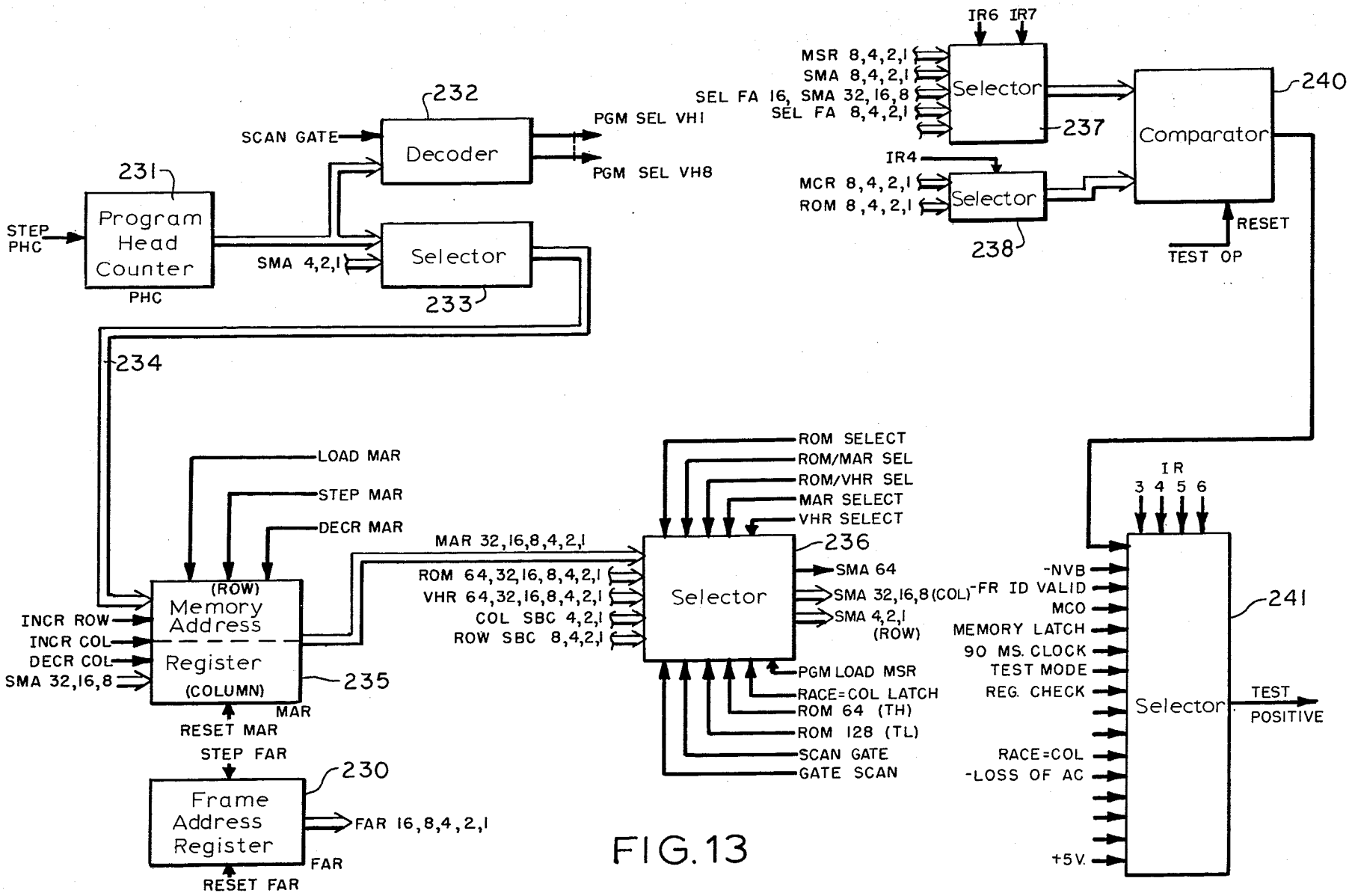
Figure 21:
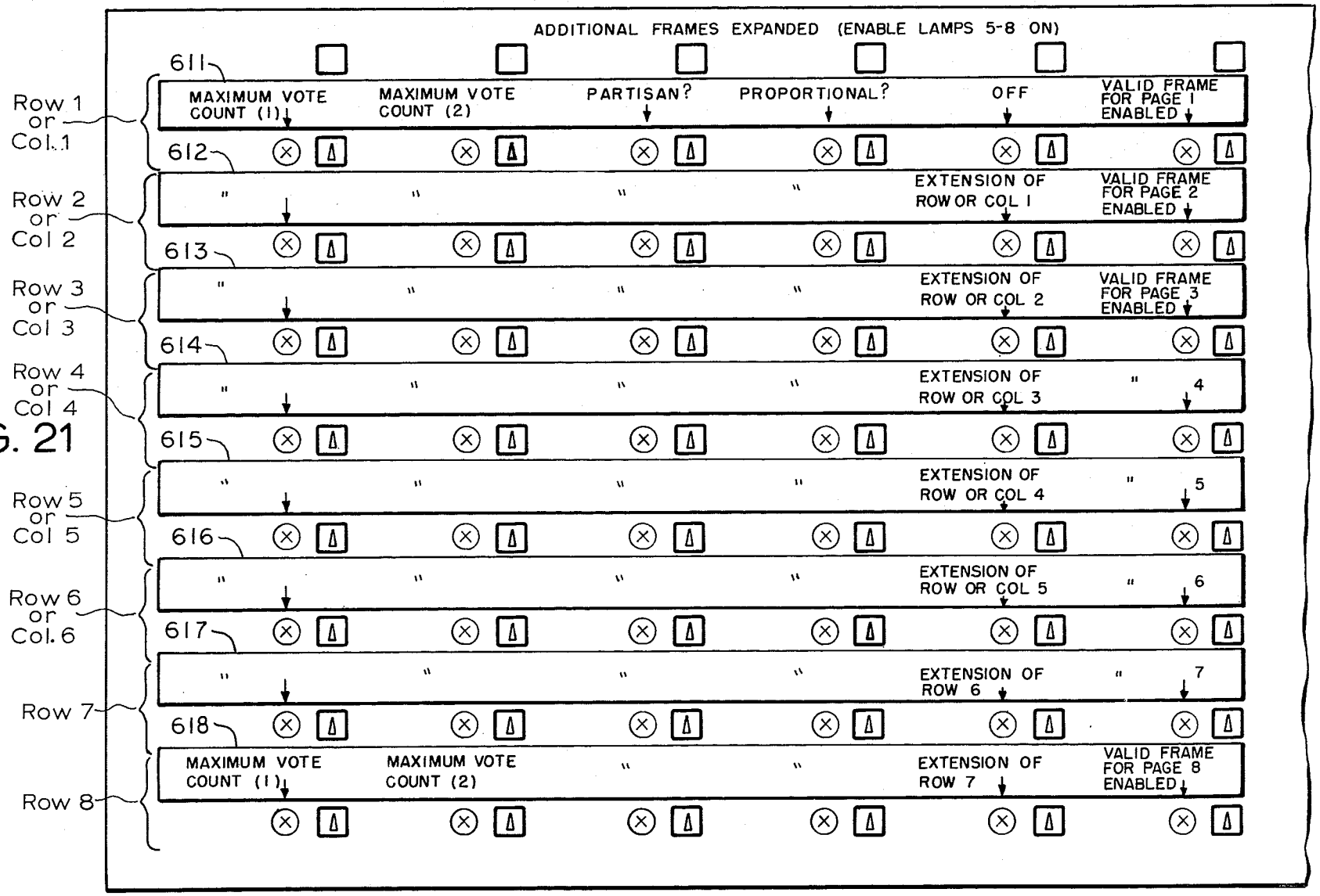
Figure 22A:
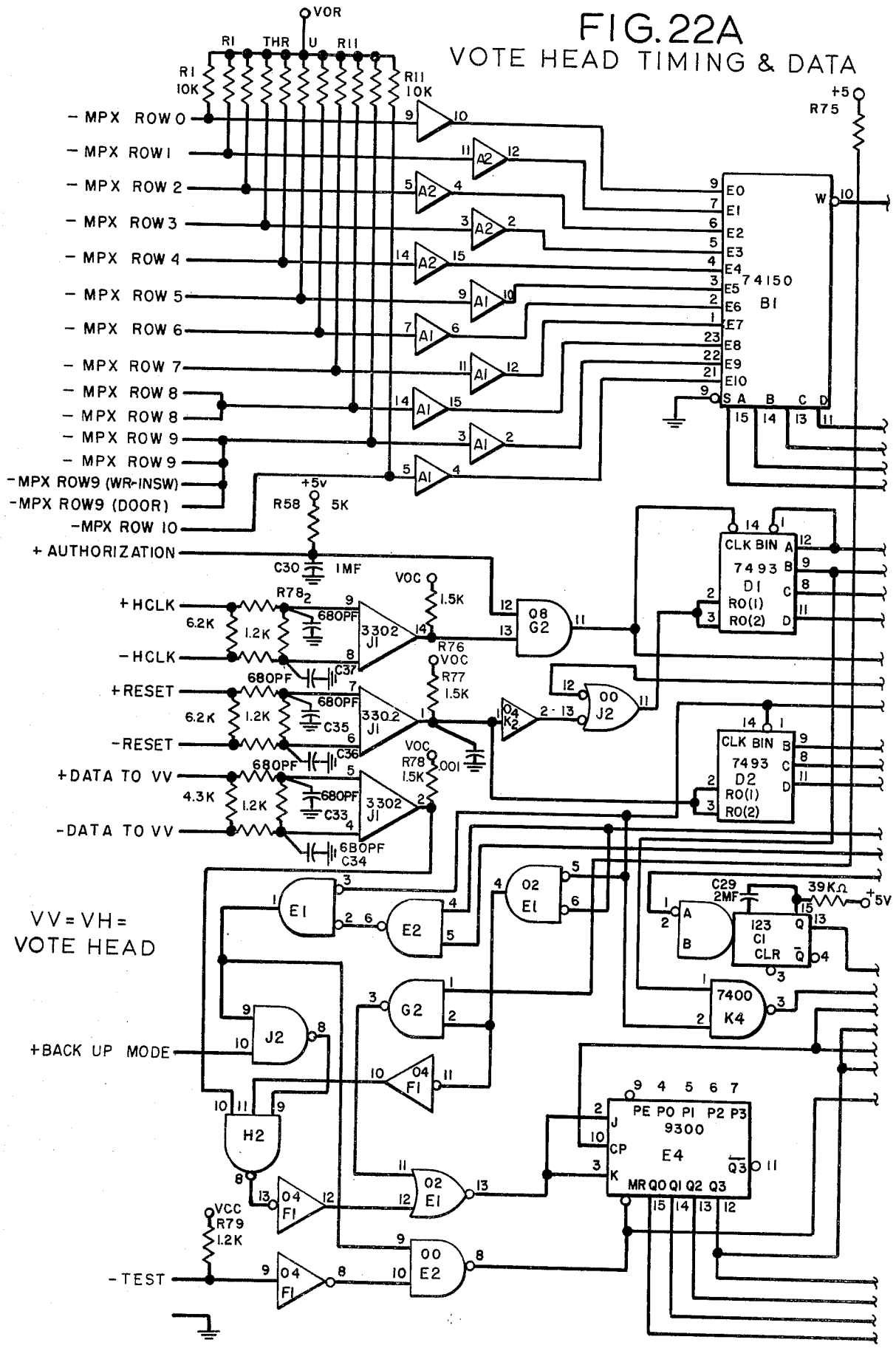
Figure 23:
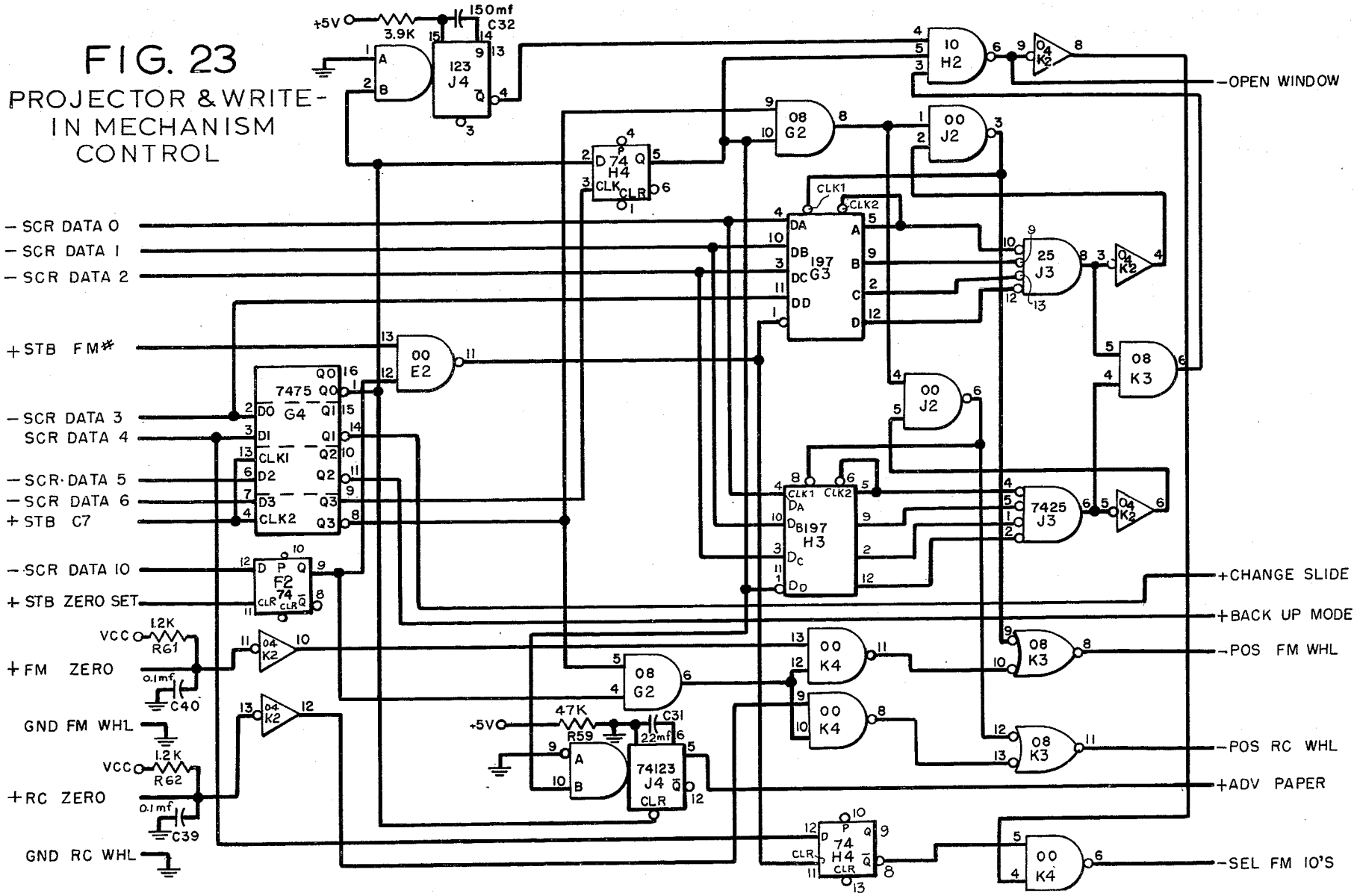
Figure 24:
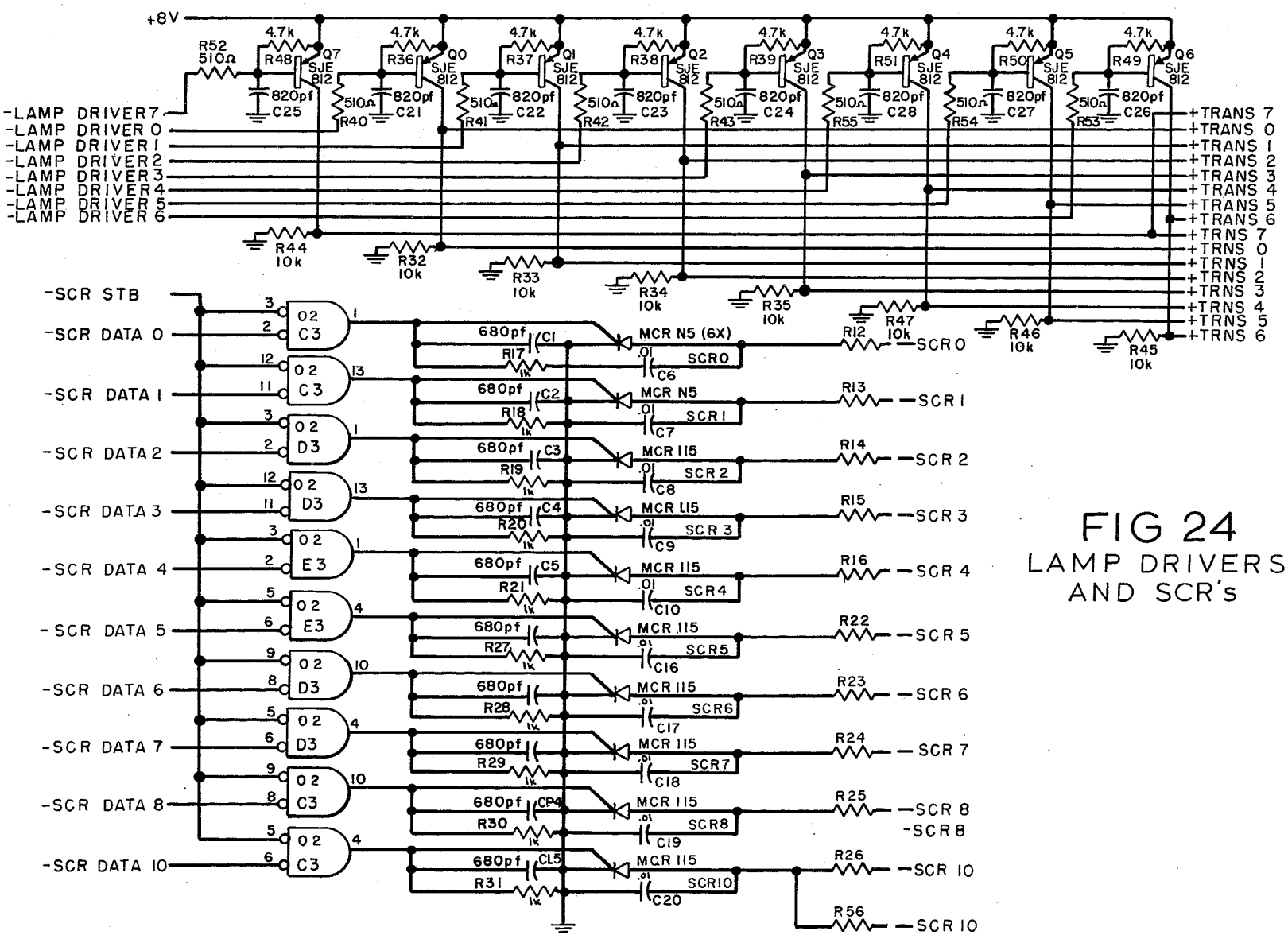
Figure 27A:
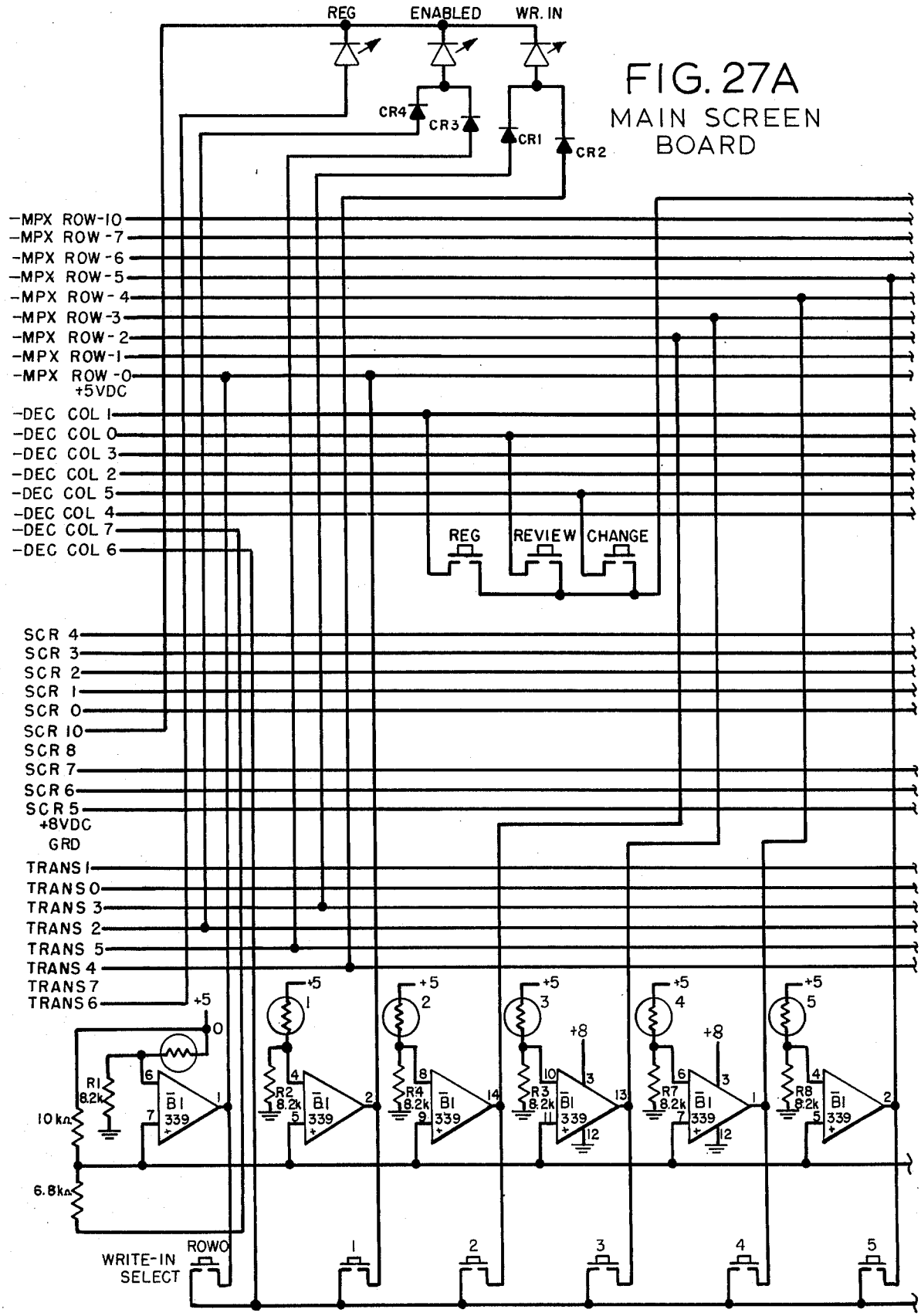
Figure 27B:
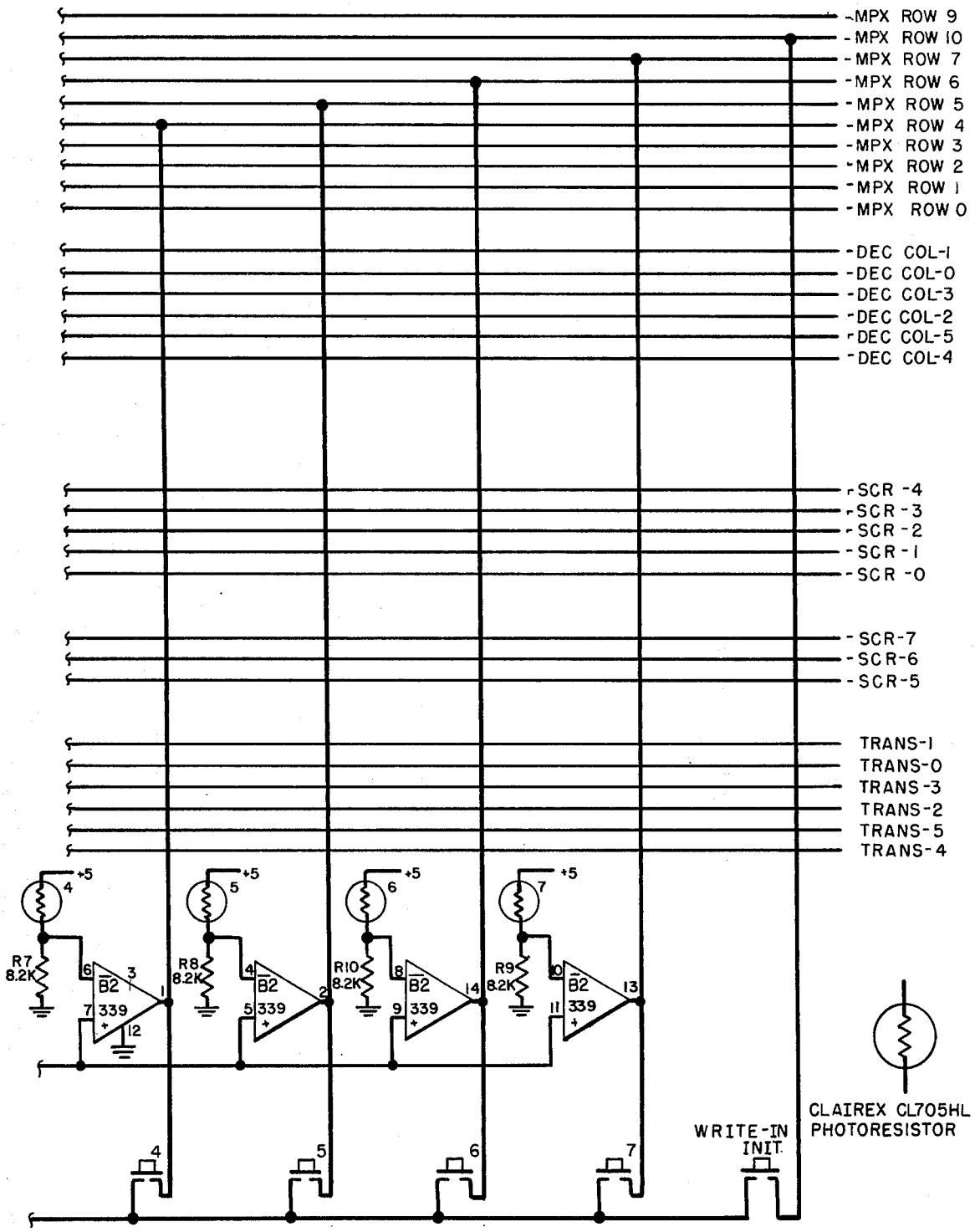
Figure 28:
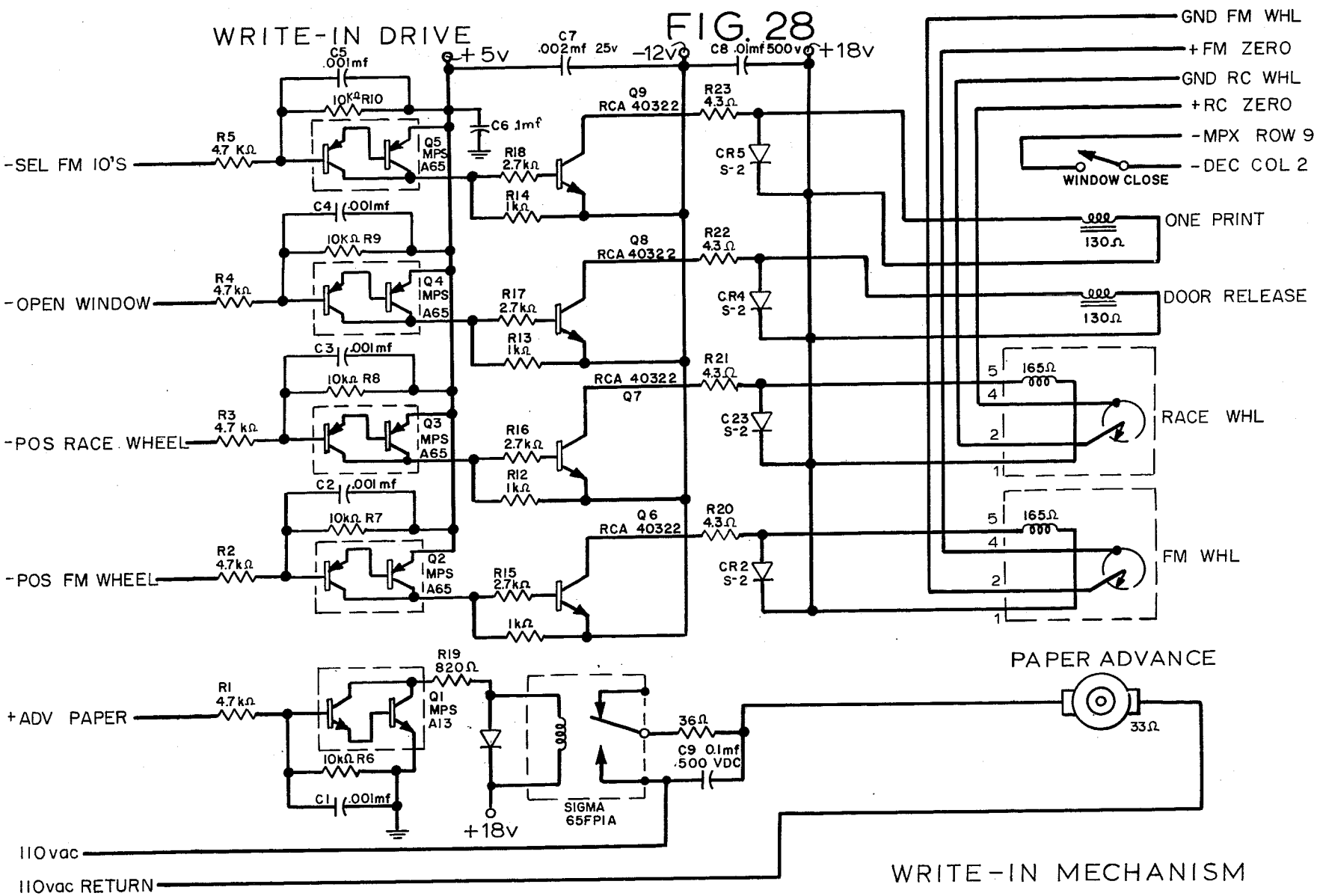
Figure 29:
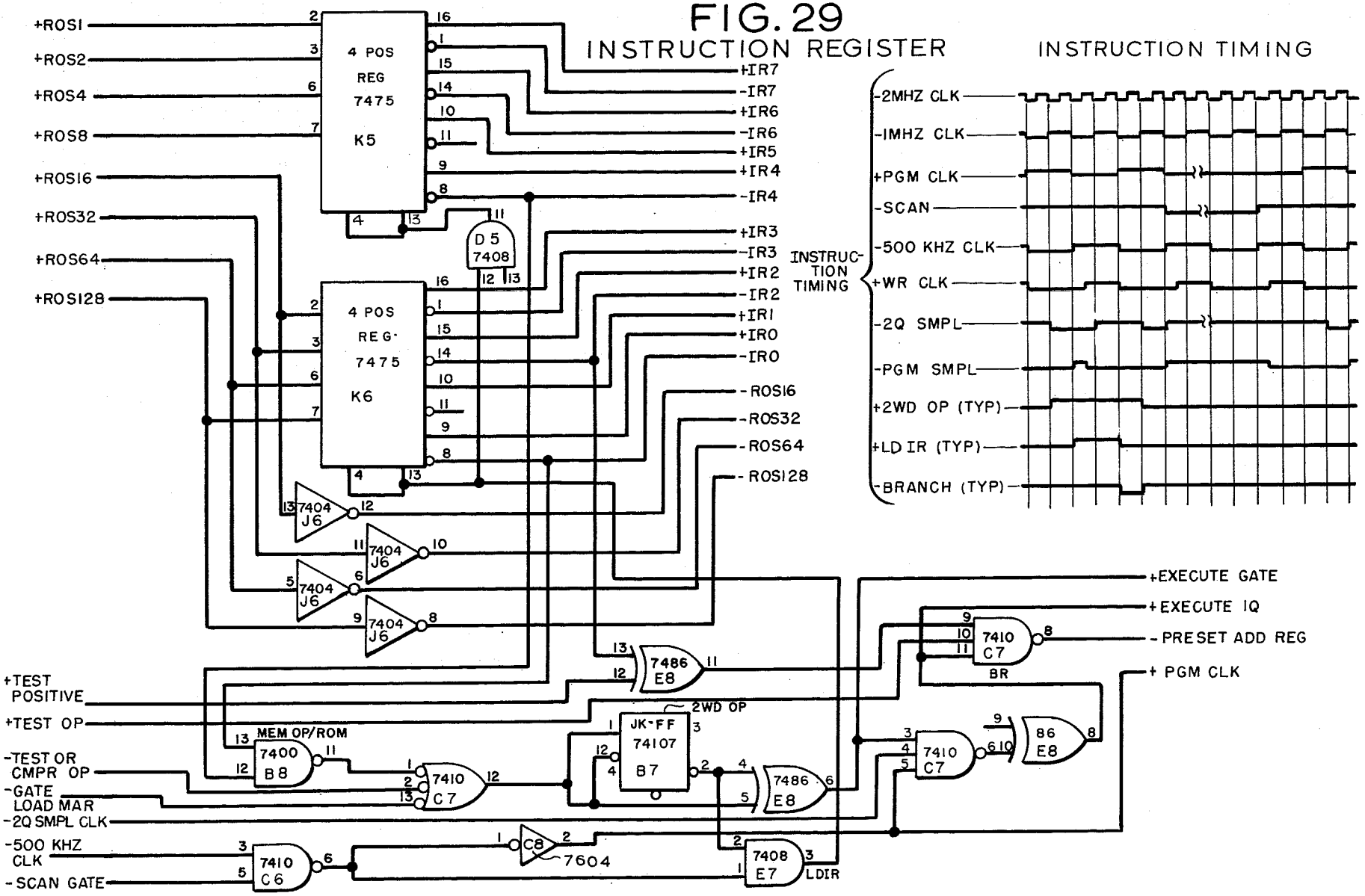
Figure 30A:
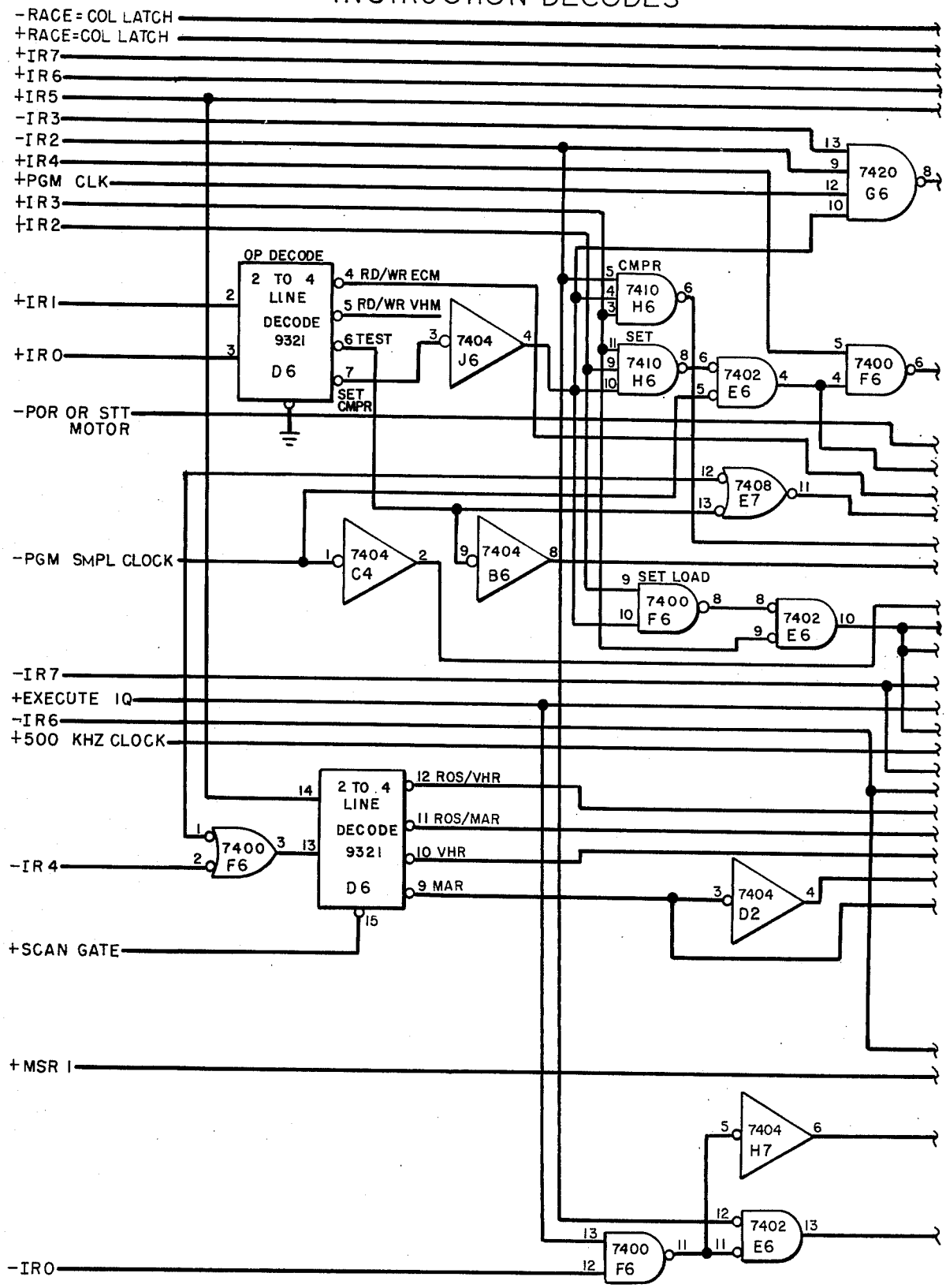
Figure 30B:
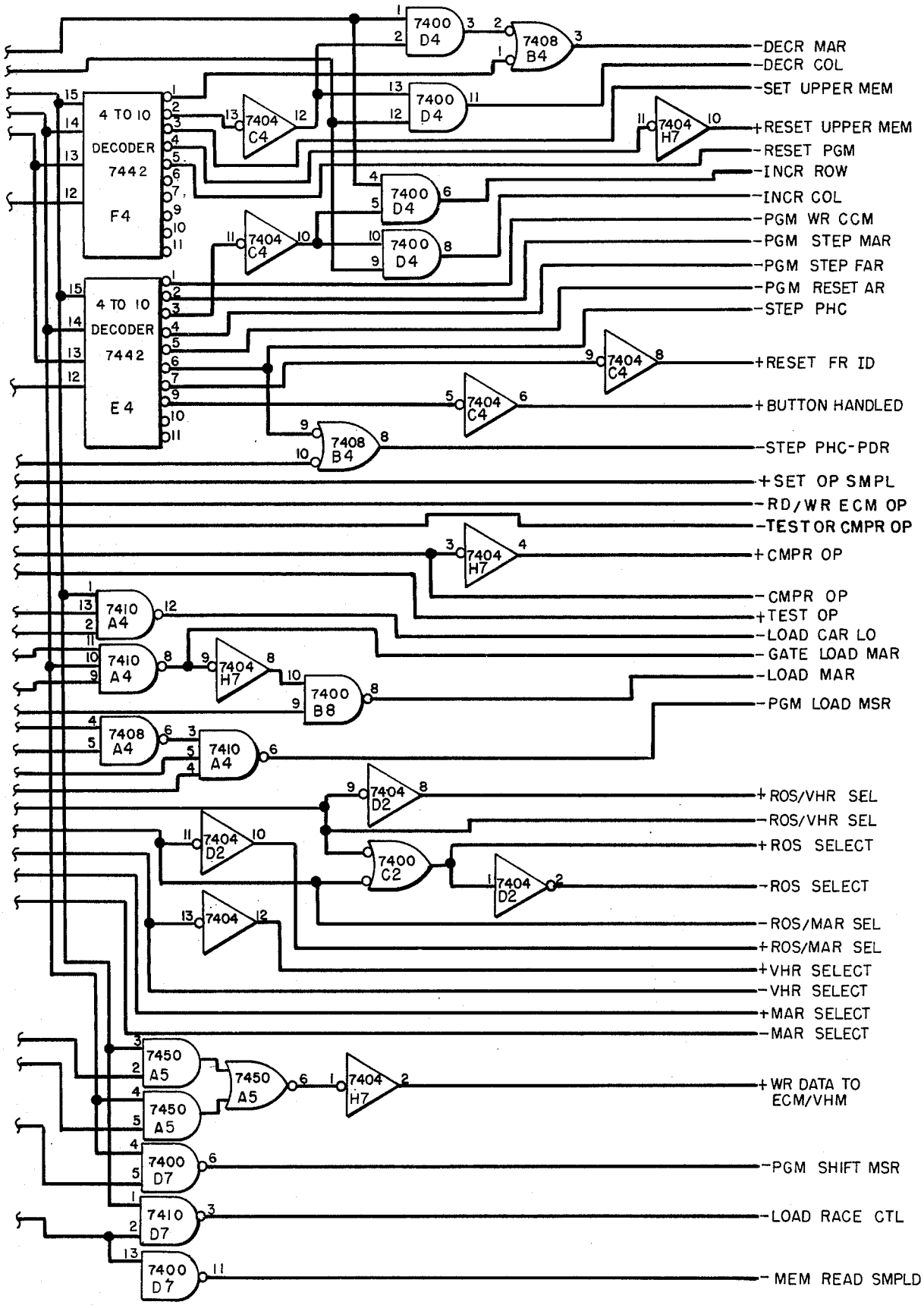
Figure 31:
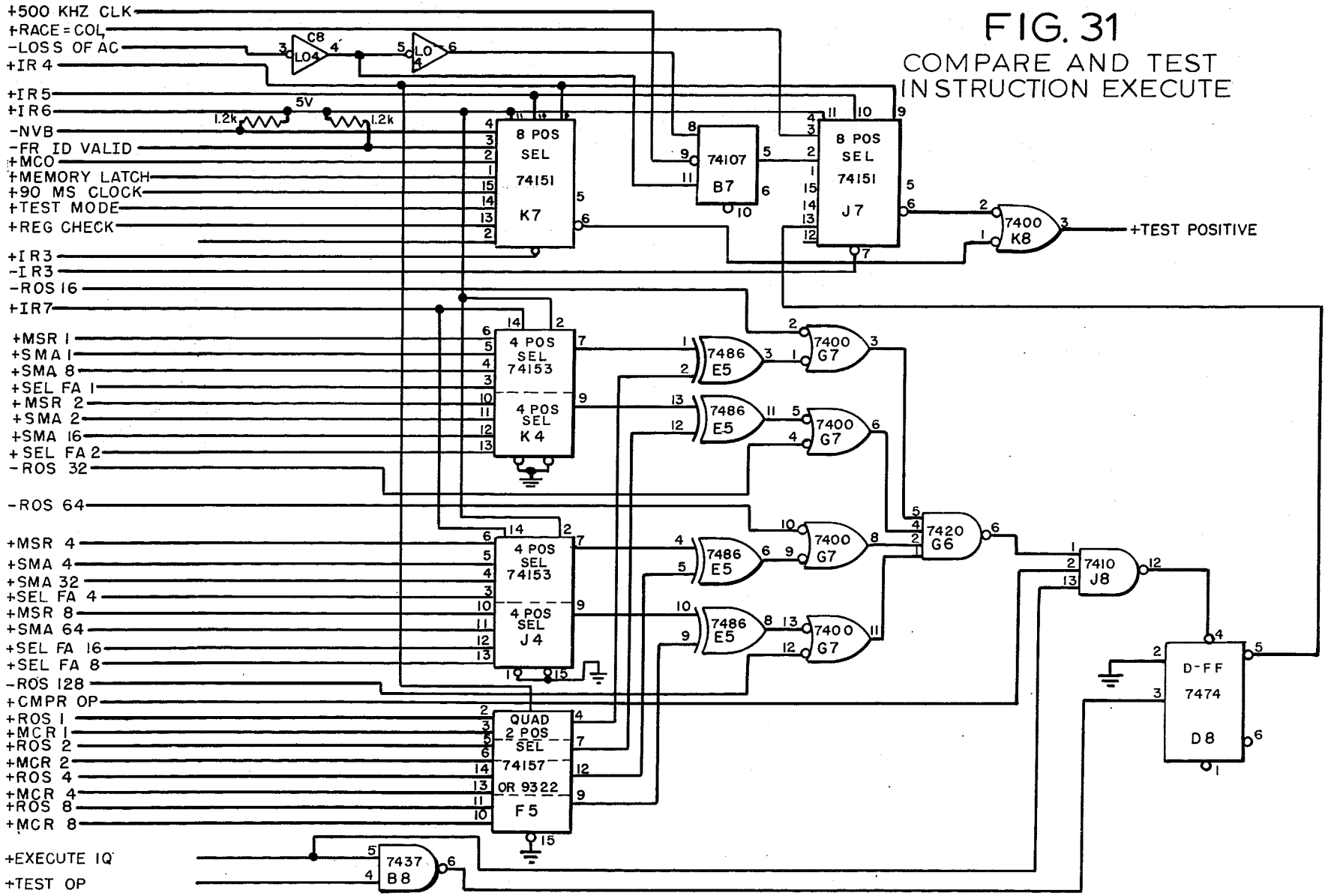
Figure 32B:
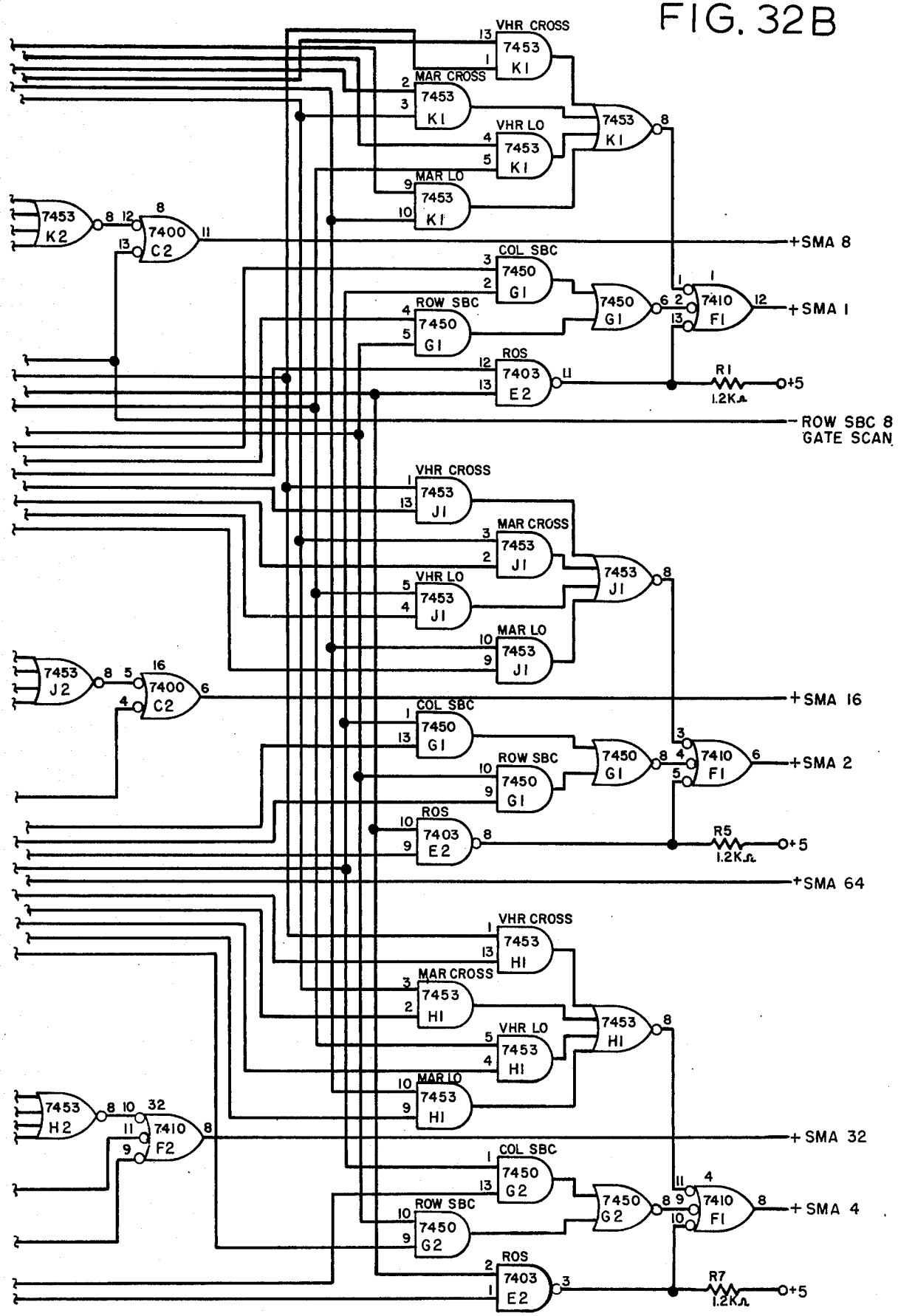
Figure 33B:
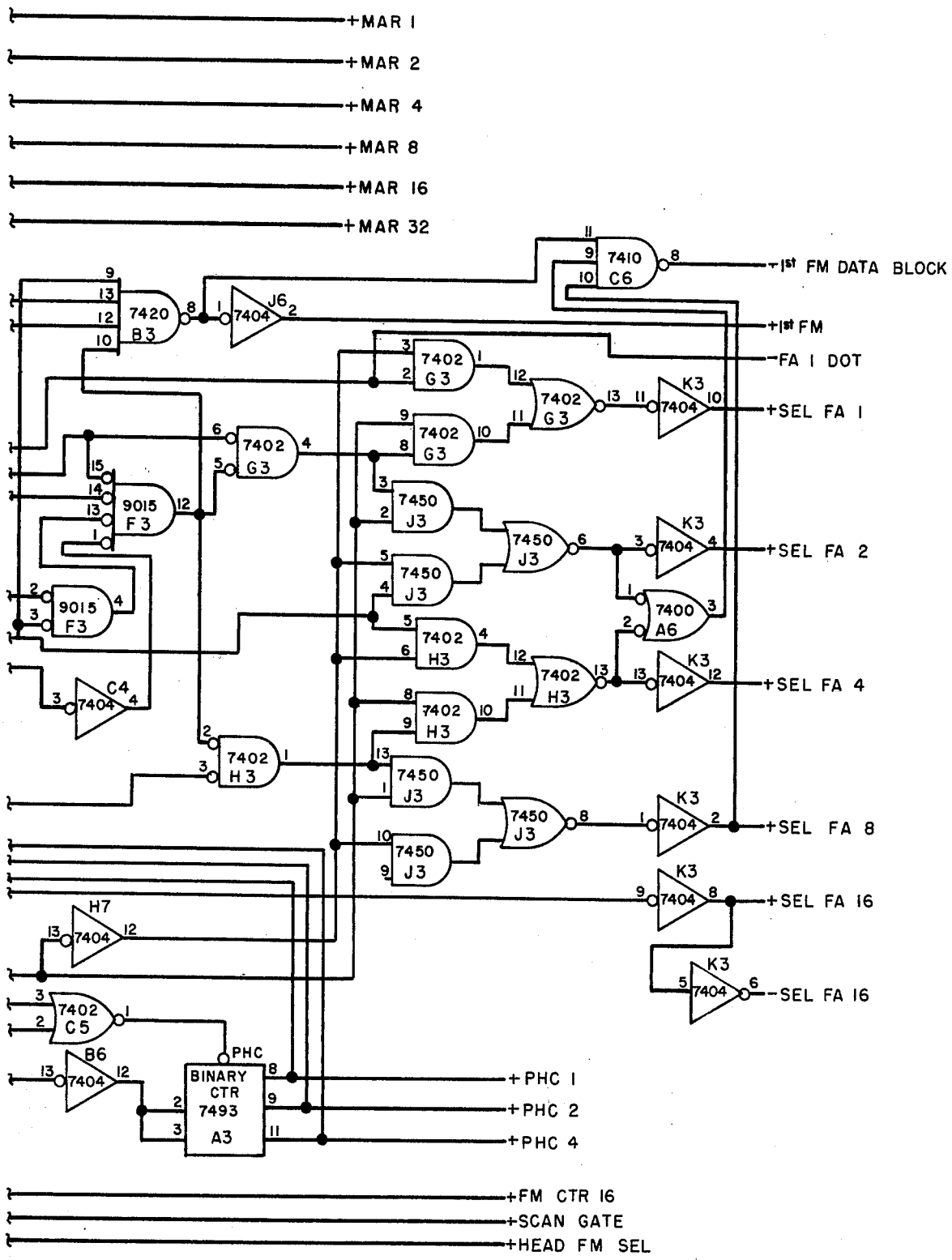
Figure 34B:
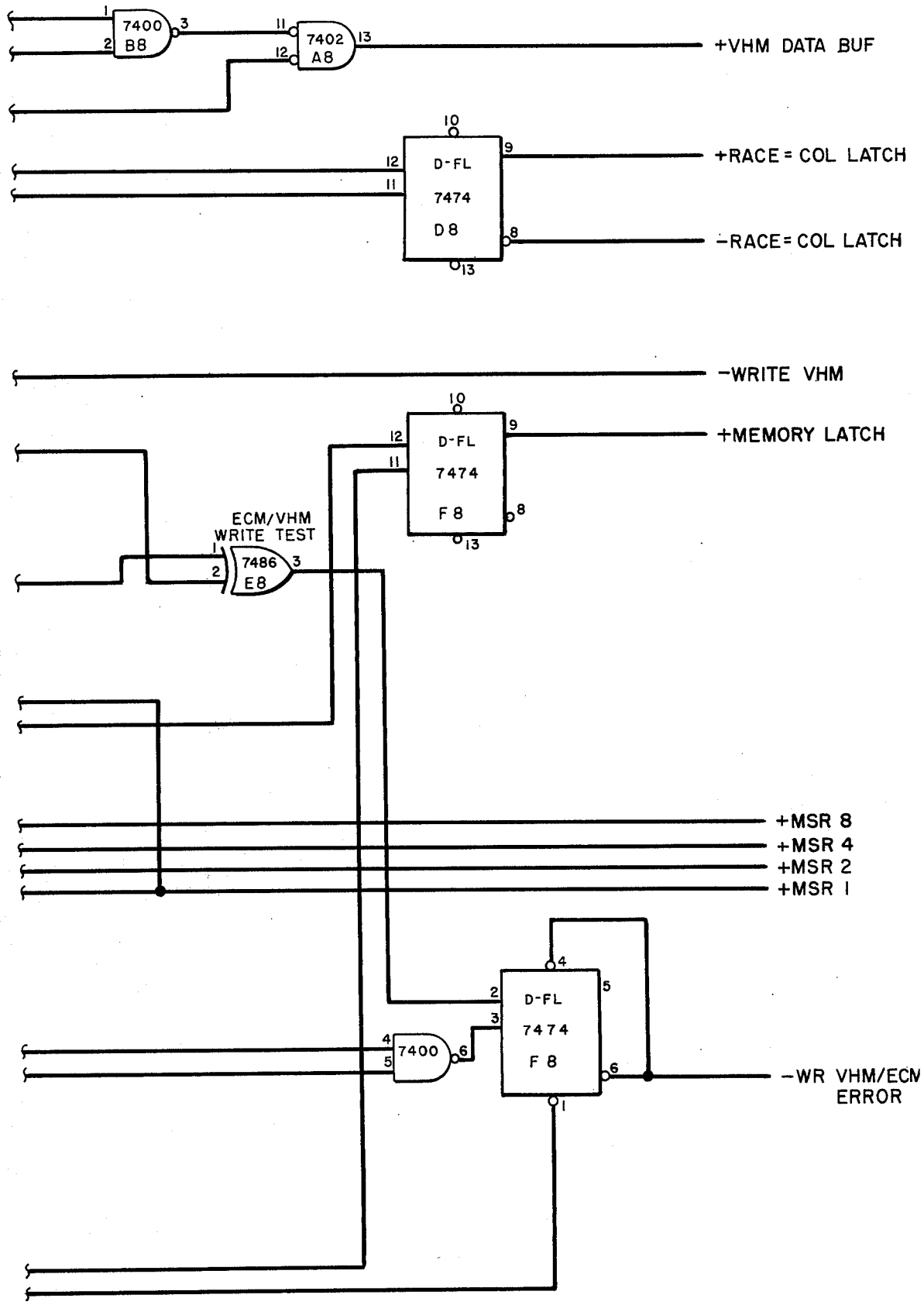
Figure 35A:
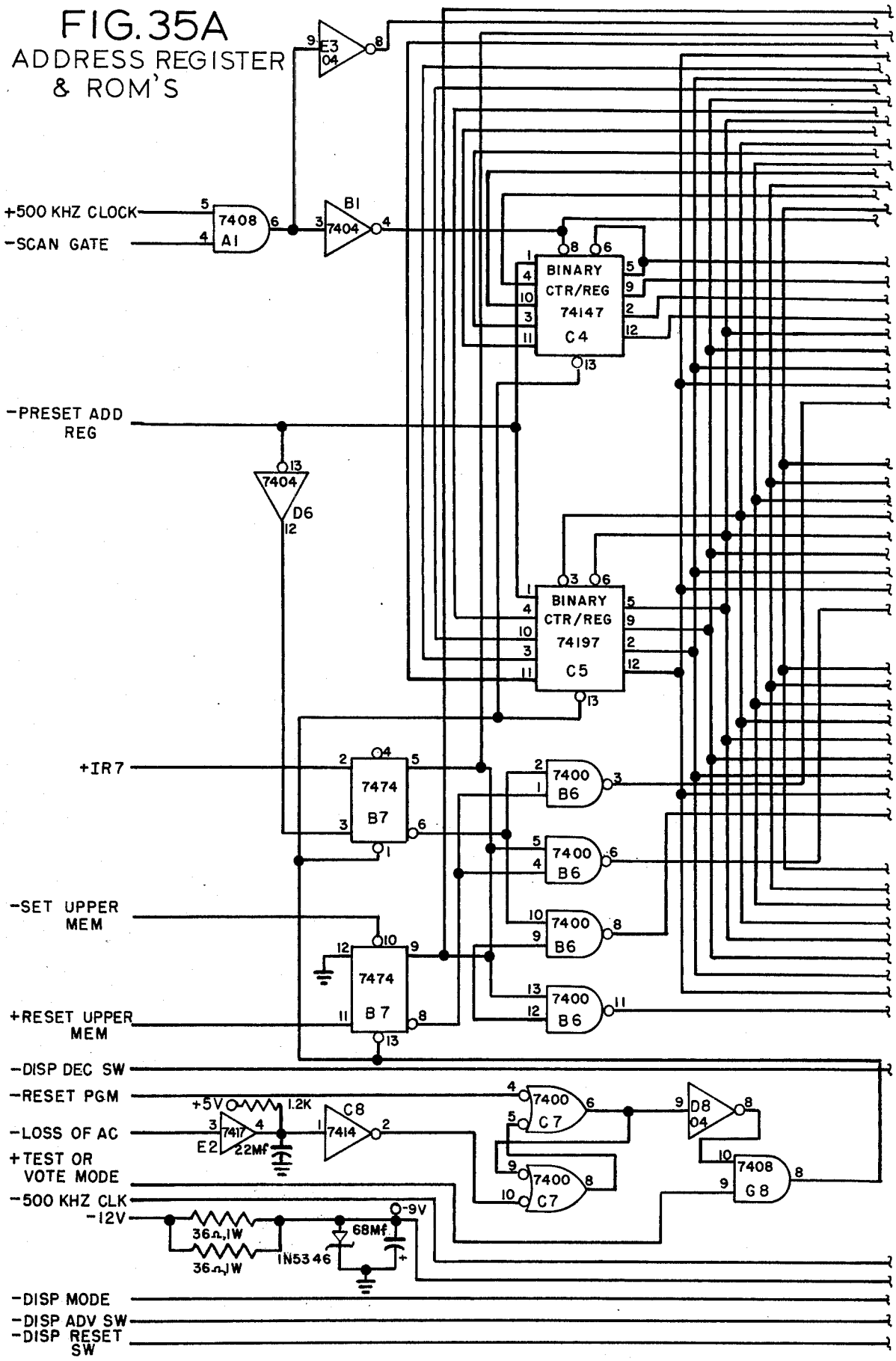
Figure 35B:
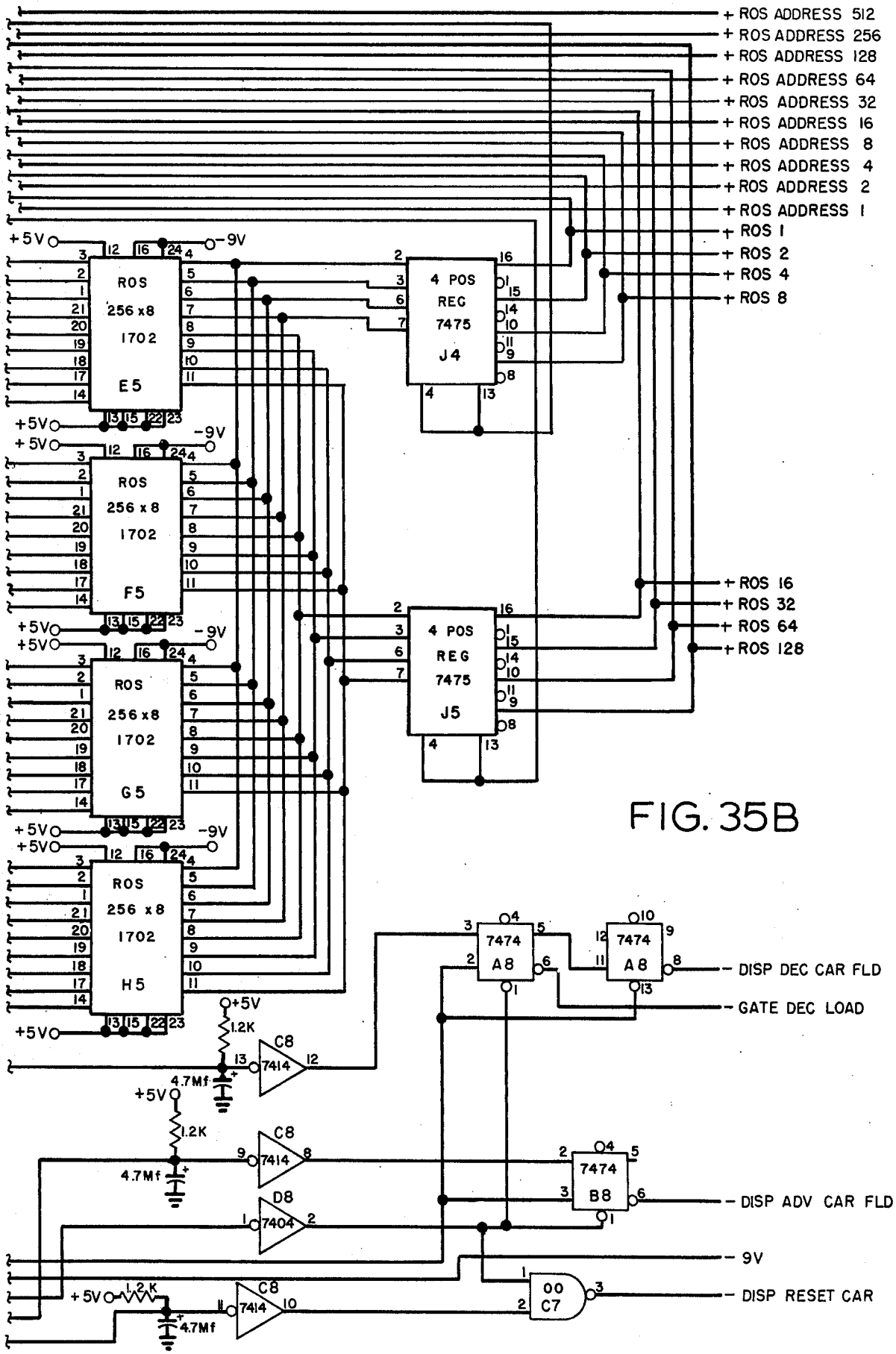
Figure 36A:
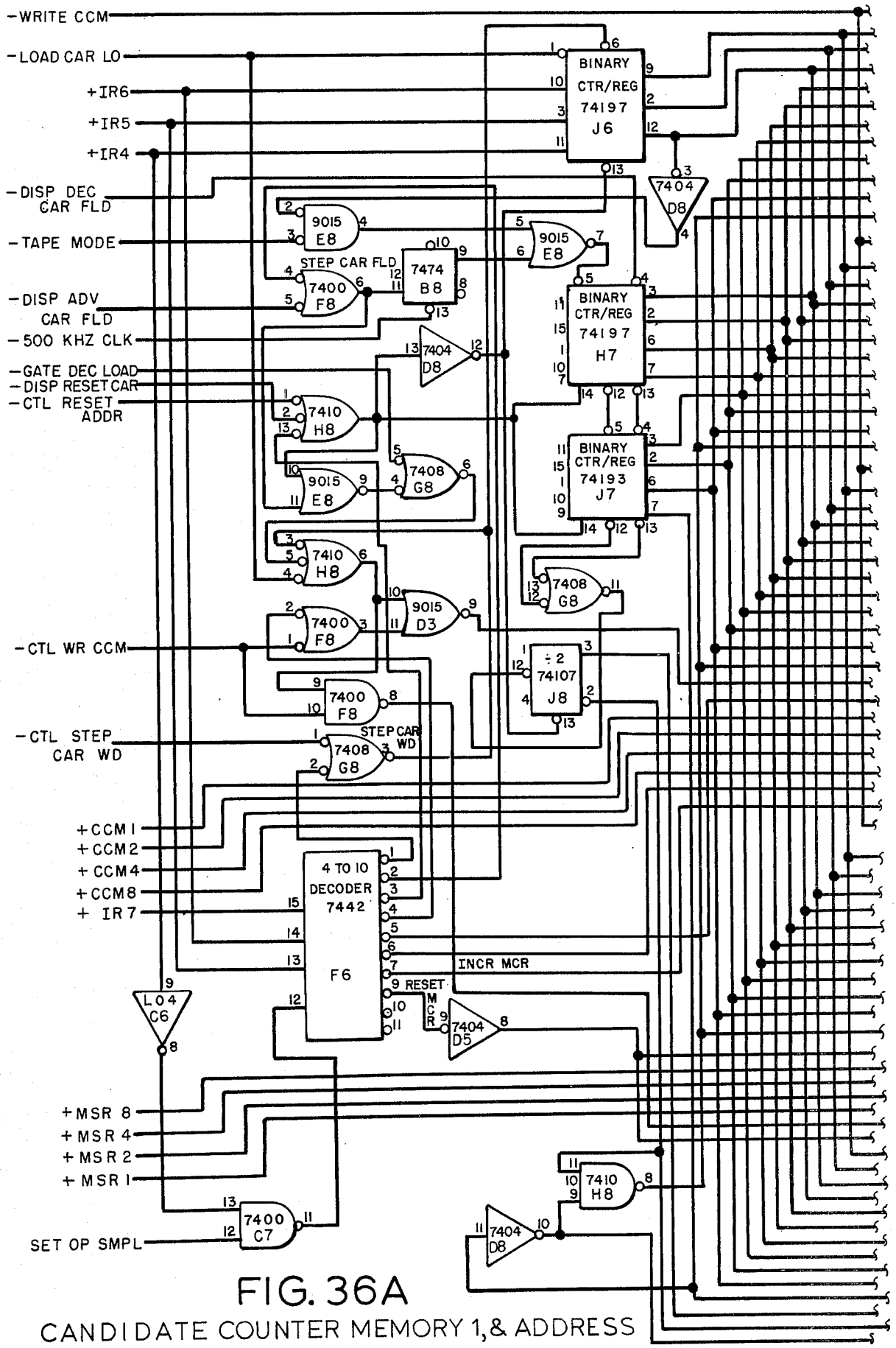
Figure 36B:
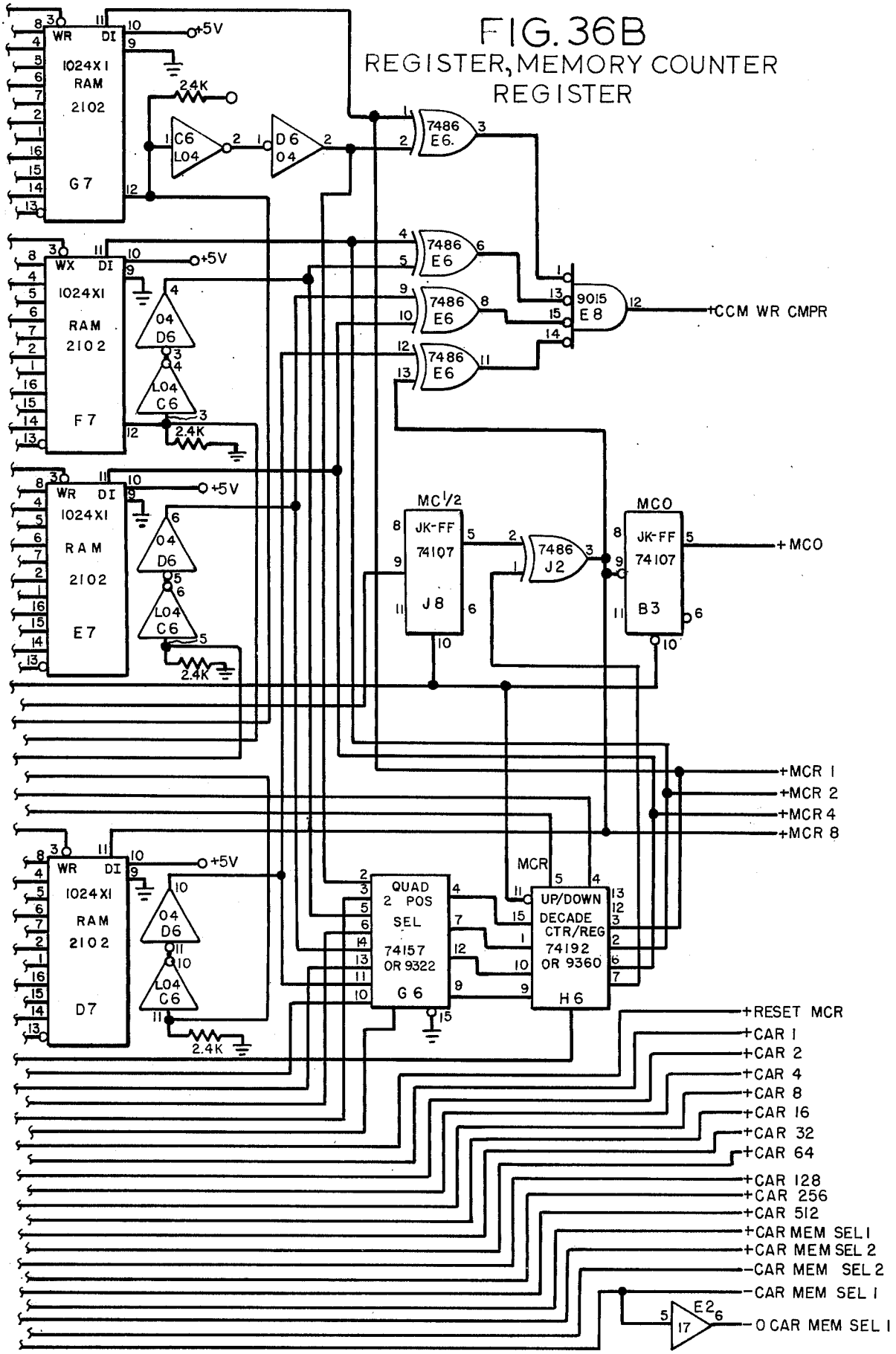
Figure 37:
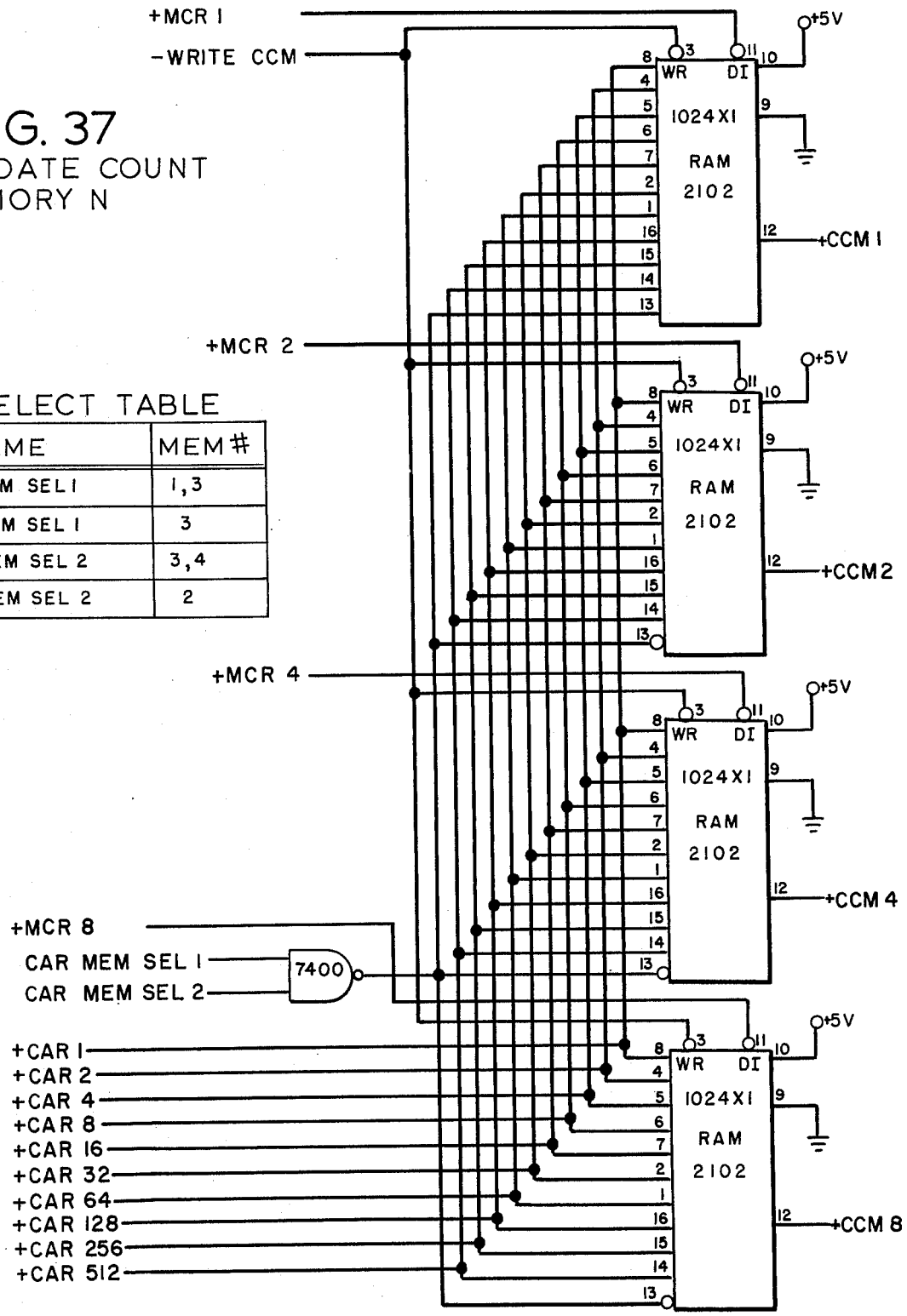
Figure 38A:
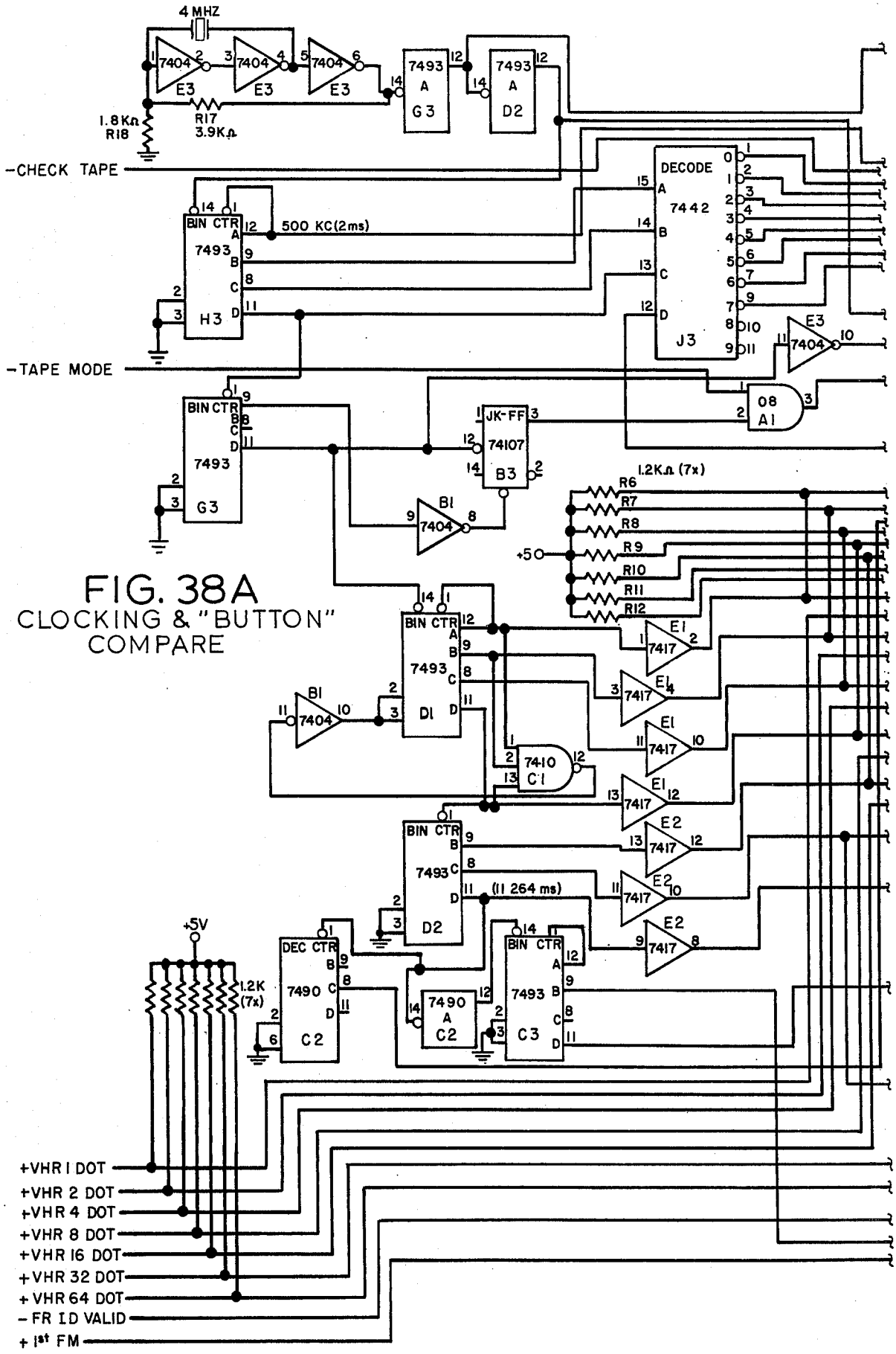
Figure 38B:
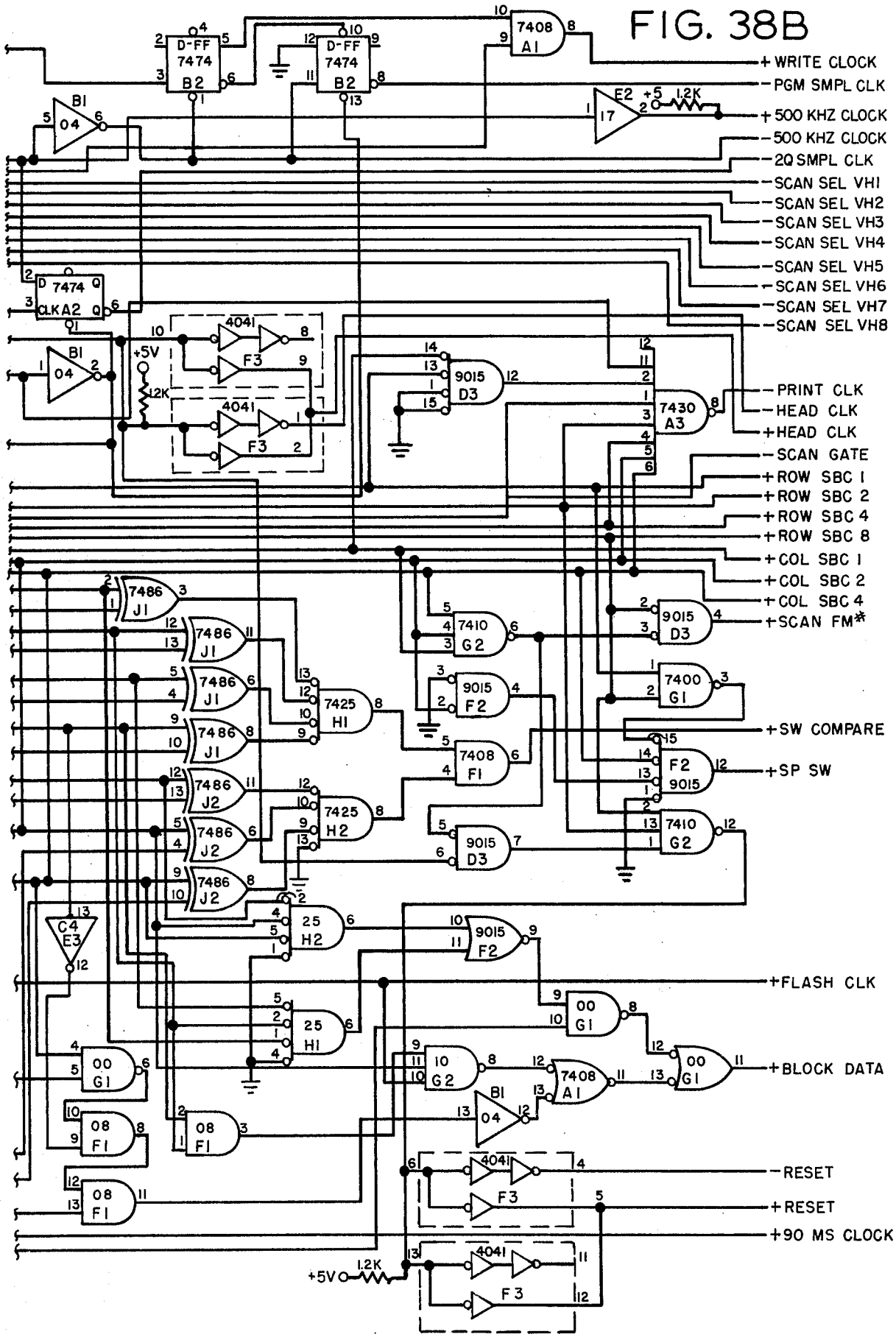
Figure 40:
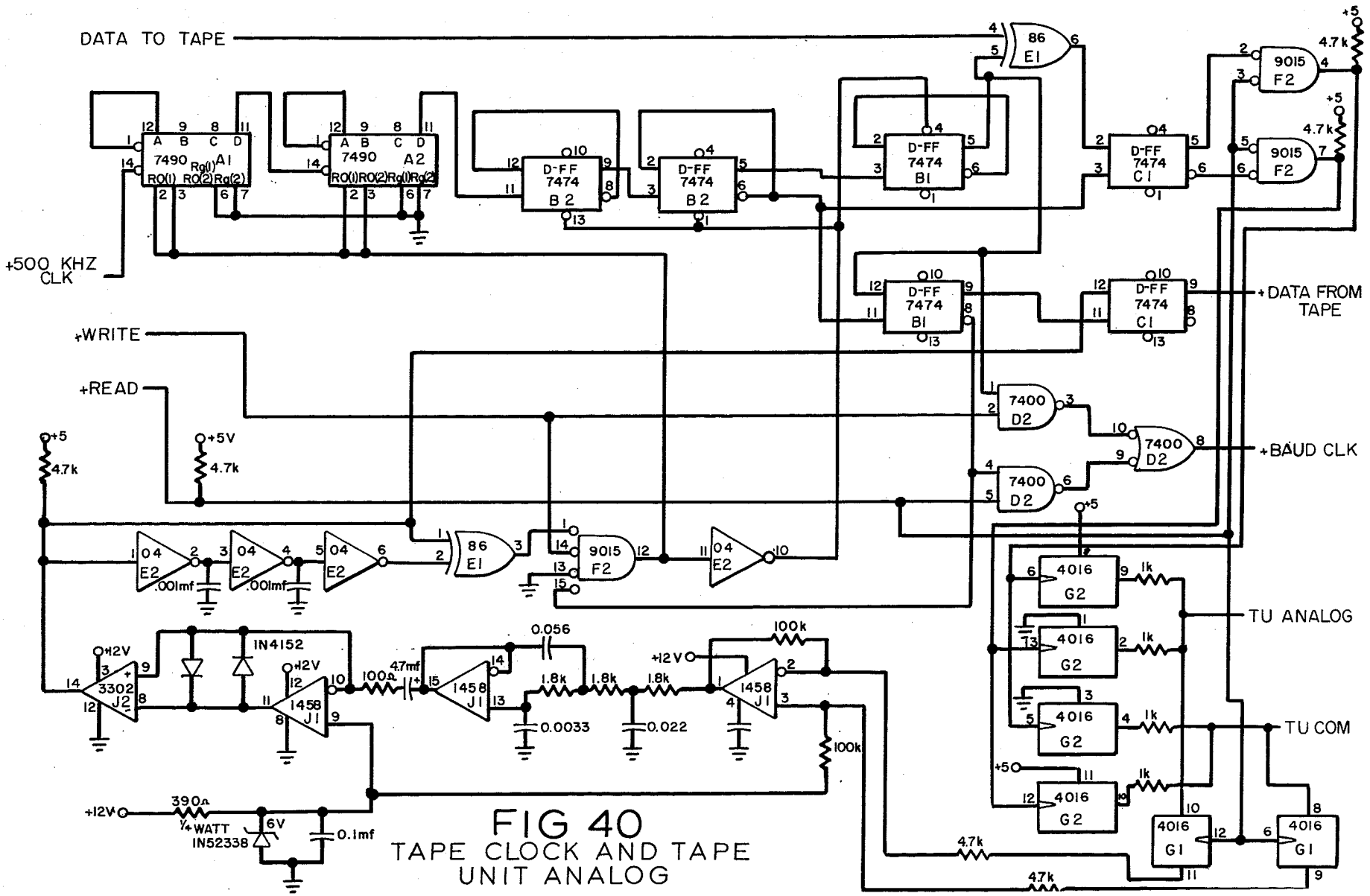
Figure 41A:
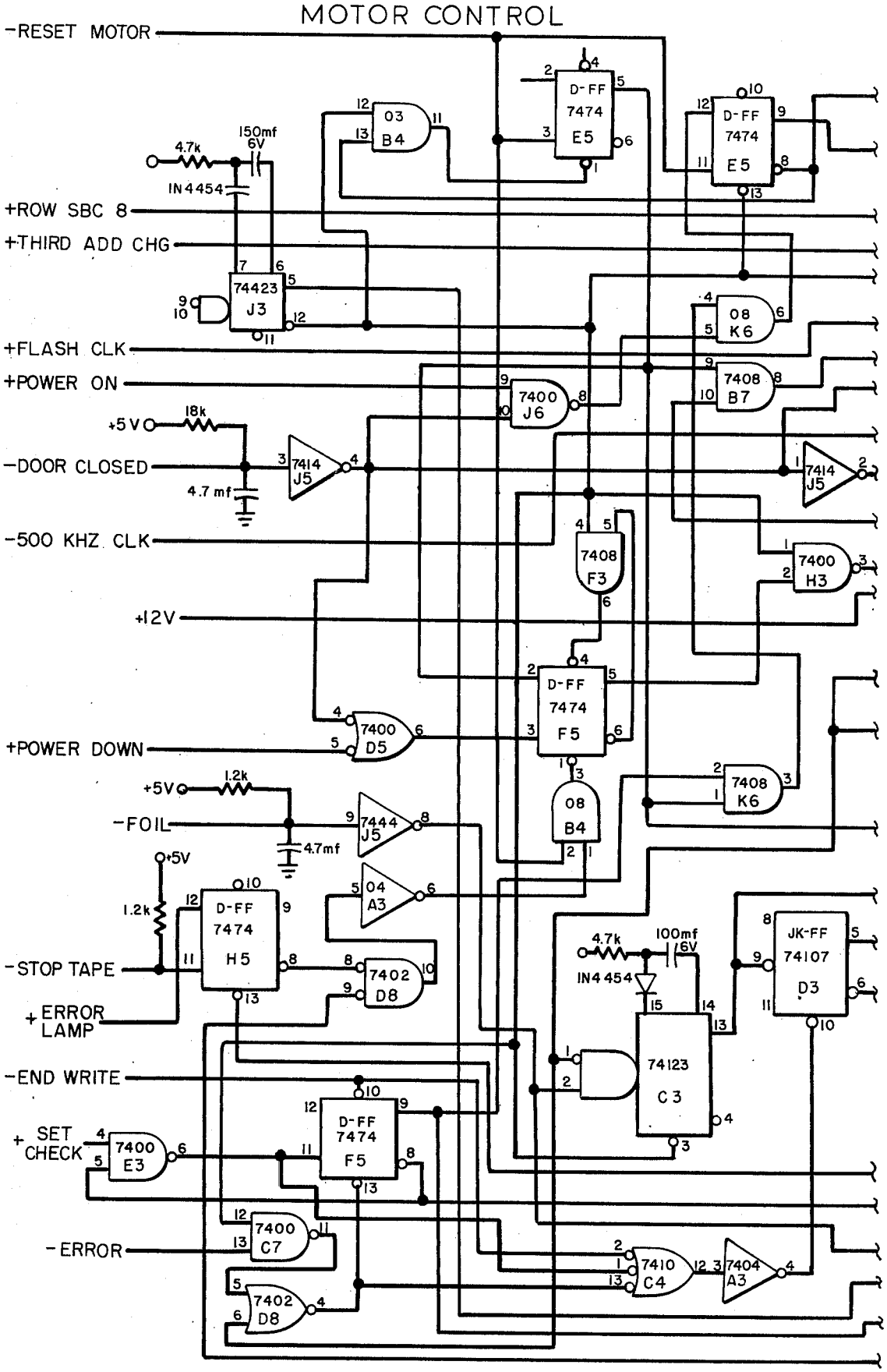
Figure 41B:
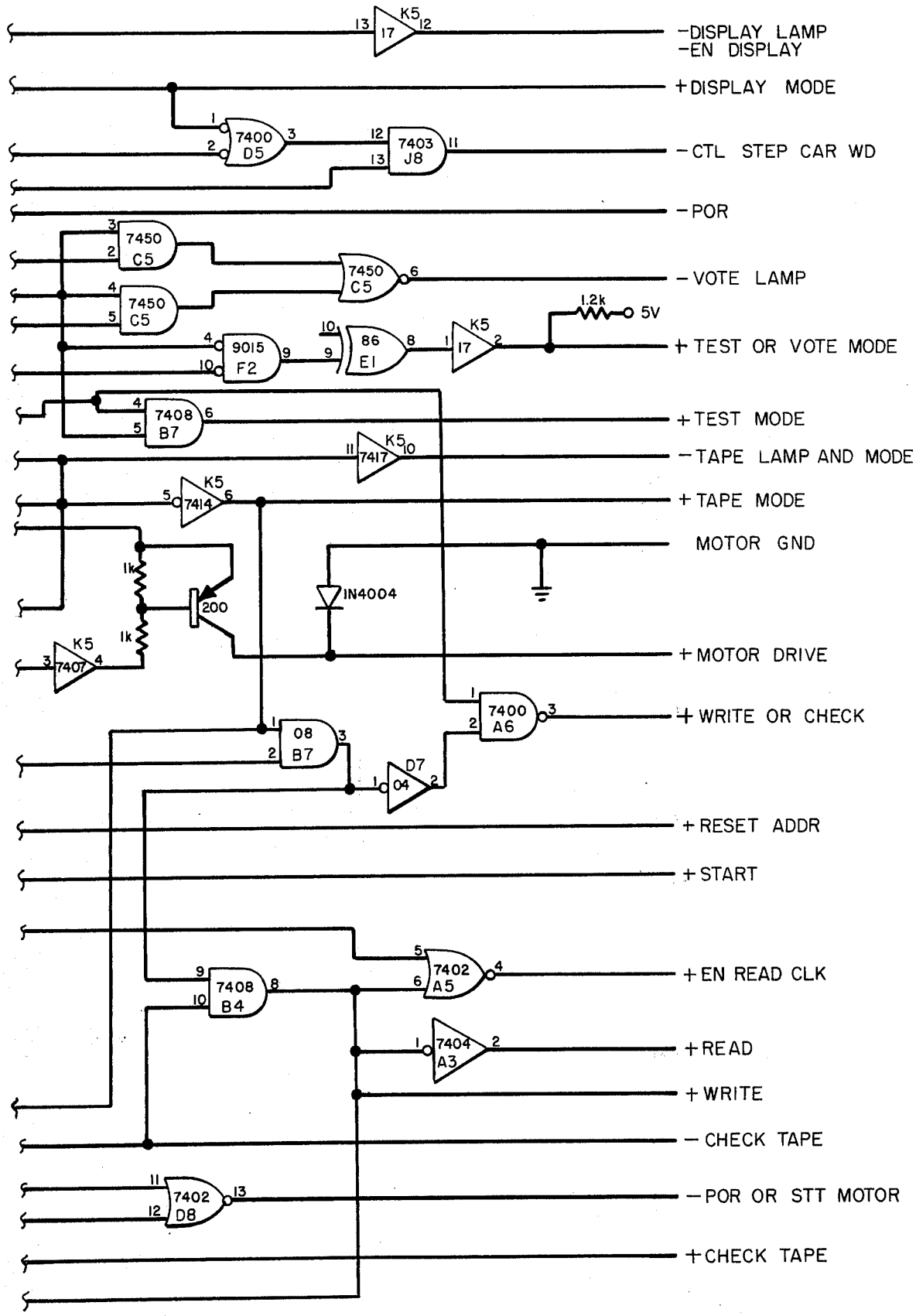
Figure 42:
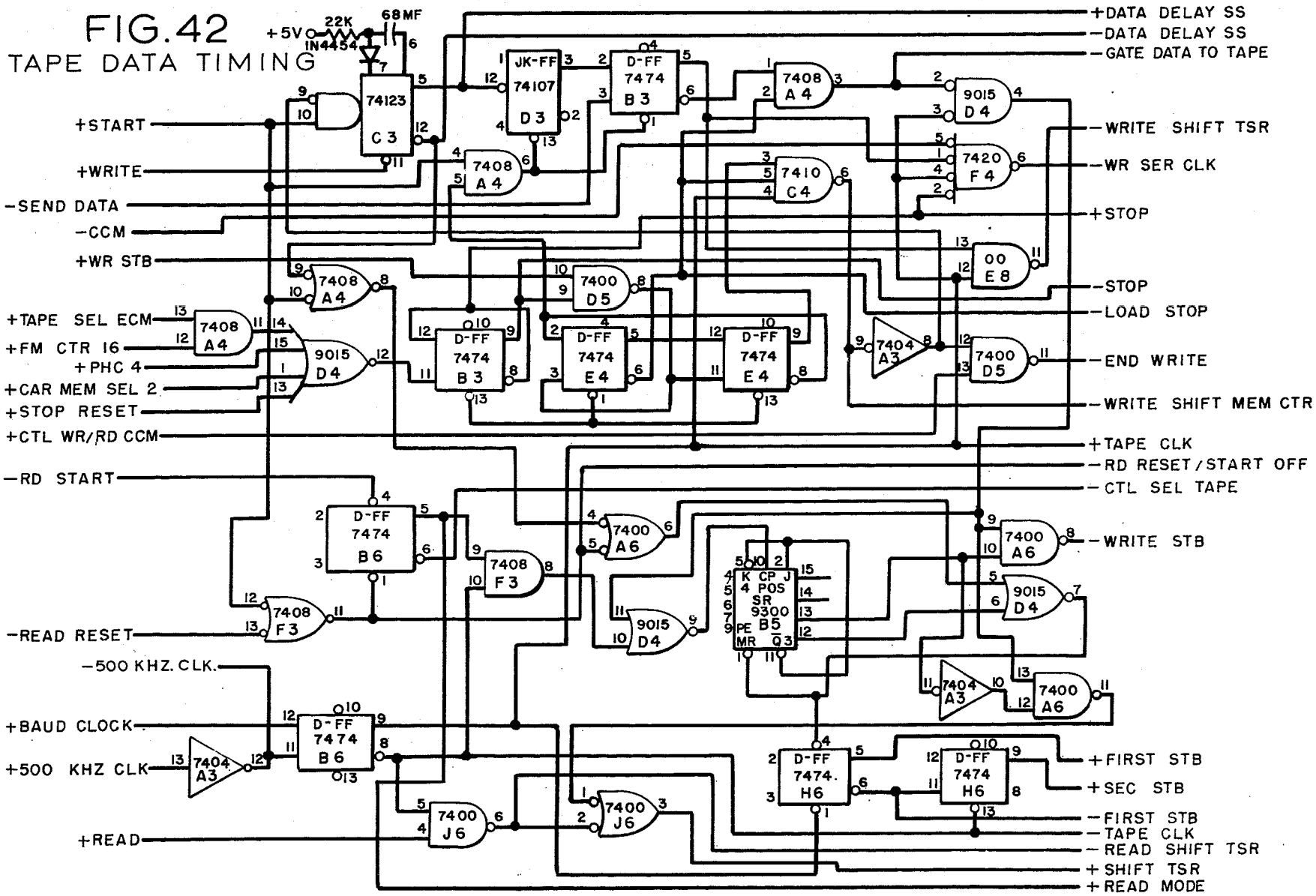
Figure 44:
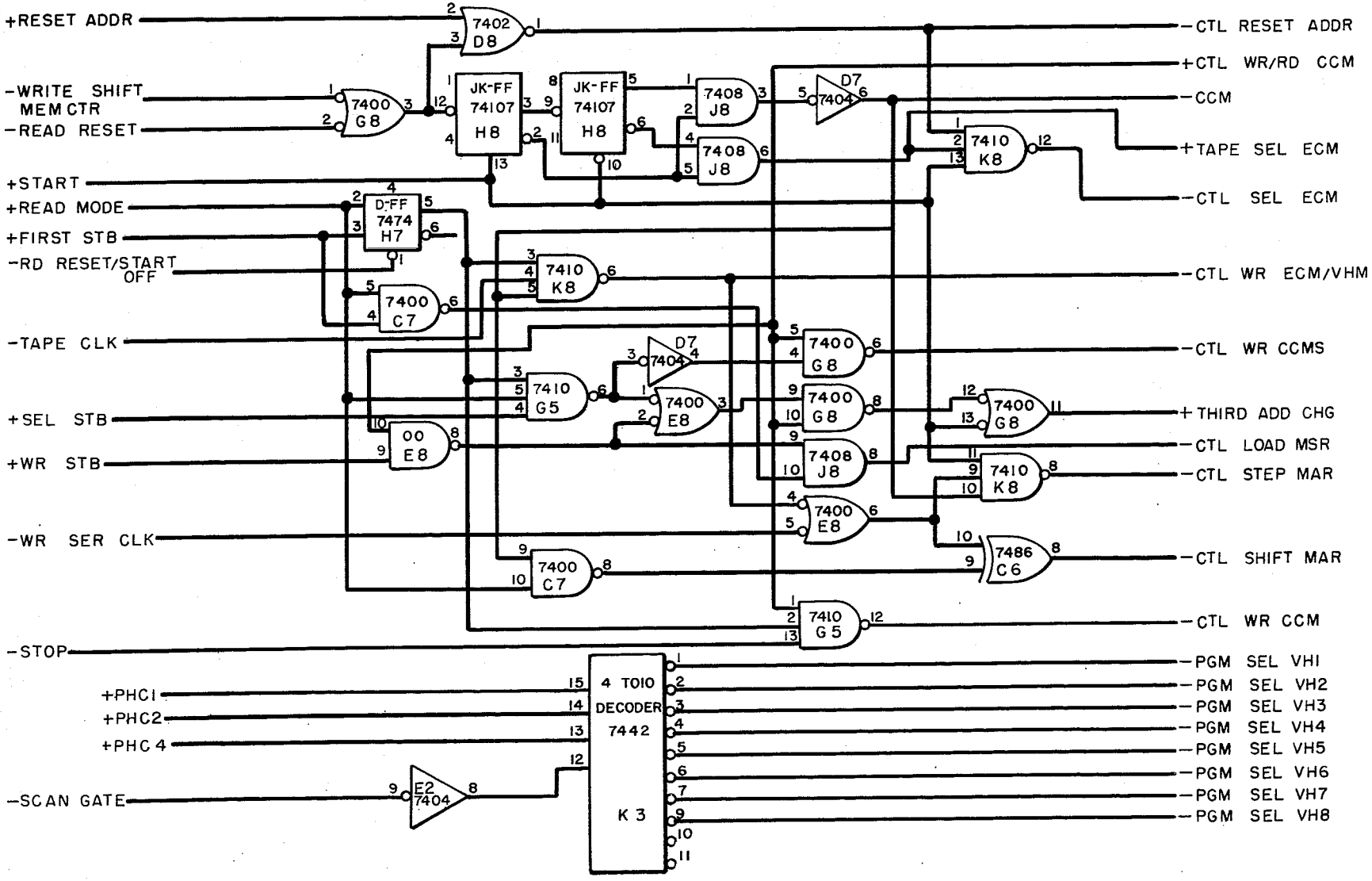
Figure 45:
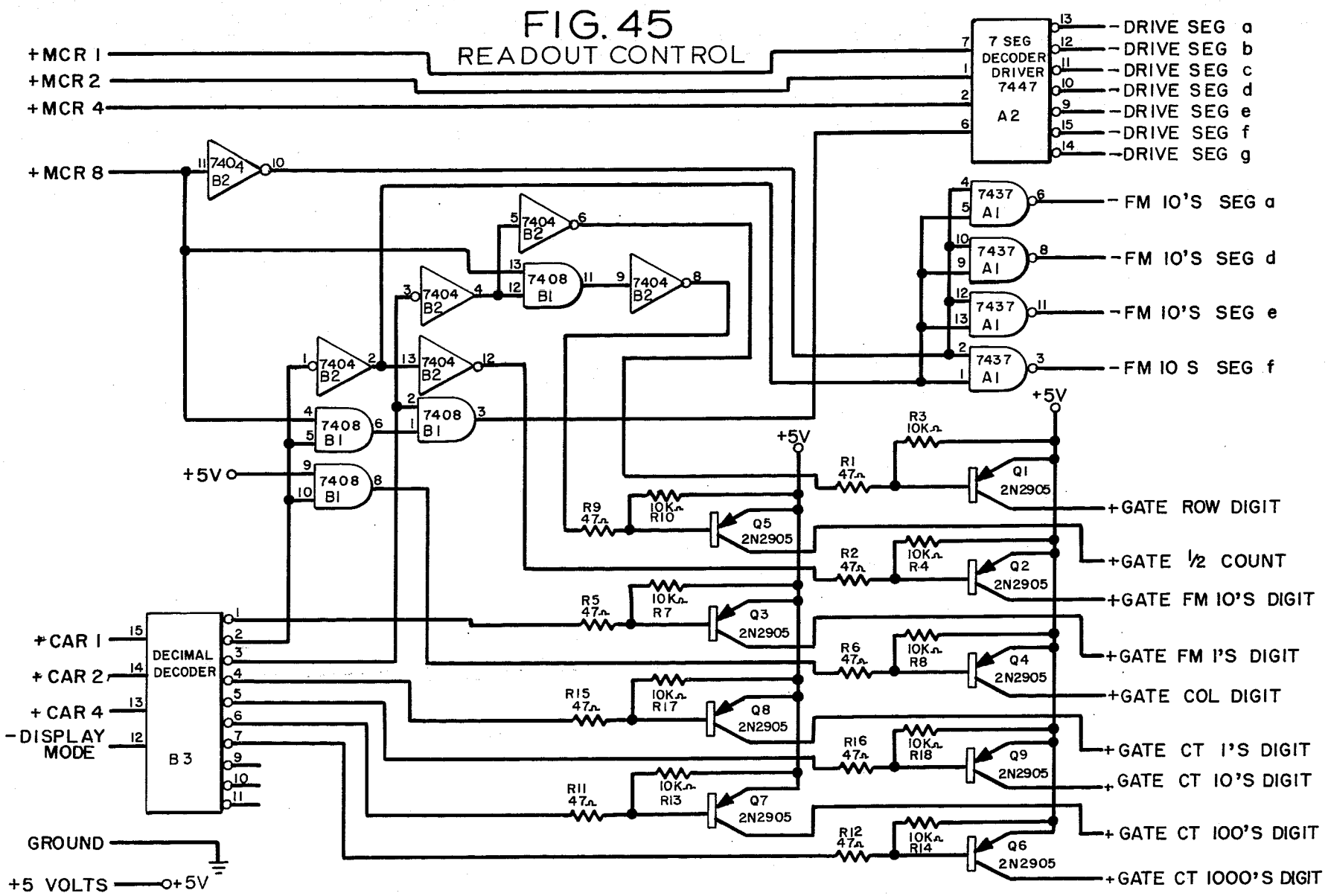
Figure 46A:
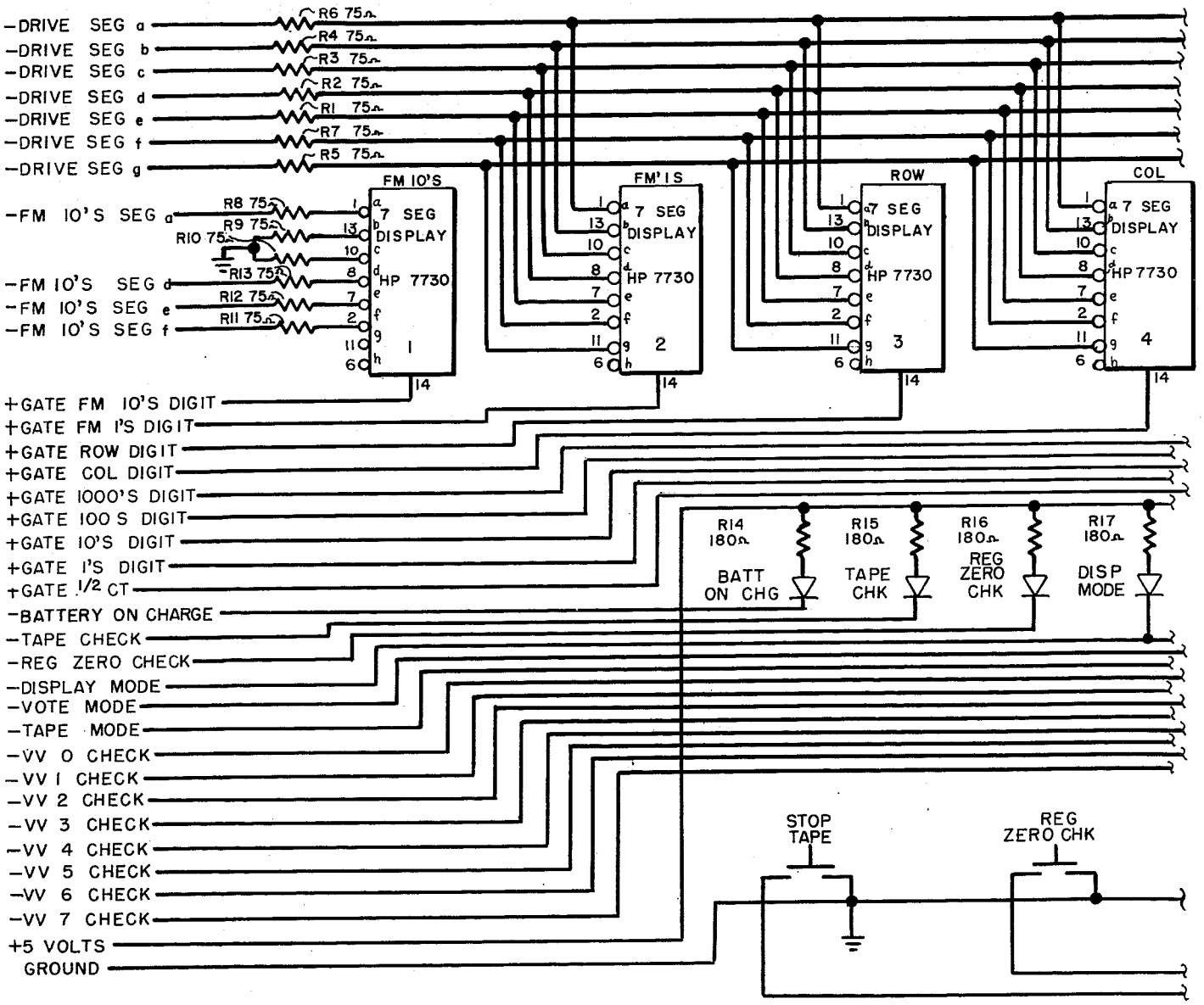
Figure 46B:
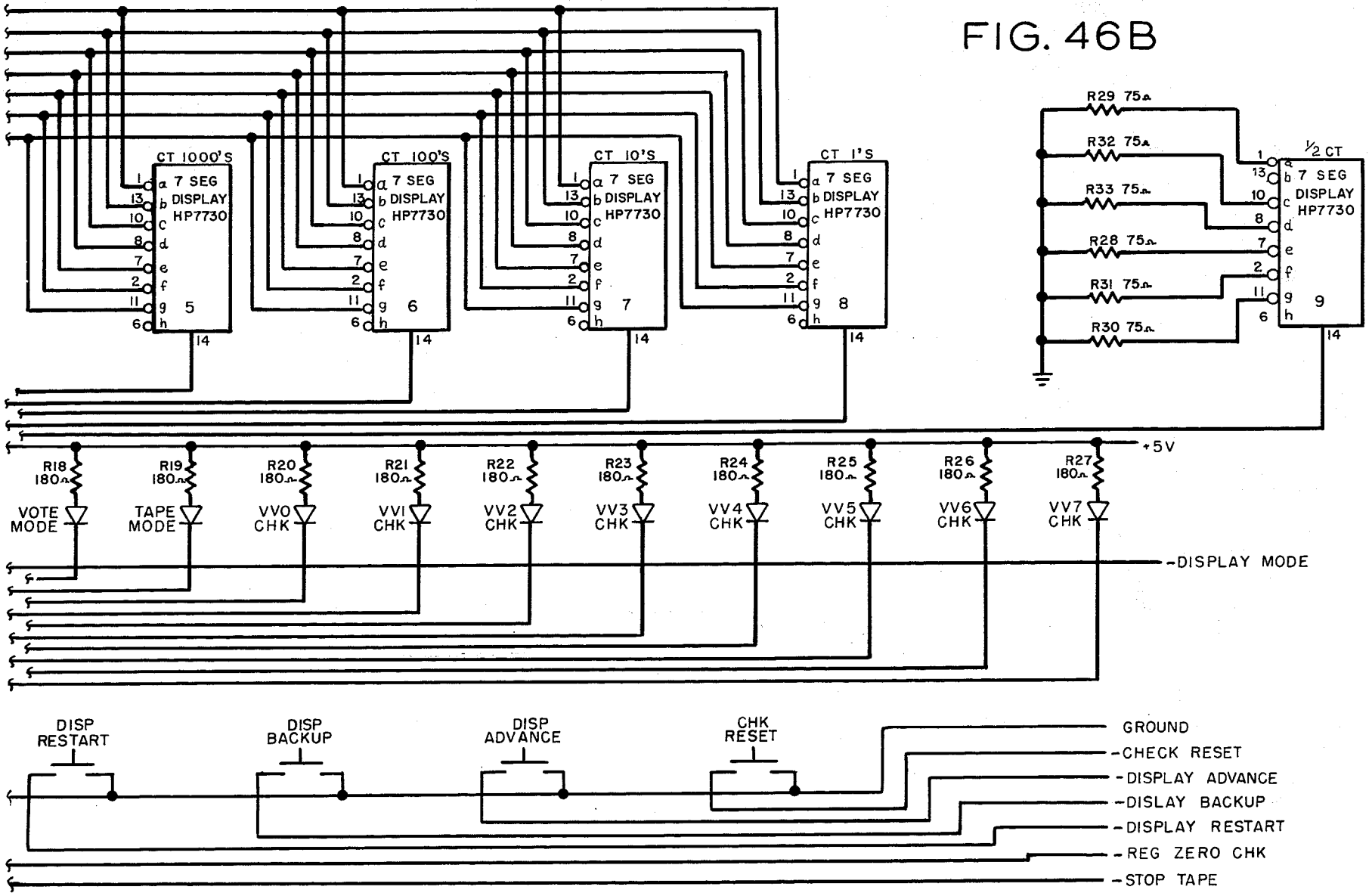
Figure 47:
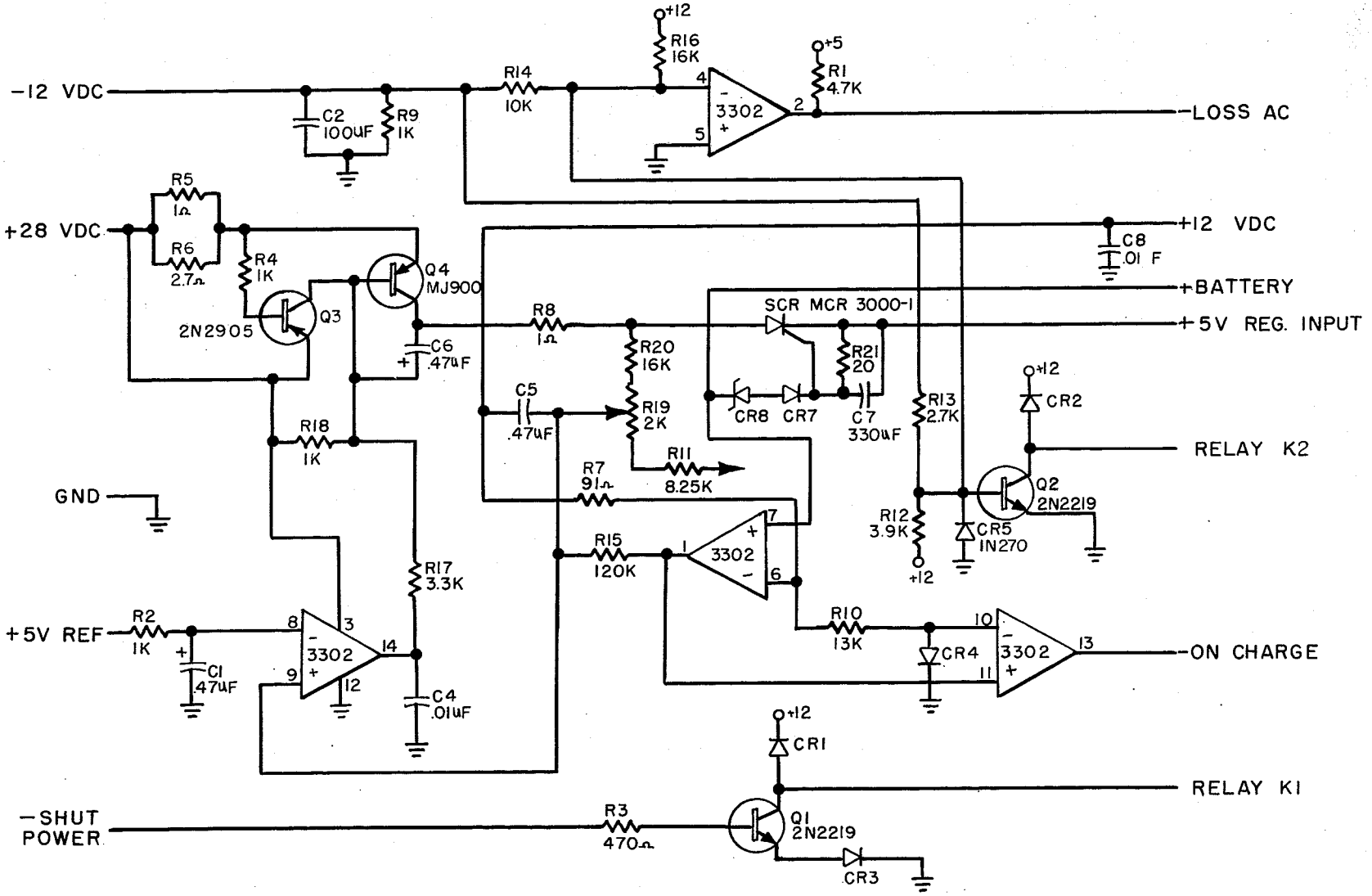

FIGS. 12–14 taken together illustrate the pulse generation and data flow among the major components of the data center 100. As shown in FIG. 21, a master oscillator or clock circuit 200 provides pulses at a frequency of 500 kilohertz. These pulses are applied to the input connection of a divide-by-eight conductor circuit 201, to the input connection of the gate circuit 202, and over line 203 as the 500 khz. signal applied at one of the upper input connections of vote head counter 801 (adapter, FIG. 11). A 3-wire output signal from divide-by-eight counter 201 is applied to a second divide-by-eight counter 204, and also the input circuit of a decoder 205. The other connection from the output of counter 201, shown upwardly and to the left of the decoder 205, refers to the scan-head counter, a 3-wire connection (SHC 1-3). There are eight individual wire outputs from the decoder 205, from the scan selector circuit for the first vote head VH1 through the eighth scan selector circuit VH8.

It is important to emphasize that there is a basic synchronization between the pulses produced by clock circuit 200 and circulating in the data center 100, and the pulses then circulating in the vote head 600, attained by the common derivation of the timing pulses at the output circuit of divide-by-eight counter 204. That is, the output pulses from this circuit 204 are passed to the input circuit of a scan button counter (SBC) 206, and the basic timing pulses for operation of the data center are produced at the output side of this scan button counter. The output signals from divide-by eight stage 204 are also passed over the line 700, through the adapter (FIG. 11), and through the AND circuit 704 in the input of the vote head to the counter 705 of the vote head. In this sense counter 206 in the data center corresponds to the counter 705 in the vote head, because both receive their basic sync or clock pulses from the output side of divide-by-eight counter 204. This connection insures that the basic synchronization between the vote head and the data center is always maintained.

There are three outputs from the scan button counter 206. The first output circuit is applied to the input of decoder 207, which in turn has three output signals, scan frame number, print clock, and reset (this is the reset signal applied through the adapter and, over conductor 702, to the bottom of counter 705 in the vote head). The second output from stage 206 are the row and column scan button counter signals, applied to the vote head register 805 in the adapter circuit as already explained. The third output from scan button counter 206 is applied to another counter circuit 208, which divides down the input pulses to provide a 90 millisecond clock output signal for use in the data center.

Divide-by-eight stage 204 has another output signal which is applied to a decoder state 210, which both provides a first output signal as the scan gate signal for use in the data center, and a second output signal which is passed over line 211 to an input connection of gate circuit 202. The output signal from gate 202 is passed over line 212 as a sync signal for the program and instruction portions of the data center.

The output signal from gate 202 is applied as a first input signal to the program address register (PAR) 213, which also receives a second input signal (IR7) and a third input signal which is returned from program memory (PM) 214 over line 215. The output of PAR 213 is passed to the program memory stage 214, and from there to the eight-conductor read-only memory (ROM), to the instruction register stage 216 and, as already described, back to the input of PAR 213. "ROM" as used herein refers to a read-only memory, and is interchangeable with the term "ROS" to describe read-only storage. The numbers 128, 64, 32, 16, 8, 4, 2 and 1 after the ROM designation indicate there ae eight binary signals being passed over eight conductors from the output side of the program memory 214.

The instruction register 216 similarly has eight individual line output signals in a binary code designated IR 0-7, which are applied to one of the input connections of the instruction decoder stage 217. The instruction decoder stage receives another input signal over line 218 from the program memory 214, and a third input signal over line 220 from the program cycle counter (PCC) 221. The program cycle counter receives a first input signal from gate circuit 202, and a second input signal over line 222 from the instruction decoder 217. The instruction decoder provides output signals such as "button handled" and "Reset FM ID", shown applied to the vote head counter 801 and the frame ID stage 804, respectively, in the adapter circuit. Only the legends are used adjacent the conductors, as the addition of more reference numerals would only occupy additional space and not clarify the intercoupling of the various circuits. Those skilled in the art will be able to derive precise circuits as a result of the explanation in conjunction with the logic flow diagrams. However to insure a complete teaching, and enable the construction of such circuits with a minimum of experimentation, schematic diagrams on FIGS. 29–47 and 49 are included to enable those skilled in the art to rapidly construct a voting system in accordance with the inventive teaching.

A comparator stage 225 shown at the right of FIG. 12 is connected to make a switch comparison, that is, it examines a button number or switch number transmitted from the vote head to determine whether it is the same as the button or switch number already stored from the previous operation. As shown the comparator receives binary input signals from the vote head register over seven individual conductors, a signal corresponding to that shown at the bottom output side of the vote head register 805 in the adapter circuit. The comparator circuit 225 also receives the scan button counter input row and column signals, provided by the counter circuit 206. The output signal of comparator 225 is then a switch comparison signal on line 226.

In the lower right of FIG. 12 is a multiplexer 227, which receives three input signals and provides an output shown as the select frame address 5-wire binary signal. This multiplexer or selector circuit 227 has three inputs, the first of which is a frame address register select signal. The second input signal is the frame address 5-wire binary signal provided from the frame ID shift register 800 in the adapter. The third input signal is the frame address register 5-wire binary input signal, which is provided by the frame address register itself shown in FIG. 13.

FIG. 13 includes hardware or the actual circuits operated by the program stored in the data center, including the frame, position and vote head identification circuits. A frame address register (FAR) 230 is shown in the lower left of FIG. 13, and this register stage receives both a step FAR signal to advance the frame address register, and a reset FAR signal to reset the register circuit. Its output (FAR 16, 8, 4, 2, 1) is applied to the lower input connection of multiplexer 227 shown in the lower right portion of FIG. 12.

In the upper left portion of FIG. 13 is the program head counter (PHC) 231, which is stepped as it receives step PHC input signals and provides output signals both to a decoder stage 232 and a selector stage 233. The decoder also receives a scan gate input signal and provides eight individual program select output signals for the respective vote heads 1 through 8. Selector stage 233 receives the described input signal from program head counter 231, and another input signal representing the 3-wire indication of the selected memory address. The output signal from selector stage 233 is also a 3-wire signal applied over the cable 234 to one input connection of the memory address register (MAR) 235. The signals applied to the upper portion of MAR 235 generally regulate the row operation, and those other signals shown applied to the lower portion of this register affect the columnar circuits and operations. "INCR" stands for "increase" or "increment". denoting an increase in the count by one. Similarly "DECR" represents "decrease" or "decrement", representing a decrease in the count by one. The 5-wire output signal from MAR 235 is shown applied to one input connection of a selector stage 236, the output side of which provides the various selected memory address (SMA) signals. Selector stage 236, like the other arrangements shown only in block form, will be illustrated in detail hereinafter, but the showing in FIG. 13 is sufficient for a basic understanding of the various input signals required to the selector stage to produce the selected memory address output signals.

In the upper right portion of FIG. 13 are two selector stages 237, 238 which receive a plurality of input signals identified by the various abbreviations previously used. The upper selector 237 receives input signals from the instruction register, memory data shift register, selected memory address, and selected frame address to provide an output signal to comparator stage 240. The other selector stage 238 also receives input signals from the instruction register, the memory counter register, and read-only memory to provide another output signal to the comparator stage 240. The output signal from comparator 240 is passed to one input connection of a selector circuit 241, which receives a plurality of input signals as shown to provide a "test positive" output signal to regulate the jump or branching operations executed by the program when various combinations of the signals are present. Selector stage 241 will also be illustrated in detail in a schematic diagram hereinafter.

In the upper portion of FIG. 14, the vote head memory (VHM) 135, the electron configuration memory (ECM) 137, and the candidate count memory (CCM) 136 are shown. The same reference numerals are used to relate these blocks to the corresponding blocks in the data center 100 shown in FIG. 5. In the upper left portion of FIG. 14, selector stage 250 receives input signals from the instruction register and from the memory data shift register, providing an output signal on line 251. This output signal is passed to the data input connections of VHM 135 and ECM 137. In addition the vote head memory receives the program select vote head memory input signals and scan select vote head memory input signals, together with an address input that is also applied to the ECM 137. A "write" input signal is also applied to each of the three memories 135, 136 and 137.

The output signal from vote head memory 135 is passed to one input connection of another selector circuit 252, and to an input connection of another selector circuit 253. Selector circuit 252 also receives a print clock input signal, a first frame input signal, and another block data input signal. The output signal from selector stage 252 is passed to the register 806 (FIG. 11) in the adapter logic circuit, and its signal in turn is passed over line 703 to the vote head.

In FIG. 14, selector 253 also receives another input signal from the election configuration memory 137. Selector 253 provides a first output signal to a memory latch circuit 254, and a second output signal to a memory shift register (MSR) stage 255. In addition to the input signal from selector 253, MSR 255 also receives load and shift input signals, and another input signal from selector stage 256. As shown stage 256 in turn receives input signals from the control selector tape circuit, the instruction register, memory counter register, selected memory address and tape unit (TU).

The candidate count memory circuit 136, in addition to the write CCM input signal, receives an input signal from the memory count register (MCR 8, 4, 2, 1) and another input signal from the candidate count memory address register (CAR) shown as two blocks 257, 258 in which the various input signals are labeled with the appropriate abbreviations. The output signal from CCM 136 is a 4-wire signal labeled CCM 8, 4, 2, 1, and it is applied to one of the input connections of a selector circuit 260. This selector circuit 260 receives another input signal from the memory data shift register (MSR). There are five additional input signal, each labeled, which are applied both to selector circuit 260 and to the memory counter register 261. The output signal from memory counter register 261 is a 4-wire signal labeled MCR 8, 4, 2, 1. One of these lines (MCR 8) also provides one input signal to a memory counter overflow (MCO) stage 262. In turn this stage MCO 262 receives an input signal from the memory counter one-half bit stage 263 designated MC ½. The input signal to this stage, in addition to all those shown coupled to the common line 264, is that generated each time one-half bit is added to the memory counter register by a ½ INCR MCR signal. In the lower left of FIG. 14, error check circuit 265 receives the five input signals represented and identified, and produces three output signals. The first output signal is really an eight-wire signal to the error lamps, those lamps numbered 1–8 under the lgend "Video Voter Check" and collectively designated 121 in FIG. 2 of the drawings. The second output signal from error check circuit 265 is for the zero verify lamp, to illuminate the lamp 124 in FIG. 2 if the zero check proves correct. The third output signal indicates the system has been powered down.

In the lower right portion of FIG. 14 are three intercoupled circuits, a mode control circuit 266, a tape interface circuit 267, and a tape unit 268. Tape unit 268 can be a conventional "Lear" type cartridge arrangement, as previously described, for reeceiving the cartridge 105 shown in FIG. 2. Vote control circuit 266 receives power on, door closed, and power down input signals, as well as another signal from the tape interface circuit 267. The door closed signal to the mode control circuit does not refer to the write-in door 605 of the data center, but to the correct placement of a cover over the data center. All the other input and output signals are apparent from the previous description. Under the control of the tape interface stage 267, tape unit 268 is driven by the "run motor" signal and data is passed in, as represented by the "data in" signal.

The three memories 135, 136 and 137 can be semiconductor memories, interconnected in the formats generally shown in FIGS. 15A–17D. Vote head memory 135 is represented in FIGS. 15A and 15B. The format shown in FIG. 15A is the initial frame format, that generally used in showing the status of the various switches indicated by the legends in the drawing. The remaining frames are shown in FIG. 15B, generally concerned with respresenting the vote indicator button status as the various buttons are pushed by the voter. Of course additional memory capacity must be provided for the vote memory if additional vote heads are connected to a single data center.

The format of election configuration memory 137 is shown in FIGS. 16A – 16D. The initial frame format is shown in FIG. 16A, and the expanded initial frame format is depicted in FIG. 16C and the expanded additional frames in FIG. 16D.

The candidate count memory format includes four different fields, shown in FIGS. 17A – 17D, for the candidate count, vote head count, tape ID, and the total vote count. All these memories are random access semi-conductor memories, the provision, interconnection and operation of which are well-known and understood in this art. With this basic description of the logic flow to the vot head and the data center, together with the depiction of the memory formats in FIGS. 15A – 17D, the preparation of a single configuration tape for a particular election will now be described.

PREPARATION OF CONFIGURATION TAPE

Briefly the program for operating the logical arrangement of the data center, including the hardware described in connection with FIG. 12–14, is stored in the election configuration memory 137 and in the logical circuit arrangement shown generally in FIGS. 12 – 14. Before the equipment is operated the ECM memory 137 is empty, and only the hard-wired circuits logical arrangment is present. The appropriate memory information must be first generated in the vote head, passed to the VHM 135, the ECM 137 and the CCM memory 136, and, when the appropriate information is configured in all the memories this information is read out and recorded on the tape 105 within the cartridge. Before this is done, the 35 millimeter film strip is prepared with the successive frames showing the different candidates and other choices to be presented to the voter.

The equipment is then energized, and a blank (unrecorded) magnetic tape cartridge is inserted into the well 111 in the data center. The film strip is loaded into the 35 millimeter projector in the vote head. The power is turned on for both the vote head and the data center and the on lamp 622 is illuminated on the front panel of the vote head. The enable button 642 (FIG. 4) is depressed on the judge's panel, and the party enable lamps (661–664) in the first four positions are illuminated, and the slide projector is actuated to display the first frame. The first frame is treated differently than the remainder of the frames. Initially the first frame should be displayed with only one of the lamps 608 illuminated, and that lamp should appear in the second row, third column position. This lamp is identified as 608A in FIG. 18, which includes additional legends useful in explaining and understanding the configuration process. This initial lamp illumination is useful to align the film, utilizing the normal manual controls on the projector. The new page button 623 and review ballot button 624 can be actuated to advance and reverse the projector until the appropriate alignment and good focus are achieved. After the appropriate alignment and focus are secured, the review ballot button 624 is actuated to return to the first frame, checking to be certain that only lamp 608A is now on as shown in FIG. 18.

Figure 18:
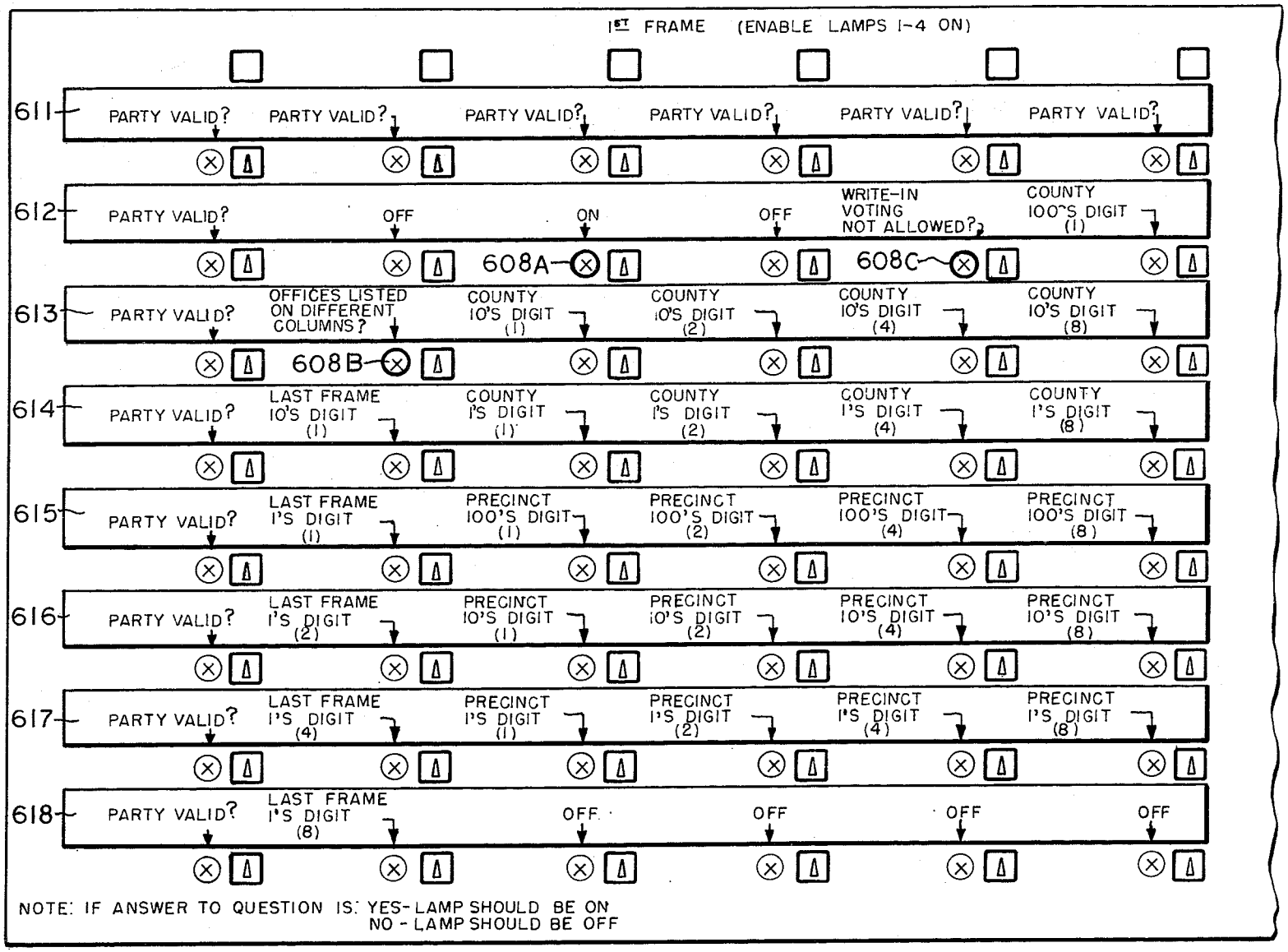
FIGS. 18 – 21 are illustrative showings useful in understanding the preparation of a master or "configurator" tape.

The horizontal translucent strips 611–618 shown in FIGS. 1 and 3 are referenced with the same numbers in FIG. 18. The various legends shown in FIG. 18 are not actually projected onto the first frame for configuration purposes, but are shown on a chart similar to FIG. 18, to provide the one configuring the tape with the information necessary to push the different buttons and insert the appropriate information. For example, if there are from one to six different parties which can be validly voted by pushing a single button, and this format is by row such as across the strip 611, those vote buttons underneath strip 611 corresponding to the locations of the valid parties are pushed once. The logic arrangement in the system is such that pushing any button once provides a signal which, after passing through the program, illuminates the lamp 608just to its left. Pushing the same button a second time in effect cancels the selection, and extinguishes the adjacent lamp to show this. Thus, if a valid party is being displayed at a given location on the film strip, and the button under that location is pushed, the lamp to the left of the button just pushed should be illuminated to show that party is valid. Moreover the logic is such that if the total number of votes has already been cast in a single race, pushing an additional button will not be effective to illuminate the adjacent lamp, and the voter will know that he must either cancel one of the preceding votes or ignore his last selection.

The next operation is to determine if the offices or races are listed on different columns. That is, if the election has a vertical orientation (the offices being listed on different columns, with the candidates for that particular office aligned on the different successive rows in each column), then the lamp 608B in row 3, column 2 should be illuminated. For many elections it is required to have the write-in apparatus operable. However for certain elections it may be desired to inhibit the write-in apparatus for the election. If the write-in voting feature is to be inhibited during the particular election for which the tape is being configured, lamp 608C in row 2, column 5, should be illuminated to indicate that this apparatus is in fact inhibited.

The county, precinct, last frame number, and security codes are then entered using a binary code system in hexadecimal digits. This is a well-known code in which four different lamps, semiconductors or other units are either on or off to represent the binary numbers 1, 2, 4 and 8. To represent the number 11, by way of example, the 1, 2 and 8 lamp positions would be energized (if lamps are used in the code), with the number 4 lamp left de-energized. Such an arrangement is well known to those skilled in the art and one example will be given of entry of these codes. The system is arranged to display up to twenty valid frames on each film strip. However the first frame always has the address zero, and therefore, the highest number of a valid frame address is 19. Suppose that there are 14 valid frames on the election to be configured; because the first valid frame address is zero, the last (highest number) valid frame address is 13. The valid last frame 10's digit can only be a 0 or a 1. In this case (13), it is a 1, and so the vote button in the fourth row, second column is pushed to insert a 1. The adjacent lamp will be illuminated to show the 1 has been correctly entered. To insert the value 3 in the last frame 1's digit position, two buttons must be pushed. The button with the value 1 in row 5, column 2, is pushed, and then the button with the value 2 in row 6, column 2 is also pushed. These two buttons add to a value of 3, and thus the last frame address of 13 has been inserted in the memory.

Figure 19:
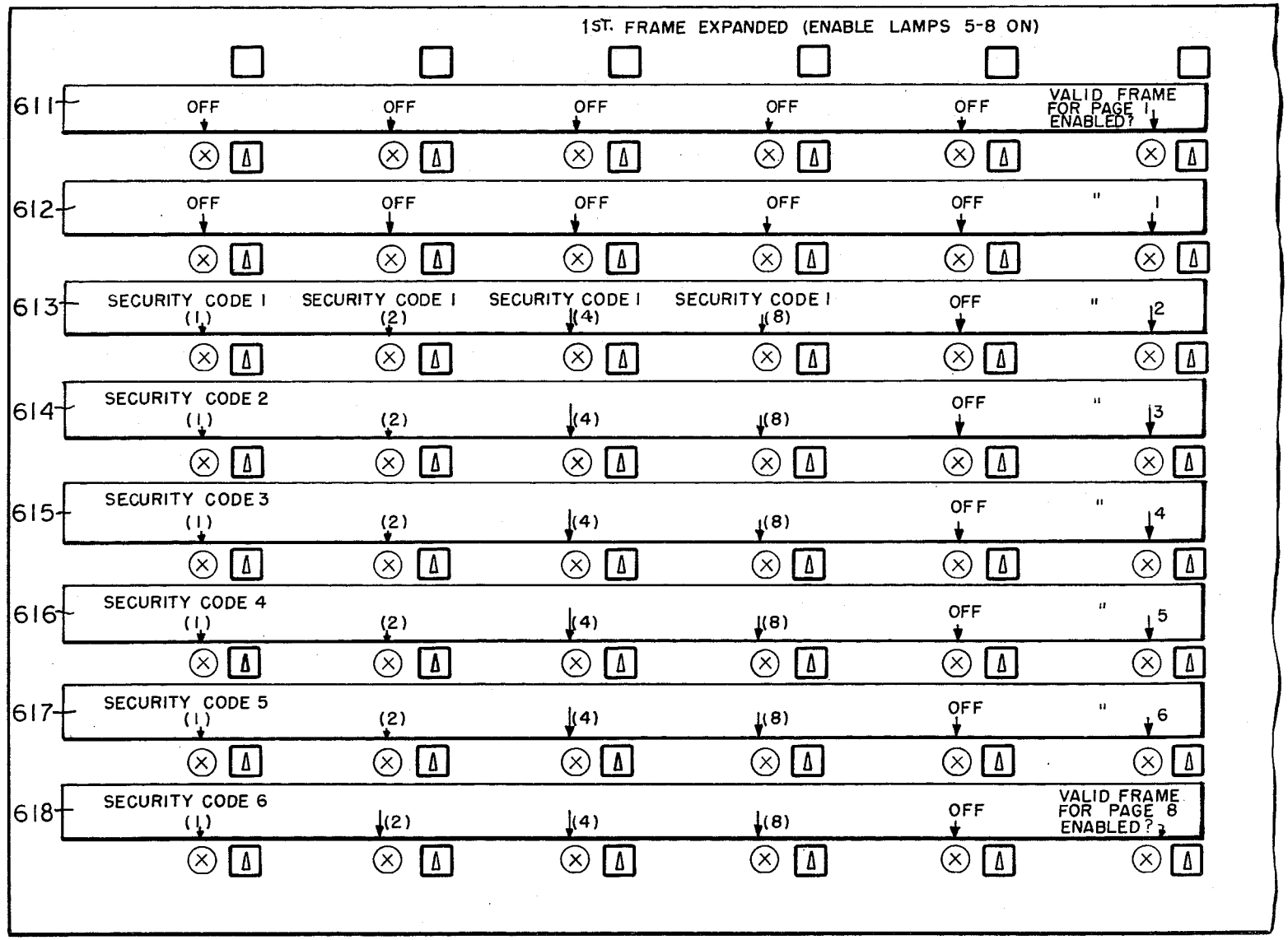

The same procedure is then followed to insert the number of the county in which the voting system is to be used. There is only one place, with the value of 1, for the county 100's digit, shown in the row 2, column 6 position. Therefore 199 is the maximum number that can be entered for the county. This button is depressed if the county number is 100 or greater. The value of the county 10's digit is then inserted by depressing the appropriate ones of the last four buttons (1, 2, 4, 8) in the third row, and the county 1's digit value is inserted by pushing the appropriate ones of the last four buttons (8, 4, 2, 1) in the fourth row. The precinct number information is inserted in the same way, by actuating the appropriate ones of the last four buttons in each of the 5th, 6th and 7th rows of the button array. The procedure to this point has generally provided the information necessary for the upper six rows shown in the initial frame (FIG. 16A) of the ECM memory 137. To configure the expanded portion of the first frame, as depicted in FIG. 16B, the add button 645 (FIG. 4) on the judges panel is depressed, and this is recognized by extinguishing the first four of the lamps 661–664 and the illumination of the next four lamps 665–668 on the judges panel. The security code is now entered, in the same manner as described above in connection with the precinct and county numbers. This six-digit security number is entered by pushing the appropriate ones of the vote buttons 607 in rows 3 – 8, as generally shown in FIG. 19. These code digits are stored in the data center memory for later recording on the configurated tape, but it is emphasized that this security code will not be displayed when the operational system is used and the ballots are presented frame by frame to the voter. This security code is only for recognition after the voting process has been completed to insure that the appropriate configuration tape has indeed been used for the particular election.

Also in FIG. 19, the lamps in the successive rows of column 6 are utilized to indicate valid frame for the successive pages 1 – 8. As noted previously, the use of the page selection buttons 651–658 on the judges panel allow some of the pages (or frames) to be skipped, thus allowing either an accumulation of votes from different precincts in the same data center, or the presentation of different referenda or other questions to different voters from different geographical locations. The lamps in column 6 in FIG. 19 should be illuminated whenever the particular frame (or page) is not to be skipped, and party votes are to be recorded for a corresponding frame. The appropriate ones of the lamps 661–668 should be illuminated on the judges panel, in correspondence with the lamps illuminated in column 6 in FIG. 19. For example, if the first, third, fourth and eighth lamps are on in the last column in FIG. 19, then the lamps 661, 663, 664, and 668 should be illuminated on the judges panel to show that these pages or frames are not to be skipped. In general it is noted that these lamps should always be illuminated to indicate the first and last frame positions, as these are instruction frames.

At this time the add button 645 is depressed, and this will be indicated by the de-energization of the last four lamps 665–668 on the judges panel, and illumination of the first four lamps 661–664. The new page selector button 623 on the front panel is depressed, and the film will advance to display the next frame. It is understood that the different candidate names will be displayed on the successive translucent strips 661–668 where the legends "button valid?" are shown FIG. 20. However the arrangement of FIG. 20 indicates that each button can be validly pushed to make a selection during the election process should be pushed at this time, and recognized by all the illumination of the lamp adjacent the selected button. When all the buttons have been pushed to complete the illumination of all the lamps indicating valid button positions, the add button 645 is then depressed on the judges panel, the first four lamps 661–664 are extinguished and the last four lamps 665–668 again are illuminated. Referring to FIG. 21, in this position the expanded portion of the additional frames is configured. It is noted that the first two columns provide for insertion of the maximum vote counts for each race. The first column has a numerical value of one, and the second has a numerical of two. If the "offices listed on different columns" button was pushed when configuring the first frame, as described in connection with FIG. 18, then the successive rows in the expanded frames will correspond to the column positions on the film strip. The maximum vote count for a particular race can thus be 3, if it is not extended (as described hereafter), or 9 if the race is extended. In FIG. 21, the legend "partisan?" in the third column signifies that the lamps in this column should be illuminated whenever the election is eligible for party voting. That is, if the Democratic party button is depressed when the first frame is displayed, the Democratic party candidate on this frame will receive a vote. The legend "proportional?" in the fourth column refers to proportional voting. The lamps in this column should be illuminated whenever the election is eligible for proportional voting. For example, if the maximum vote count for a particular race is 3, proportional election means that a voter can select one candidate who will then receive all three votes, or two candidates who will each receive one and one-half votes.

In the fifth column, the legend "extension of row or column" refers to the presentation of the candidates on two successive rows or columns, instead of only on a single row or column. Suppose for example there were eight candidates in a single race. Their names could not be presented on only the first six horizontal row positions. Accordingly the button in row 2, column 5 is depressed to extend the race through both rows 1 and 2. In effect the second row or column is then made an extension of the previous row or column for purposes of accumulating the vote totals. It is noted that under these conditions there are two lamps and buttons available (at the column 1 and 2 positions in each row) to insert the maximum vote count, and this provides sufficient signals so that a maximum vote count of up to 9 can be inserted when the race is extended. Illumination of any lamp in the fifth column of a display as shown in FIG. 21 indicates that the row in which that lamp is illuminated is an extension of the previous row.

Figure 20:
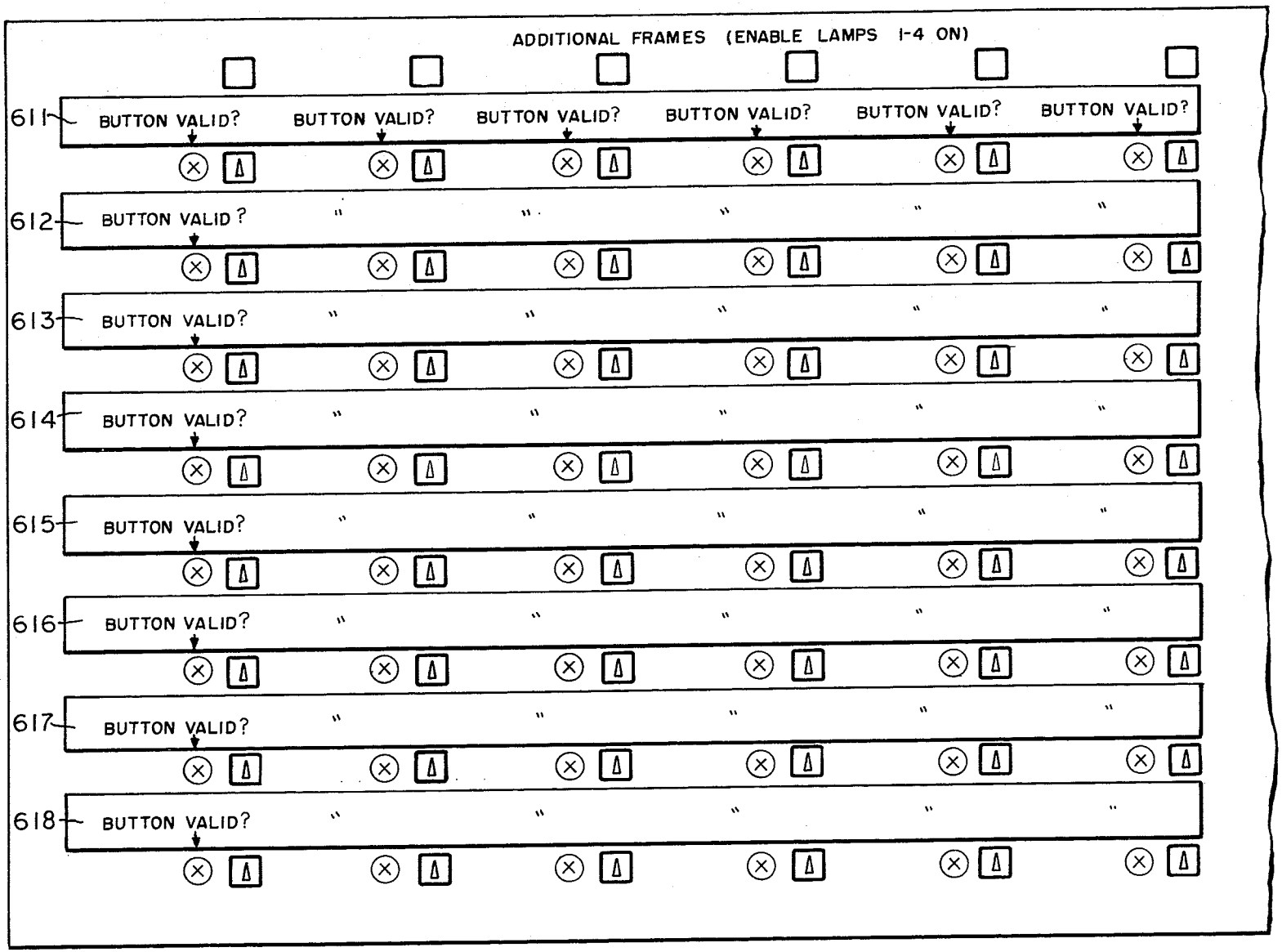

The lamps in the last column of FIG. 21 should be illuminated to show whether the frame being configured is a valid frame for the given page enable selection on the judges panel. If the frame is to be skipped for a given page enable selection, then the corresponding lamps in the last column should be off. The steps just described in connection with FIGS. 20 and 21 are then repeated for each successive frame of the film strip until the entire election has been configured. At this time the entire configuration format should be reviewed by reviewing each frame on the film strip. This is done utilizing the review ballot, new page, and add buttons. Corrections can be made simply by depressing any button adjacent a lamp erroneously lighted, and noting that the lamp is then extinguished. After the entire configuration has been verified, the register votes button 626 is depressed. All the lamps will then be extinguished. The tape recorder apparatus can then be automatically activated and the information temporarily stored in the memories 135–137 will be recorded onto the tape 105, under the control of the data center. This recording of the tape takes only a very short time.

Although the master tape has now been recorded, the memories still retains the information inserted by the procedure described above. Thus if another configuration tape is to be recorded with only minor changes from that on the first tape, the original configured tape can be removed and a new, blank (unrecorded) tape inserted into the tape well of the data center. Depression of the review ballot button 624 on the vote head will return the film strip to the first frame. The configuration can be modified by successively pushing the new page button 623, advancing the film frame by frame and changing the state of the desired lamps by pushing those buttons which effect the desired changes. After the new configuration has been verified, it can be recorded on the second tape in the same manner.

OPERATION DURING ELECTION

In general the set-up and energization of the voting system is supervised by two judges of election from opposite political parties. The configured tape in the cartridge 105 is inserted into the well 111 of the data center, and the data center is then closed and locked with the cover preventing the removal of the tape cartridge. Power switch 104 is then turned to the "on" position, and the "tape" mode light 118 will be illuminated. At this time the hard-wired logic circuits in the data center regulate the read-out of the data stored on the configured tape into the memories 135–137 of the data center. In less than 3 minutes the transfer of data and the other warm-up functions are completed, and the system automatically enters the "vote" mode, so that lamp 118 is extinguished and lamp 117 is lighted. The "battery" light 126 will also be on until the battery is fully charged, and then will be extinguished.

The vote head cover is removed, and authorization key 641 is inserted and turned clockwise on the judges panel, and the projector lamp (not illustrated) is turned on. The enable button 642 is turned on, and the lights 622 on the front panel and 643 on the judges panel will flash intermittently; no votes will be recorded in the data center while these lights are flashing. The "new page" button 623 is successively pushed to display each frame or image. Each frame is tested by pushing the buttons for each voting position as designated, to be certain that the accompanying lamp 608 is illuminated as each adjacent selector button is pushed. The judges attempt to over-vote each race, to be certain that the tape is properly configured and will not allow such over-voting. Each frame is advanced and the vote buttons are actuated for all the offices referenda, and other questions on the ballot. The judges compare the specimen ballot with each frame. After the film and the tape have been verified, the "register votes" button 626 is pushed to clear the system, but no votes are recorded at this time. With the vote head cover still removed, the top side of the paper roll for the write-in apparatus is exposed, and each judge writes his initials and some other identifying data, such as the serial number of the particular vote head, on the paper roll.

When the vote head cover was removed, a microswitch was released to prevent the casting of votes. After the system has been verified, the cover is returned to the top position of the vote head, and the authorization key 641 again inserted into the proper position to authorize operation of the vote head. This key must be removed each time the cover is taken on or off of the vote head. With the cover in place and the authorization key turned, actuation of the enable button 642 will provide a steady illumination of the voting lamp 643 and the on lamp 622 on the front panel of the voter.

At this time the judges check the memories or electronic registers in the data center by momentarily depressing the zero check button 123. When this button is released the "zero-check" lamp 124 will be illuminated to show that there is no vote total then stored in the vote head memory or in the candidate count memory. If this lamp is not illuminated, a technician must be called to be certain that there is no vote count in any memory prior to the initiation at the voting process.

The voting process itself is very simple. After presenting proper identification to the judges of election the voter enters the booth and uses only the face (or front panel) of the vote head. The lamp 622 is on to show the equipment is ready for his operation. In a general election, the instruction frame is also the straight-party voting frame. Pushing "new page" button 623 advances the film to the next frame, and the voter makes his selection by pressing the desired ones of the buttons 607 to select his candidates. Each of his selections is identified by illumination of the lamp 608 adjacent that one of the buttons 607 pushed by the voter. At this time his votes on each frame are registered only in the scratch pad or vote head memory 135 in the data center. The voter advances to the next frame by pushing the new page button 623, and likewise makes his selections on that page. If write-in is desired for any particular race, button 628 is depressed and the lamp 629 will begin flashing. The voter pushes the one of the buttons 631–638 adjacent the row in which he desires to make the write-in selection, and the write-in window 605 opens. The voter makes his selection by writing in the name of the candidate, and then closes the window. He then goes on to complete the voting process. After his last frame or ballot page has been selected, he can push the review ballot button 624 to provide a successive repetition of all the frames, and review his selections. Any selection can be simply changed by again pushing the button under his previous selection, cancelling that choice and extinguishing the adjacent lamp, and then making a different selection for the same race. Errors made in the first selection can thus be simply remedied. After he has determined that all his selections are indeed correct and he wished to maintain them, the voter pushes the register votes button 626. At this time the lamp 625 flashes, while the temporarily stored votes previously held in the scratch pad memory 135 are passed into the candidate county memory 136, and added to whatever count has already been accumulated for the candidates selected. The voter then leaves the booth and the apparatus is ready for operation by the next voter.

At the end of the election, the judges again open the vote head at the top and expose the paper roll for the write-in. If their initials and other identifying data are in the same location as prior to the election, there are no write-in selections to be added. If their initials are not in the same place, there is at least one write-in selection, and the judges again enter their initials and some other identifying data to indicate the end of the write-in tabulations. Each write-in vote has three digits stamped adjacent the write-in candidate name, identifying the frame and row for which the write-in selection was cast.

At this time the cover is removed from the data center, which initiates an automatic recording of the vote totals then stored in the candidate count memory onto the tape 105 in the cartridge. This takes about three minutes and, when all the data has been recorded on the tape, the data center automatically goes into the display mode as will be indicated by illumination of the lamp 116. It is emphasized that at this time all the accumulated vote information is on the tape, and is free from the tampering by any person. This tape can be locked or otherwise secured for transmission to a central headquarters as a record, or it can itself be automatically read into some data processing system for merger with other votes from other locations. However in general the accumulated count, which is still present in the candidate count memory 136 at this time, is read out by the judges of election by using the advance button 115 and the backup button 115 to read out the totals. This is done by recognizing the successive position numbers in the display window 106, which identify each successive frame and row to positively identify the race. To the right of each position number is the total displayed in the window 107, so that the judges of election can visually determine the count and enter this count on a tabulated form. This record provides another source which can be compared with the record on the tape 105 at a later time if necessary. The paper ballots from absentees and write-in selections are then added to the total displayed in the window 107 to determine the election totals at this particular location.

From the foregoing explanation, it is apparent that a positive and accurate system of automatic voting has been provided in which the voter can readily make his selections and easily verify them. This system is simple in operation by the voter, and tamper-proof in that only a single conductor pair is utilized to transmit all the information from each vote head to its data center. In this way the particular candidates or party identifications cannot be tampered with by cutting a single wire or jamming a single actuator. The system allows for a great deal of flexibility, such as extending races to successive rows or columns on the front panel visible to the voter, to present more candidates in a single race. The maximum number of votes (up to 3) can be set for each race, and this number is increased (up to 9) when the race is extended. In addition the judge by election can utilize the page selection buttons on the judges panel to present only some of the different frames to the voter. This allows voters from different precincts to vote on different propositions or referenda, or allows the data center to accumulate votes for the same candidate from different precincts and show the different precinct totals.

Those skilled in the art will appreciate that, to "configure" the master tape, a hard-wired program different from the program which regulates the normal voting operation must be used. This is easily accomplished, by removing the read-only memories from the data center, and replacing them with ROM's carrying the configuration program. This configuration program has three basic differences from the normal program.

First, the configuration program directs the information punched in on buttons 607 into ECM 137 and, for verification at the vote head, into VHM 135. Second, when new page button 623 is pushed, and the new page or frame is displayed, the configuration program reproduces in VHM 135 the information currently in ECM 137. Third, when the register votes button 626 is pushed, the configuration program scans ECM 137 to determine which buttons are valid, and sets up the candidate code and stores this code in the CCM 136. When all the frames have been viewed and the corresponding data punched into the memories 135–137, all this data is read out and recorded on the tape 105, whic is then the master or configuration tape.

FIG. 50 depicts another embodiment of the vote head 600, modified such that the projector apparatus is replaced by a cathode-ray tube (CRT) 675 for displaying the information to the voter. The write-in window and the control switch array 620 are not altered, and there is additional equipment (not visible in FIG. 50) for use in conjunction with the CRT for providing the visual display to the voter. A light pen 680 is shown with a body portion 681 coupled over an extensible cable 682 to the logic circuit 671 within the vote head. The body portion 681 may include an extendable tip 683, spring loaded for retraction when the body portion 681 is pushed against the face plate of the CRT, which functions both to shield the sensor within the light pen from ambient light and to activate the sensing circuit within the pen arrangement.

The display as shown on the face of the CRT is that for one race of the entire ballot. As an example a race for county trustee is depicted, and the instructions also show the voter may vote for six candidates of the 12 displayed. The additional information is provided so the voter can instantly determine that he has cast four votes, and two votes remain to be cast. The display shows the twelve different names of the candidates for the six positions, and a white square symbol is generated and displayed just to the right of each candidate identification. When the light pen is positioned over the white square related to the candidate, and then pushed inwardly, a "vote" or selection circuit is completed. The candidate selected is recognized in conjunction with the scanning mechanism already described in connection with the logic arrangement. A subsequent pulse from the data center then instructs the logic circuitry within the vote head to generate and display a black X positioned in the box adjacent the candidate, to indicate which one has been selected. The write-in selection can also be provided on the face of the CRT as shown, obviating the need for a write-in select button 628 in the previous arrangement. From the showing on the face of this display, it is apparent that with four votes cast and only three showing on the face plate, one candidate write-in selection has been made in the manner already described, and two votes remain to be cast.

The general system arrangement for providing a visual display as shown in FIG. 50 is set out in block arrangement in FIG. 51. As there shown the film drive and projector apparatus has been replaced by the cathode-ray tube 675, a character generator 676, and a buffer storage 677 in the vote head 600. In addition, a "race" memory 138 is added to the other memories 135, 136 and 137 previously described in connection with the data center 100. The race memory includes information, in binary form, regarding all the races and names of the candidates for display sequentially, in the same manner as each frame of the film was used in conjunction with the projector apparatus. Although the remainder of the data center 100 is shown unmodified, those skilled in the art will appreciate that a tape recording system with a cassette or other storage means need not be used, but instead the entire memory including the units 135, 136, 137 and 138 can be a plug-in electronic memory. Such units can have the information initially "written" or stored therein, and then plugged directly into an appropriate socket in the data center 100. At the termination of voting, this unit can then be lifted out and plugged into the tabulating apparatus for accumulating the election results.

Those skilled in the art will understand that the system depicted in FIGS. 50 and 51 operates in a manner quite similar to that already described. The information previously carried on the film for use in the projection apparatus is now stored in race memory 138 in the data center 100. Thus when a signal similar to the "advance film" signal is generated as the voter finishes his selection in one race, this signal causes the logic circuit in the data center to search for the next race information, transmit it over the cable 110 to the vote head and, through logic circuit 671, store it in the buffer storage circuit 677. This can be a simple storage arrangement of any suitable type, and it appears now that 1,024 storage bits will suffice for display of all information in a single race. When the particular race information is accumulated in the buffer storage, the stored signals are used to regulate operation of the character generator 676 in a well known manner to cause the sweep of the cathode-ray tube 675 to vary in intensity at the proper locations across the face of the tube to produce an information arrangement of the type depicted generally in FIG. 50. Each time a candidate is selected by use of the light pen, or any other suitable means, the vote signal is transmitted over the cable 110 back to the vote head memory in the data center 100, for transfer to the candidate count memory 136 as already described. Those skilled in the art will also appreciate that the sensing element need not be in the light pen assembly 680, but this pen can have a light projecting unit. The light-sensitive locations can be provided on the face of the CRT 675 which then registers the signals, in much the same manner that the photocells receive the signals on the face plate of the projection apparatus originally described.

In the appended claims the term "connected" means a d-c connection between two components with virtually zero d-c resistance between those components. The term "coupled" indicates there is a functional relationship between two components, with the possible interposition of other elements between the two components described as "coupled" or "intercoupled."

While only particular embodiments of the invention have been described and claimed herein, it is apparent that various modifications and alterations of the invention may be made. It is therefore the intention in the appended claims to cover all such modifications and alterations as may fall within the true spirit and scope of the invention.

What is claimed is:

1. A voting system for storing information regarding candidates and races for successive presentation to a voter, comprising:

a vote head including an optical unit for visually displaying the candidates in each race, including a plurality of vote selectors for selecting the candidate in each race, and a vote head logic circuit coupled to the plurality of selectors; and a data center, coupled to the vote head by at least two conductor pairs, including memory means for storing processing instructions, for accumulating the total of votes cast in each race at the vote head, and for continually representing the status of the vote selectors in the vote head, and a data center logic circuit coupled to a first one of the conductor pairs and to the memory means, which data center logic circuit includes means for generating a train of pulses for passage over the second of the conductor pairs to the vote head for continually scanning all the vote selectors in the vote head, with the vote head logic means being connected to change the representation of at least one pulse in the pulse train each time a vote selector is actuated, thus producing a modified pulse train which is returned over the first conductor pair to the data center in a time sequence which is synchronized with the pulse train passed over the second conductor pair to the vote head, to indicate the candidates selected at the vote head.

2. A voting system as claimed in claim 1, and further comprising a vote head counter circuit in the vote head logic circuit connected to receive the train of pulses from the data center, and a data center counter circuit, connected in the data center logic circuit and also connected to receive the same train of pulses, this maintaining synchronism between the pulses passed over the second conductor pair to the vote head and the pulses circulating in the data center to regulate operation of the data center logic circuit.

3. A voting system as claimed in claim 2, and further comprising a third conductor pair, coupled between the vote head logic circuit and the data center logic circuit, for passing a reset pulse from the output side of the data center counter circuit to the vote head counter circuit, to insure that synchronism between the data center and the vote head is maintained.

4. A voting system as claimed in claim 2 in which the data center logic circuit has means for storing a data processing program with fixed-format and variable-format portion to regulate the vote selection, accumulation and registration, and including a memory connected to receive the variable-format portion for a particular election, to regulate the validity of the vote selectors in the vote head and to prevent over-voting.

5. A voting system as claimed in claim 4, and in which said data center further comprises a tape unit, coupled to said memory, for receiving a tape cartridge on which the variable format portion of the program has been stored, and for passing that variable-format program portion to the memory.

6. A voting system as claimed in claim 5, and further comprising a readout display coupled to the memory, in which said fixed-format portion of the program is connected to regulate transfer of the total votes in each race from the memory to the tape without changing the information stored in the memory, thus enabling the tape to be removed with a record of the votes cast and thereafter allowing the vote totals to be read out from said readout display.

7. A vote entry and recording system for storing information regarding candidates and races for successive presentation to a voter, comprising:

a vote head including an optical unit for visually displaying the candidates in each race, including a plurality of vote selectors for indicating the candidate selected in a given race, and a vote head logic circuit connected to the plurality of vote selectors; and a data center, coupled to the vote head by first and a second conductor pairs, including an election configuration memory for storing processing instructions, a candidate count memory connected to receive and accumulate the total of votes in each race cast at the vote head, a vote head memory, coupled between the first conductor pair and the candidate count memory, for continually representing the status of the vote selectors in the vote head, and a data center logic circuit coupled to the first conductor pair and to all the memories, which data center logic circuit includes a clock circuit connected to generate a train of pulses for passage over the second conductor pair to the vote head for use in continually scanning the plurality of vote selectors in the vote head, said vote head logic means being connected to change the representation of at least one pulse in the pulse train each time a vote selector is actuated, thus producing a modified pulse train which is returned over the first conductor pair to the data center logic circuit to indicate the candidate selected at the vote head.

8. A vote entry and recording system as claimed in claim 7, and further comprising a vote head counter circuit in the vote head logic circuit for receiving the train of pulses from the clock circuit, and a data center counter circuit connected in the data center logic circuit and also coupled to the same clock circuit for receiving an identical train of pulses, thus maintaining synchronism between the pulses passed over the second conductor pair to the vote head and the pulses in the data center which regulate the operation of the data center logic circuit.

9. A vote entry and recording system as claimed in claim 8, and further comprising a third conductor pair, coupled between the vote head logic circuit and the data center logic circuit, for passing a reset pulse from the output side of the data center counter circuit to the vote head counter circuit, to maintain synchronism between the data center and the vote head.

10. A vote entry and recording system as claimed in claim 8, in which the data center logic circuit has means for storing a data processing program having fixed-format and variable-format portions, including a hard-wired circuit for regulating the fixed-format portion of the program and thus regulating the vote selection, accumulation and registration, and said election configuration memory is connected to receive the variable-format portion for a particular election, to regulate the validity of the vote selectors in the vote head and to prevent over-voting.

11. A vote entry and recording system as claimed in claim 10, and in which said data center further comprises a tape unit coupled to all of said memories, for receiving a tape cartridge on which the variable-format portion of the program has been stored and for passing that variable-format program to the memories.

12. A vote entry and recording system as claimed in claim 11, and further comprising a readout display coupled to the candidate count memory, in which said fixed-format portion of the program is connected to regulate transfer of the total votes in each race from the candidate count memory to the tape without changing the candidate count memory information, thus enabling the tape to be removed with a record of the votes cast and thereafter allowing the candidate count memory total to be read out from said readout display.

13. A vote entry and recording system as claimed in claim 11, and further comprising a power supply coupled to a back-up battery in the data center, connected such that upon interruption of power to the power supply the battery energizes the system as the data in all the memories is recorded on the tape, and upon restoration of power to the power supply the data is read out from the tape and recorded again in the memories.

14. A vote entry and recording system as claimed in claim 7, and further comprising a write-in apparatus including a roll of paper and a window which can be opened to allow the vote to write-in a candidate's name on the paper, which apparatus is positioned in said vote head coupled to the vote head logic circuit, a plurality of write-in control buttons in said vote head for regulating operation of the write-in apparatus in conjunction with the memory in the data center, to allow the voter to make a write-in selection for a given race in lieu of utilizing the vote selector buttons for that particular race.

15. A vote entry and recording system as claimed in claim 7, in which said optical unit in the vote head is a film drive and projector arrangement including a lamp and a continuous film strip with a plurality of successive frames depicting the candidates for each of the races to be presented to the voter, code means in a segment of each frame of the film strip to block or pass light directed from the projector lamp toward the front panel of the vote head, and a plurality of light-sensitive units positioned on the front panel of the vote head to provide electrical signals responsive to the incident light from the lamp passing through the code means of the film strip, thus providing a frame identification signal for passage over said first conductor pair to the data center to positively identify the frame then being presented to the voter.

16. A vote entry and recording system as claimed in claim 15, and in which said vote head includes a new page button for providing a signal to regulate the advance of the film strip in the projector unit, and a review ballot button connected to provide a reverse drive signal to the projector to reverse the travel of the film strip and enable the voter to review selections already made.

17. A vote entry and recording system as claimed in claim 7, and in which said vote head includes a judge's controls array positioned on one side of the vote head away from the front panel viewed by the voter, including an authorization key, an add button and individual page selector buttons connected to provide signals for passage over the first conductor pair to the data center and allow the judge to control which frames of the film strip will be presented to the voter, and also to allow the system to accumulate counts from different precincts for the same candidate in the data center by use of the page selector buttons.

18. A vote entry and recording system as claimed in claim 7, including at least one additional vote head coupled to the data center, and in which the data center includes a plurality of adapter circuits respectively coupled to the vote heads, for passing the pulse train to each of the vote heads.

19. The method of recording and tabulating votes cast by a voter, comprising the steps of:

providing a vote head with a plurality of vote buttons for actuation by the voter to indicate candidate selections;

providing a data center with a vote-accumulating memory;

generating a train of pulses in the data center;

passing the train of pulses to the vote head to continually scan all the vote buttons;

modifying a particular pulse in the pulse train in response to actuation of a particular vote button in the vote head by the voter; and returning the modified pulse train to the data center, wherein the modified pulse is detected and stored in the vote-accumulating memory.

20. A voting system for storing information regarding candidates and races for successive presentation to a voter, comprising:

a vote head including an optical unit for visually displaying the candidates in each race, means for selecting the candidate in each race, and a logic circuit coupled to the means for selecting the candidate; and a data center, coupled to the vote head by at least two conductor pairs, including memory means for storing processing instructions, for accumulating the total of votes cast in each race at the vote head, and for continually representing the status of the candidate selection means in the vote head, and a logic circuit coupled to a first one of the conductor pairs and to the memory means, which logic circuit includes means for generating a train of pulses for passage over the second of the conductor pairs to the vote head for continually scanning the candidate selection means in the vote head, with the logic means in the vote head being connected to change the representation of at least one pulse in the pulse train each time a candidate is selected, thus producing a modified pulse train which is returned over the first conductor pair to the data center in a time sequence which is synchronized with the pulse train passed over the second conductor pair to the vote head, to indicate the candidate selected at the vote head.

21. A voting system as claimed in claim 10, in which the vote head optical unit includes a cathode-ray tube, a light pen for the candidate selection means, a character generator coupled to the cathode-ray tube, and a buffer storage unit coupled to the character generator, and the data center includes a race memory for storing information including the identification of the candidates in each race.

* * * * *